US009211976B2

(12) United States Patent
Moehlenbrock et al.

(10) Patent No.: US 9,211,976 B2
(45) **Date of Patent: *Dec. 15, 2015**

(54) EASY OPEN AND RECLOSABLE PACKAGE WITH DISCRETE LAMINATE, WITH DIE-CUT, ANCHORED TO SECOND SIDE PANEL

(76) Inventors: Andrew W. Moehlenbrock, Simpsonville, SC (US); Sumita Sanjeevi Ranganathan, Simpsonville, SC (US)

( * ) Notice: Subject to any disclaimer, the term of this patent is extended or adjusted under 35 U.S.C. 154(b) by 322 days.

This patent is subject to a terminal disclaimer.

(21) Appl. No.: 13/221,256

(22) Filed: Aug. 30, 2011

(65) Prior Publication Data

US 2012/0207408 A1 Aug. 16, 2012

Related U.S. Application Data

(60) Provisional application No. 61/443,454, filed on Feb. 16, 2011.

(51) Int. Cl.
*B65D 65/26* (2006.01)
*B65D 65/28* (2006.01)
(Continued)

(52) U.S. Cl.
CPC ..... *B65D 33/1691* (2013.01); *B31B 19/00* (2013.01); *B65B 5/022* (2013.01); *B65B 9/06* (2013.01); *B65B 9/2028* (2013.01); *B65B 9/213* (2013.01); *B65B 51/303* (2013.01); *B65B 61/08* (2013.01); *B65D 75/58* (2013.01); *B65D 75/5827* (2013.01); *B65D 77/2032* (2013.01);
(Continued)

(58) Field of Classification Search
CPC ..... B65D 75/58; B65D 75/5805; B65D 75/5827; B65D 75/5833; B65D 75/5838; B65D 75/5844; B65D 75/5894
USPC ..... 383/5, 200, 203–210, 210.1, 211, 63, 383/61.2, 78, 84, 93, 81, 86, 87; 229/87.05, 229/92.1, 92.5, 92.7; 428/40.1, 41.7, 41.8, 428/42.2
See application file for complete search history.

(56) References Cited

U.S. PATENT DOCUMENTS 2,991,001 A 7/1961 Hughes
3,259,303 A 7/1966 Repko
(Continued)

FOREIGN PATENT DOCUMENTS

EP 0179624 A2 4/1986
EP 1676785 A1 7/2006
(Continued)

OTHER PUBLICATIONS

JP 3161665 Aug. 5, 2010, Amano, Y., Abstract 7 Drawings (11 pages).
(Continued)

*Primary Examiner* — Jes F Pascua
*Assistant Examiner* — Nina Attel

(57) ABSTRACT

An easy-open and reclosable package includes a pouch including a discrete laminate including a base strip and a panel section having a die cut defining a die cut segment, the panel section anchored to the base strip; the second surface of the base strip anchored to the inner surface of a second side panel; and the panel section anchored to a first side panel; and a product in the pouch. The die cut segment is so arranged with respect to the base strip that when the package is opened, the package can be reclosed by adhering the pressure sensitive adhesive to the first side panel.

5 Claims, 38 Drawing Sheets

(51) Int. Cl.

| | |
|---|---|
| ***B65D 65/30*** | (2006.01) |
| ***B65D 33/16*** | (2006.01) |
| ***B65D 75/58*** | (2006.01) |
| ***B31B 19/00*** | (2006.01) |
| ***B65B 5/02*** | (2006.01) |
| ***B65B 9/06*** | (2012.01) |
| ***B65B 9/20*** | (2012.01) |
| ***B65B 9/213*** | (2012.01) |
| ***B65B 51/30*** | (2006.01) |
| ***B65B 61/08*** | (2006.01) |
| ***B65D 77/20*** | (2006.01) |

(52) U.S. Cl.

CPC ..... *B65D 77/2096* (2013.01); *B31B 2219/269* (2013.01); *B31B 2219/6092* (2013.01); *B31B 2219/909* (2013.01); *B31B 2219/9019* (2013.01); *B31B 2219/9096* (2013.01); *B31B 2237/10* (2013.01); *B31B 2237/406* (2013.01); *B31B 2237/50* (2013.01)

(56) References Cited

U.S. PATENT DOCUMENTS

| | | | | |
|---|---|---|---|---|
| 3,272,424 | A | 9/1966 | Rodkey | |
| 3,349,993 | A | 10/1967 | Ells et al. | |
| 3,456,867 | A | 7/1969 | Repko | |
| 4,260,061 | A | 4/1981 | Jacobs | |
| 4,280,653 | A | 7/1981 | Elias | |
| 4,410,130 | A | 10/1983 | Herrington | |
| 4,759,643 | A | 7/1988 | Canno | |
| 4,785,940 | A | 11/1988 | Wilson | |
| 4,913,293 | A | 4/1990 | Sanders | |
| 4,934,535 | A | 6/1990 | Muckenfuhs et al. | |
| 5,044,772 | A | 9/1991 | Larson | |
| 5,089,320 | A | 2/1992 | Straus et al. | |
| 5,205,649 | A | 4/1993 | Fullerton | |
| 5,391,136 | A | 2/1995 | Makowka | |
| 5,601,368 | A * | 2/1997 | Bodolay et al. | 383/5 |
| 5,626,929 | A | 5/1997 | Stevenson | |
| 5,658,077 | A | 8/1997 | Hoftman | |
| 5,806,984 | A | 9/1998 | Yeager | |
| 5,836,697 | A | 11/1998 | Chiesa | |
| 5,855,435 | A | 1/1999 | Chiesa | |
| 5,882,749 | A | 3/1999 | Jones et al. | |
| 5,882,789 | A | 3/1999 | Jones et al. | |
| 5,954,433 | A | 9/1999 | Yeager | |
| 6,012,844 | A | 1/2000 | Huseman et al. | |
| 6,131,248 | A | 10/2000 | Tomic | |
| 6,196,716 | B1 | 3/2001 | Geyer | |
| 6,279,297 | B1 * | 8/2001 | Latronico | 53/412 |
| 6,302,321 | B1 | 10/2001 | Reese et al. | |
| 6,461,044 | B1 | 10/2002 | Anderson | |
| 6,502,986 | B1 | 1/2003 | Bensur et al. | |
| 6,517,243 | B2 | 2/2003 | Huffer et al. | |
| 6,659,645 | B1 | 12/2003 | Schulz | |
| 6,969,196 | B2 | 11/2005 | Woodham et al. | |
| 7,033,077 | B2 | 4/2006 | Taylor | |
| 7,165,888 | B2 | 1/2007 | Rodick | |
| 7,422,782 | B2 | 9/2008 | Haedt et al. | |
| 7,527,842 | B2 | 5/2009 | Mathy et al. | |
| 7,681,732 | B2 | 3/2010 | Moehlenbrock et al. | |
| 7,722,255 | B2 | 5/2010 | Chiesa | |
| 7,927,679 | B2 | 4/2011 | Cruz et al. | |
| 2003/0118254 | A1 | 6/2003 | Razeti et al. | |
| 2004/0013322 | A1 | 1/2004 | Taylor | |
| 2004/0179753 | A1 * | 9/2004 | Schneider et al. | 383/5 |
| 2006/0062496 | A1 | 3/2006 | Clune et al. | |
| 2006/0269707 | A1 | 11/2006 | Berbert | |
| 2008/0152264 | A1 | 6/2008 | Pokusa et al. | |
| 2009/0190866 | A1 * | 7/2009 | Hughes | 383/207 |
| 2009/0279813 | A1 | 11/2009 | Pokusa et al. | |
| 2009/0304874 | A1 | 12/2009 | Stephens et al. | |
| 2009/0311454 | A1 | 12/2009 | Stephens | |
| 2011/0036741 | A1 | 2/2011 | Moehlenbrock | |
| 2011/0038570 | A1 | 2/2011 | Moehlenbrock | |
| 2011/0038571 | A1 | 2/2011 | Moehlenbrock | |
| 2011/0103718 | A1 | 5/2011 | Bosman | |
| 2011/0147383 | A1 | 6/2011 | Soudais et al. | |
| 2011/0162993 | A1 | 7/2011 | Cruz | |
| 2011/0204056 | A1 | 8/2011 | Veternik et al. | |
| 2012/0156415 | A1 | 6/2012 | Willey et al. | |
| 2013/0114918 | A1 * | 5/2013 | Lyzenga et al. | 383/203 |

FOREIGN PATENT DOCUMENTS

| | | | |
|---|---|---|---|
| IT | 01319964 | | 3/2000 |
| WO | WO 0002782 | * | 1/2000 |
| WO | WO 0002782 A2 | * | 1/2000 |
| WO | WO2006/005848 | | 1/2006 |
| WO | WO2007057060 | | 5/2007 |
| WO | WO2008001768 | | 1/2008 |

OTHER PUBLICATIONS

Wipak Mission Reclosable, Apr. 2006, 8 pages.

* cited by examiner

EASY OPEN AND RECLOSABLE PACKAGE WITH DISCRETE LAMINATE, WITH DIE-CUT, ANCHORED TO SECOND SIDE PANEL

This application claims the benefit of U.S. Provisional Application No. 61/443,454, filed Feb. 16, 2011, that application incorporated herein by reference in its entirety.

FIELD OF THE INVENTION

This invention relates to an easy-open and reclosable package with a discrete laminate, with a die-cut, anchored to a second side panel, and to methods of making the package.

BACKGROUND OF THE INVENTION

Food and non-food products, including produce, snack foods, cheese and the like have long been packaged in containers such as pouches, bags, or lidded trays or formed webs made from various thermoplastic materials such as polyethylene, polypropylene, or polyester (PET). These containers can be formed from a web or webs of thermoplastic material on packaging equipment, using various packaging processes, at a processing/packaging facility. Such equipment and processes includes horizontal form/fill/seal (HFFS), vertical form/fill/seal (VFFS), thermoforming/lidstock, and continuous horizontal packaging (sometimes referred to as Flow-wrap). In each case, the product is manually or automatically placed in a pouch, bag, formed web, tray, etc., the filled container is optionally vacuumized or gas flushed, and the mouth of the container is hermetically or non-hermetically sealed to close and finish the package.

Opening of the finished package (i.e. opening with the use of tools such as scissors or knives) can provide access to the product by the consumer.

Common in the industry is the use of plastic zipper closures; press-to-close or slide zippers; interlocking closures; reclosable fasteners with interlockable fastener elements; interlocking rib and groove elements having male and female profiles; interlocking alternating hook-shaped closure members, and the like. These terms appear in the patent literature, and to some extent may overlap in meaning. These features provide reclosability, and in some cases may provide an easy-open feature to the package. However, such features are not always easy to open or reclose.

Also relatively common is the use of pressure sensitive adhesive to provide a reclosability feature to a package.

There is need in the marketplace for a package, and methods of packaging that can be used in a manner that requires little or no modification to the packager's packaging equipment, while providing a manually (i.e. by hand, without the need for tools such as scissors or knives) openable and easy to reclose feature, optionally while maintaining hermeticity of the package when made, and without the use of plastic zipper closures; press-to-close or slide zippers; interlocking closures; reclosable fasteners with interlockable fastener elements; interlocking rib and groove elements having male and female profiles; interlocking alternating hook-shaped closure members, and the like.

Some retail packages currently do not offer an easy-open and/or reclosable feature. Examples are some produce bags and snack food bags. In the produce market, there is a need for a cost-effective way to manually open, and repeatably reclose, retail produce bags, e.g. a package made in HFFS, VFFS, thermoforming/lidstock, or continuous horizontal packaging processes.

The present invention relates to a package, and methods of making the package, which package is manually openable, and reclosable, i.e. can be opened and reclosed a number of times, and adapted to package non-food products, as well as food products such as e.g. produce, snack foods, cheese, luncheon meat, sausage, culinary nuts, trail mix, etc., as well as products for the medical industry. The package optionally maintains a hermetic seal until the package is opened.

There is also a need in the marketplace for a discrete laminate that can be anchored to a processor's packaging material of choice to provide easy-open and reclosable functionalities to a package made from that web/laminate combination with only relatively minor modifications to the processor's packaging material, packaging process or equipment.

SUMMARY OF THE INVENTION

Statement of Invention/Embodiments of the Invention

In a first aspect, an easy-open and reclosable package comprises:

- a pouch comprising
  - a first and second side panel each comprising an outer and inner surface, a first and second side edge, and a first and second end, the first and second side panels joined together along their respective first and second side edges with a seal;
  - a first end;
  - a second end defined by the second ends of the first and second side panels respectively; and
  - a discrete laminate comprising
    - a base strip comprising a first and second surface, a first and second side edge, a first and second end, a sealing segment, a backing segment, and an intermediate layer disposed between the sealing and backing segments and comprising a pressure sensitive adhesive, and
    - a panel section comprising an outer and inner surface, a first and second side edge, a first and second end, and a die cut;
  - a first anchor seal whereby the first surface of the base strip is anchored to the inner surface of the panel section;
  - a second anchor seal whereby the second surface of the base strip is anchored to the inner surface of the second side panel; and
  - a third anchor seal whereby the panel section is anchored to the first side panel;
  - wherein
    - the panel section and the second side panel are joined together along their respective first and second side edges with a seal, and
    - the die cut defines a primary die cut segment, the primary die cut segment so arranged with respect to the base strip that when the package is opened, the package can thereafter be reclosed by adhering the pressure sensitive adhesive to the first side panel; and
- a product disposed in the pouch.

Optionally, according to various embodiments of the first aspect of the invention, taken alone or in any suitable combination of these embodiments:

- both the first and second surfaces of the base strip comprise a sealant.
- the first surface of the base strip is sealed to the inner surface of the panel section with an easy-open seal.
- the inner surface of the panel section comprises an easy-open sealant.
- the first surface of the base strip comprises an easy-open sealant.

a second part of the outer surface of the panel section is anchored to the inner surface of the first side panel.

a second part of the inner surface of the panel section is anchored to the outer surface of the first side panel.

the first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a second aspect, an easy-open and reclosable package comprises a pouch comprising a folded web comprising an exterior and interior surface, and a first and second edge, a first transverse seal at a first end of the folded web, a second transverse seal at a second end of the folded web, and a longitudinal seal extending along the length of the folded web;

a discrete laminate comprising a base strip positioned adjacent to and spaced apart from the longitudinal seal, the base strip comprising a first and second surface, a first and second end, a first and second side edge, a sealing segment, a backing segment, and an intermediate layer disposed between the sealing and backing segments and comprising a pressure sensitive adhesive, and a panel section comprising an outer and inner surface, a first and second side edge, a first and second end, and a die cut;

a first anchor seal whereby the first surface of the base strip is anchored to the inner surface of the panel section, a second anchor seal whereby the second surface of the base strip is anchored to the interior surface of the folded web, and a third anchor seal whereby the panel section is anchored to the folded web;

the die cut defining a primary die cut segment, the primary die cut segment so arranged with respect to the base strip that when the package is opened, the package can thereafter be reclosed by adhering the pressure sensitive adhesive to the folded web; and a product disposed in the pouch.

Optionally, according to various embodiments of the second aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the interior surface of the folded web.

a second part of the inner surface of the panel section is anchored to the exterior surface of the folded web.

the second end of the base strip extends beyond the second end of the panel section.

the second end of the panel section extends beyond the second end of the base strip.

the second end of the panel section is co-extensive with the second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the primary die cut segment is spaced apart from a first and second side seal respectively.

the primary die cut segment extends laterally across the package from the first side edge to the second side edge of the package.

the primary die cut segment is underlain entirely by at least one of a clear area, or the interior surface of the folded web.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a third aspect, a method of making an easy-open and reclosable package in a horizontal form/fill/seal process comprises providing a lay-flat web comprising a first and second surface;

providing a discrete laminate comprising a base strip comprising a first and second surface, and a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

advancing the lay-flat web to a forming device to convert the lay-flat web to a folded web;

advancing the discrete laminate such that when the package is made, the discrete laminate is part of the package;

making side seals in the folded web and the discrete laminate;

cutting the folded web and the discrete laminate to produce an open pouch comprising a first and second side panel each comprising an outer and inner surface, a first and second side edge, and a first and second end, the first and second side panels joined together along their respective first and second side edges by a seal, the panel section and second side panel joined along their respective first and second side edges by a seal;

putting a product in the open pouch; and sealing a first end of the pouch to close the pouch;

wherein the die cut defines a primary die cut segment, the primary die cut segment so arranged with respect to the base strip that when the package is opened, the package can thereafter be reclosed by adhering the pressure sensitive adhesive to the first side panel;

at any time during the method of making the package, anchoring the first surface of the base strip to the inner surface of the panel section to form a first anchor seal, anchoring the second surface of the base strip to the lay-flat web, the interior surface of the folded web, or the inner surface of the second side panel to form a second anchor seal, and anchoring the panel section to the lay-flat web, the folded web, or the first side panel to form a third anchor seal;

such that when the package is completed, the first surface of the base strip is anchored to the inner surface of the panel section, the second surface of the base strip is anchored to the inner surface of the second side panel, and the panel section is anchored to the first side panel; and the web is cut at the side seals during the step of making side seals in the folded web, or before, during or after any subsequent steps.

Optionally, according to various embodiments of the third aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a fourth aspect, a method of making an easy-open and reclosable package in a horizontal form/fill/seal process comprises providing a lay-flat web comprising a first and second surface;

providing a discrete laminate comprising a base strip comprising a first and second surface, a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

wherein i) the panel section is anchored to the lay-flat web, or ii) the second surface of the base strip is anchored to the lay-flat web;

advancing the lay-flat web with the discrete laminate anchored thereto to a forming device to convert the lay-flat web to a folded web;

making side seals in the folded web and the discrete laminate;

cutting the folded web and the discrete laminate to produce an open pouch comprising a first and second side panel each comprising an outer and inner surface, first and second side edges, and a first and second end, the first and second side panels joined together along their respective first and second side edges by a seal, the panel section and second side panel joined along their respective first and second side edges by a seal;

putting a product in the open pouch;

wherein the die cut defines a primary die cut segment, the primary die cut segment so arranged with respect to the base strip that when the package is opened, the package can thereafter be reclosed by adhering the pressure sensitive adhesive to the first side panel; and wherein the web is cut at the side seals during the step of making side seals in the folded web, or before, during or after any subsequent steps; and completing the anchoring of the discrete laminate to the lay-flat web, folded web, or side panels such that the first surface of the base strip is anchored to the inner surface of the panel section, the second surface of the base strip is anchored to the inner surface of the second side panel, and the panel section is anchored to the first side panel, and sealing a first end of the pouch to close the pouch.

Optionally, according to various embodiments of the fourth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a fifth aspect, a method of making an easy-open and reclosable package in a vertical form/fill/seal process comprises providing a lay-flat web comprising a first and second surface;

providing a discrete laminate comprising a base strip comprising a first and second surface, and a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

advancing the lay-flat web over a forming device to convert the lay-flat web to a folded web;

advancing the discrete laminate such that when the package is made, the discrete laminate is part of the package;

making a longitudinal seal in the folded web and the discrete laminate;

transversely sealing the folded web and the discrete laminate to produce a first transverse seal to define a first pouch, wherein the first transverse seal is a bottom transverse seal of the first pouch;

putting a product in the first pouch;

advancing the folded web and the discrete laminate, with the first pouch, downward a predetermined distance;

transversely sealing the first pouch to produce a top transverse seal in the first pouch, and a bottom transverse seal in a second pouch, the second pouch disposed above the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges, the panel section and second side panel joined along their respective first and second side edges;

wherein the die cut defines a primary die cut segment, the primary die cut segment so arranged with respect to the base strip that when the package is opened, the package can thereafter be reclosed by adhering the pressure sensitive adhesive to the first side panel; and at any time during the method of making the package, anchoring the first surface of the base strip to the inner surface of the panel section to form a first anchor seal, anchoring the second surface of the base strip to the lay-flat web, the interior surface of the folded web, or the inner surface of the second side panel to form a second anchor seal, and anchoring the panel section to the lay-flat web, the folded web, or the first side panel to form a third anchor seal;

such that when the package is completed, the first surface of the base strip is anchored to the inner surface of the panel section, the second surface of the base strip is anchored to the inner surface of the second side panel, and the panel section is anchored to the first side panel.

Optionally, according to various embodiments of the fifth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a sixth aspect, a method of making an easy-open and reclosable package in a vertical form/fill/seal process comprises providing a lay-flat web comprising a first and second surface;

providing a discrete laminate comprising a base strip comprising a first and second surface, and a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

wherein i) the panel section is anchored to the lay-flat web, or ii) the second surface of the base strip is anchored to the lay-flat web;

advancing the lay-flat web with the discrete laminate anchored thereto over a forming device to convert the lay-flat web to a folded web;

making a longitudinal seal in the folded web and the discrete laminate;

transversely sealing the folded web and the discrete laminate to produce a first transverse seal to define a first pouch, wherein the first transverse seal is a bottom transverse seal of the first pouch;

putting a product in the first pouch;

advancing the folded web and the discrete laminate, with the first pouch, downward a predetermined distance;

transversely sealing the first pouch to produce a top transverse seal in the first pouch, and a bottom transverse seal in a second pouch, the second pouch disposed above the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges, the panel section and second side panel joined along their respective first and second side edges; and wherein the die cut defines a primary die cut segment, the primary die cut segment so arranged with respect to the base strip that when the package is opened, the package can thereafter be reclosed by adhering the pressure sensitive adhesive to the first side panel;

the web is cut at the side seals during the step of making side seals in the folded web, or before, during or after any subsequent steps; and completing the anchoring of the discrete laminate to the lay-flat web, folded web, or side panels such that the first surface of the base strip is anchored to the inner surface of the panel section, the second surface of the base strip is anchored to the inner surface of the second side panel, and the panel section is anchored to the first side panel.

Optionally, according to various embodiments of the sixth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a seventh aspect, a method of making an easy-open and reclosable package having a formed web comprises providing a formed web having a first and second end, an inner and outer surface, and a product cavity;

providing a product;

providing a lidstock, having a first and second end, comprising a lay-flat web comprising an outer and inner surface, and a discrete laminate comprising a base strip comprising a first and second surface, and a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

placing the product in the product cavity;

sealing the inner surface of the lidstock to the formed web; and cutting the lidstock and formed web to make the package, wherein the die cut defines a primary die cut segment, the primary die cut segment so arranged with respect to the base strip that when the package is opened, the package can thereafter be reclosed by adhering the pressure sensitive adhesive to the lidstock;

at any time during the method of making the package, anchoring the first surface of the base strip to the panel section to form a first anchor seal, anchoring the second surface of the base strip to the inner surface of the formed web to form a second anchor seal, and anchoring the panel section to the lay-flat web to form a third anchor seal;

such that when the package is completed, the first surface of the base strip is anchored to the inner surface of the panel section, the second surface of the base strip is anchored to the inner surface of the formed web, and the panel section is anchored to the lay-flat web.

Optionally, according to various embodiments of the seventh aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the lay-flat web.

a second part of the inner surface of the panel section is anchored to the outer surface of the lay-flat web.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the primary die cut segment is spaced apart from a first and second side seal respectively.

the primary die cut segment is underlain entirely by at least one of a clear area, or the inner surface of the formed web.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In an eighth aspect, a method of making an easy-open and reclosable package having a formed web comprises providing a formed web having a first and second end, an inner and outer surface, and a product cavity;

providing a product;

providing a lidstock, having a first and second end, comprising a lay-flat web comprising an outer and inner surface, and a discrete laminate comprising a base strip comprising a first and second surface, and a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

wherein i) the panel section is anchored to the lay-flat web, or ii) the second surface of the base strip is anchored to the inner surface of the formed web;

placing the product in the product cavity;

sealing the lidstock to the inner surface of the formed web; and cutting the lidstock and formed web to make the package, wherein the primary die cut segment is so arranged with respect to the base strip that when the package is opened, the package can thereafter be reclosed by adhering the pressure sensitive adhesive to the lidstock; and completing the anchoring of the panel section to the lay-flat web and the base strip to the formed web such that when the package is completed, the first surface of the base strip is anchored to the inner surface of the panel section, the second surface of the base strip is anchored to the inner surface of the formed web, and the panel section is anchored to the lay-flat web.

Optionally, according to various embodiments of the eighth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the lay-flat web.

a second part of the inner surface of the panel section is anchored to the outer surface of the lay-flat web.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the primary die cut segment is spaced apart from a first and second side seal respectively.

the primary die cut segment is underlain entirely by at least one of a clear area, or the inner surface of the formed web.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a ninth aspect, a method of making an easy-open and reclosable package in a continuous horizontal packaging process comprises providing a lay-flat web comprising a first and second surface;

providing a discrete laminate comprising a base strip comprising a first and second surface, and a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

advancing the lay-flat web to a forming device to convert the lay-flat web to a folded web having an interior surface;

advancing the discrete laminate such that when the package is made, the discrete laminate is part of the package;

advancing a product to the forming device such that the folded web and the discrete laminate envelop the product;

making a longitudinal seal in the folded web and the discrete laminate;

transversely sealing the folded web and the discrete laminate, with the product therein, to produce a leading transverse seal to define a first pouch;

advancing the folded web and the discrete laminate, with the leading transverse seal, forward a predetermined distance;

transversely sealing the folded web to produce a trailing transverse seal in the first pouch, and a leading transverse seal in a second pouch, the second pouch disposed upstream of the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges, the panel section and second side panel joined along their respective first and second side edges;

wherein the die cut defines a primary die cut segment, the primary die cut segment so arranged with respect to the base strip that when the package is opened, the package can thereafter be reclosed by adhering the pressure sensitive adhesive to the first side panel; and at any time during the method of making the package, anchoring the first surface of the base strip to the inner surface of the panel section to form a first anchor seal, anchoring the second surface of the base strip to the lay-flat web, the interior surface of the folded web, or the inner surface of the second side panel to form a second anchor seal, and anchoring the panel section to the lay-flat web, the folded web, or the first side panel to form a third anchor seal;

such that when the package is completed, the first surface of the base strip is anchored to the inner surface of the panel section, the second surface of the base strip is anchored to the inner surface of the second side panel, and the panel section is anchored to the first side panel.

Optionally, according to various embodiments of the ninth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a tenth aspect, a method of making an easy-open and reclosable package in a continuous horizontal packaging process comprises providing a lay-flat web comprising a first and second surface;

providing a discrete laminate comprising a base strip comprising a first and second surface, and a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

wherein i) the panel section is anchored to the lay-flat web, or ii) the second surface of the base strip is anchored to the lay-flat web;

advancing the lay-flat web with the discrete laminate anchored thereto to a forming device to convert the lay-flat web to a folded web having an inner surface;

advancing a product to the forming device such that the folded web and the discrete laminate envelope the product;

making a longitudinal seal in the folded web and the discrete laminate;

transversely sealing the folded web and the discrete laminate, with the product therein, to produce a leading transverse seal to define a first pouch;

advancing the folded web and the discrete laminate, with the leading transverse seal, forward a predetermined distance;

transversely sealing the first pouch to produce a trailing transverse seal in the first pouch, and a leading transverse seal in a second pouch, the second pouch disposed upstream of the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges, the panel section and second side panel joined along their respective first and second side edges;

wherein the die cut is disposed in the folded web, the die cut defining a primary die cut segment, the primary die cut segment so arranged with respect to the base strip that when the package is opened, the package can thereafter be reclosed by adhering the pressure sensitive adhesive to the first side panel; and completing the anchoring of the discrete laminate to the lay-flat web, folded web, or side panels such that the first surface of the base strip is anchored to the inner surface of the panel section, the second surface of the base strip is anchored to the inner surface of the second side panel, and the panel section is anchored to the first side panel.

Optionally, according to various embodiments of the tenth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In an eleventh aspect, a pouch comprises a first and second side panel each comprising an outer and inner surface, a first and second side edge, and a first and second end, the first and second side panels joined together along their respective first and second side edges with a seal;

a first end;

a second end defined by the second ends of the first and second side panels respectively; and a discrete laminate having a first and second end, the discrete laminate comprising a base strip comprising a first and second surface, a first and second side edge, a first and second end, a sealing segment, a backing segment, and an intermediate layer disposed between the sealing and backing segments and comprising a pressure sensitive adhesive, the first and second surfaces of the base strip comprising a sealant, and a panel section comprising an outer and inner surface, a first and second side edge, a first and second end, and a die cut;

a first anchor seal whereby the first surface of the base strip is anchored to the inner surface of the panel section, a second anchor seal whereby the second surface of the base strip is anchored to the inner surface of the second side panel; and a third anchor seal whereby the panel section is anchored to the first side panel;

wherein the panel section and the second side panel are joined together along their respective first and second side edges with a seal, and the die cut defines a primary die cut segment, the primary die cut segment so arranged with respect to the base strip that when the package is opened, the package can thereafter be reclosed by adhering the pressure sensitive adhesive to the first side panel; and a product disposed in the pouch.

Optionally, according to various embodiments of the eleventh aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

the first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the pouch, and a package made from the pouch, is absent any zipper.

the pouch, and a package made from the pouch, can be opened with a peel force of from 25 grams/inch to 5 pounds/inch.

the primary die cut segment is completely underlain by the base strip.

the primary die cut segment is partially underlain by the base strip.

when a package made from the pouch, is opened, the base strip is not torn through the entire thickness of the base strip.

the first surface of the base strip is substantially free from PSA.

the second surface of the base strip is substantially free from PSA.

the second surface of the base strip comprises an adhesive.

the pouch, and a package made from the pouch, is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the pouch, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

In a twelfth aspect, a method of making a bag with a discrete laminate disposed thereon comprises extruding a thermoplastic tube to make a bag tubing;

providing a discrete laminate comprising a base strip comprising a first and second surface, a first and second side edge, a sealing segment, a backing segment, and an intermediate layer disposed between the sealing and backing segments and comprising a pressure sensitive adhesive, and a panel section comprising an outer and inner surface, a first and second side edge, and a die cut;

slitting the tubing at a longitudinal edge thereof to make a slit bag tubing;

anchoring the discrete laminate to the slit bag tubing; and transversely cutting and sealing the slit bag tubing at predetermined intervals to make a plurality of individual bags each with the discrete laminate disposed thereon, each bag comprising a first and second side panel each comprising an outer and inner surface, first and second side edges, and a first and second end, the first and second side panels joined together along their respective first and second side edges by a seal, a first end defined by the first ends of the first and second side panels respectively, an end fold defined by the second ends of the first and second side panels respectively;

wherein the die cut defines a primary die cut segment, the primary die cut segment so arranged with respect to the base strip that when the bag is sealed to make a package, and the package is then opened, the package can thereafter be reclosed by adhering the pressure sensitive adhesive to the first side panel; and at any time during the method of making the bag anchoring the first surface of the base strip to the inner surface of the panel section to form a first anchor seal, anchoring the second surface of the base strip to the bag tubing, the slit bag tubing, or the inner surface of the second side panel, and anchoring the panel section to the lay-flat web, the folded web, or the first side panel to form a third anchor seal;

such that when a package is made from the bag, the first surface of the base strip is anchored to the inner surface of the panel section, the second surface of the base strip is anchored to the inner surface of the second side panel, and the panel section is anchored to the first side panel.

Optionally, according to various embodiments of the twelfth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package can be opened with a peel force of from 25 grams/inch to 5 pounds/inch.

the primary die cut segment is completely underlain by the base strip.

the primary die cut segment is partially underlain by the base strip.

when the package is opened, the base strip is not torn through the entire thickness of the base strip.

the first surface of the base strip is substantially free from PSA.

the second surface of the base strip is substantially free from PSA.

the second surface of the base strip comprises an adhesive.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

when the primary die cut segment is removed or displaced, the sealing segment is at least partially removed from the base strip, and the intermediate layer comprising the pressure sensitive adhesive is at least partially exposed.

a secondary die cut segment is disposed between the primary die cut segment and an end of the package, the secondary die cut segment so arranged with respect to the base strip that when the secondary die cut segment is removed or displaced, the sealing segment is at least partially removed from the base strip, and the intermediate layer comprising the pressure sensitive adhesive is at least partially exposed.

the sealing segment comprises a single layer.

the backing segment comprises a single layer.

BRIEF DESCRIPTION OF THE DRAWINGS

The present invention is illustrated by reference to the following drawing figures, encompassing different views of various embodiments of the invention, wherein.

DEFINITIONS

Figure 1:
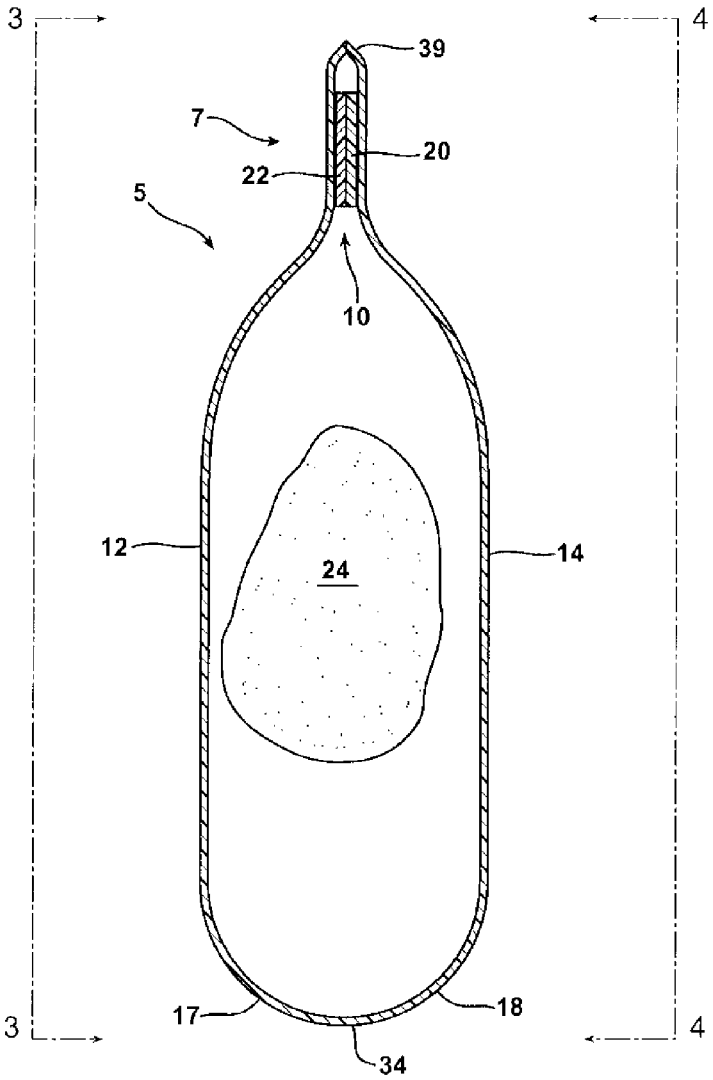
FIG. 1 is an elevational view of a package.

"Anchored", "anchoring" and the like herein refers to sealing or adhering two surfaces together, and refers to the resulting bond between surfaces. Sealing is done by means of a sealant. Adhering is done by means of a permanent adhesive or PSA.

In processes described herein where a discrete laminate is anchored to a web or side panel, either during the process wherein the web and discrete laminate are advanced, or when a discrete laminate has been pre-anchored to the web before the start of the process, anchoring can be done by use of any suitable continuous or discontinuous sealing or adhesive material and method. Such anchoring is done to hold the discrete laminate to the web or panel during the relevant packaging process.

In some embodiments, wherein the anchor is already relatively strong or continuous, e.g. a heat seal that constitutes either a relatively strong heat seal, or an easy-open seal as defined herein, the anchor functions not only to hold the discrete laminate to the web or panel during the relevant packaging process, but also as a final seal of that surface of the discrete laminate to the web (lay-flat or folded) or panel made from the web.

Any subsequent disclosed or recited step in the process of sealing one of the surfaces (i.e. the anchored surface) of the discrete laminate to a web or panel, is already completed by the anchoring step. In these embodiments, then, contact of a seal device, e.g. a seal bar in the region of the anchor, in a subsequent step, may add no further or separate seal to that surface of the discrete laminate.

Any subsequent step in the process of sealing the other surface of the discrete laminate to a web or panel, then, may in some embodiments add no further or separate seal to the anchored surface of the discrete laminate.

In some embodiments where the bond is a relatively weak or discontinuous one, e.g. a discontinuous seal, spots or narrow stripes of adhesive. etc., in a subsequent step of sealing one of the surfaces of the discrete laminate to the web or panel, a seal bar that seals one of the surfaces of the discrete laminate to the web or panel can contact the web or panel in the region where the anchor is already disposed. The seal in that region may be either enhanced, or initially created, by the subsequent sealing step.

Sealing of a surface of the discrete laminate to a web or panel, as a process step disclosed or recited herein, should be understood in this light.

"Backing segment" refers to a monolayer or multilayer portion of a base strip that can be sealed to a web, panel section or second side panel by a sealant.

"Closed-loop" herein refers to a die cut that defines a closed pattern or path in the panel section whereby the web material within the path (the die-cut segment) can be removed from the panel.

"Die cut" herein refers to methods of cutting or scoring materials, including rotary die, steel rule die, platen die cutting, and laser cutting or scoring, and/or the resultant cut or score. A die cut can extend entirely or partially through the relevant layer or web, and can leave intact a certain amount of material. "Score" and the like herein refers to a partial die cut that extends partly but not entirely through the thickness of a material, layer, web, panel, panel section, etc, The purpose of the score in the present invention is to provide for controlled tear or separation of material in the act of displacing or removing the die cut segment. The depth of the cut can vary from package to package, and within a single die cut on a given package.

"Die-cut segment" herein refers to a portion of the panel section that can be displaced or completely removed because of the presence of a closed loop or open loop die cut. The die-cut segment is a piece of the panel section, and when displaced or removed can sometimes function as a tamper evidence device, and facilitates access to the interior of the package.

"Discrete" with respect to the discrete laminate is used herein to mean independently made (the discrete laminate is not an integral part of the web when the web is made,) or constituting a separate entity from the web, and from a first or second side panel made from the web.

"Easy-open" herein refers to a package that can be manually opened relatively easily. The physical mode of opening may include any one or more of a) actual peeling at the base strip/web interface (adhesive failure), or b) a sealant layer of the base strip breaking completely through, and peeling then occurring between the sealant layer and an adjacent layer within the strip (delamination failure), or c) breaking within a sealant layer by rupturing of the sealant material itself (cohesive failure). The peel force required to open the package can be measured by an evaluation of seal strength or peel strength in accordance with the test procedure set out in ASTM F88, incorporated herein by reference in its entirety, using a cross-head speed of 8 to 12 inches/minute and an initial jaw gap of from 1.00 inch to 2.00 inch. Typical peel forces for opening the package of the invention can range from e.g. 25 grams/inch to 3 pounds/inch, e.g. from 100 grams/inch to 2 pounds/inch, such as from 200 grams/inch to 1.5 pounds/inch. In some cases, the sealant may actually peel away from the surface to which it is adhered (adhesive failure), or breakage of the sealant and delamination along an adjacent layer interface may occur (delamination failure) or a rupture of the sealant can occur (cohesive failure). Depending on the design and geometry of the seal, peel forces can in some embodiments be higher than 3 pounds/inch, e.g. 3.5, 4.0, 4.5, or 5 pounds/inch, or values intermediate these values. When a die cut segment is displaced or removed from the panel section, such that the PSA is exposed, in some embodiments some part of the scored portion of the die cut segment that remains after the die cutting process, may be torn through in the act of opening the package. The peel force required for this step in the opening process will be within the parameters discussed herein.

"Easy-open seal" herein refers to a seal involving the base strip and web in which materials and sealing conditions are chosen for the base strip and web such that the package is easy-open with a physical mode of opening that includes one or more of adhesive failure, delamination failure, or cohesive failure as described herein.

"Easy-open sealant" herein refers to a material chosen for one or both surfaces of the base strip, such that when such surface is sealed to a web, it provides a package that is easy-open with a physical mode of opening that includes one or more of adhesive failure, delamination failure, or cohesive failure as described herein.

"Ethylene/alpha-olefin copolymer" (EAO) herein refers to copolymers of ethylene with one or more comonomers selected from $C_3$ to $C_{10}$ alpha-olefins such as propene, butene-1, hexene-1, octene-1, etc. EAO includes heterogeneous materials such as linear medium density polyethylene (LMDPE), linear low density polyethylene (LLDPE), and very low and ultra low density polyethylene (VLDPE and ULDPE); single-site catalyzed materials such as homogeneous linear ethylene/alpha olefin copolymers and long chain branched ethylene/alpha olefin copolymers; and multicomponent ethylene/alpha-olefin interpenetrating network resin (or "IPN resin").

"Ethylene homopolymer or copolymer" herein refers to polyethylene (PE) such as ethylene homopolymer such as low density polyethylene (LDPE), medium density polyethylene (MDPE), high density polyethylene (HDPE); ethylene/alpha olefin copolymer such as those defined herein; ethylene/vinyl acetate copolymer (EVA); ethylene/alkyl acrylate copolymer such as ethylene/methyl acrylate copolymer (EMA) or ethylene/ethyl acrylate copolymer (EEA), or ethylene/butyl acrylate copolymer (EBA); ethylene/(meth)acrylic acid copolymer; or ionomer resin (IO).

"Fig." and the like herein refers to a drawing figure; "Figs." and the like herein to drawing figures.

"Film" is used herein to mean a thermoplastic film, laminate, or web, either multilayer or monolayer, that may be used in connection with the present invention. Film can be of any suitable thickness, e.g. between 0.1 and 30 mils.

"Fin seal" is used herein to mean, in the case of a single web, folding one edge of the web towards the opposite edge of the web, and sealing the facing inner surfaces together. In the case of two webs, a fin seal is a seal formed by sealing the inner surface of the edge of one web to the inner surface of a corresponding edge of another web.

"Lap seal" is used herein to mean a seal made by sealing an inside surface of a web to an outside surface of a web. The inside and outside surfaces can both be on a single web; or the inside surface can be of one web, and the outside surface of a second web.

"Lidstock" herein refers to a film used to cover a container or tray that carries a product, and can be sealed to the tray, typically as a perimeter heat seal. Lidstock typically is supplied to a food processor in a lay flat film rolled onto a roll.

"Longitudinal seal" herein refers to a fin seal or lap seal.

"Near" herein means, with respect to the position of the discrete laminate in relation to the package, that the first end 28 of the base strip of the discrete laminate closest to the first end of the pouch and package will be typically within about three inches of the first end of the pouch. The strip 10 can be closer than this, such as within about two inches, one and one quarter inches, one inch, 0.75 inches, 0.5, 0.4, 0.3, 0.2, or 0.1 inches of the first end of the pouch.

"Olefinic" and the like herein refers to a polymer or copolymer derived at least in part from an olefinic monomer.

"Open-loop" herein refers to a die cut that defines an open pattern or path in the panel section whereby the web material within the path or pattern (the die-cut segment) can be displaced from its original position on the panel section, e.g. by acting as a flap.

"Oxygen barrier" and the like herein refers to materials having an oxygen permeability, of the barrier material, less than 500 $cm^3$ $O_2/m^2$·day·atmosphere (tested at 1 mil thick and at 25° C., 0% RH according to ASTM D3985), such as less than 100, less than 50, less than 25, less than 10, less than 5, and less than 1 $cm^3$ $O_2/m^2$·day·atmosphere. Examples of polymeric materials useful as oxygen barrier materials are ethylene/vinyl alcohol copolymer (EVOH), polyvinylidene dichloride (PVDC), vinylidene chloride/methyl acrylate copolymer, vinylidene chloride/vinyl chloride copolymer, polyamide (nylon), and polyester (PET).

"Polymer" and the like herein means a homopolymer, but also a copolymer thereof, including terpolymer, tetrapolymer, block copolymer, etc.

"Pouch" herein means a pouch or bag.

"Pressure sensitive adhesive" (PSA) herein refers to a repositionable adhesive that bonds firmly with the application of light pressure. It adheres to most surfaces with very slight pressure; is available in solvent and latex or water based forms, and is often based on non-crosslinked rubber adhesives, acrylics, or polyurethanes. PSA forms viscoelastic bonds that are aggressively and permanently tacky; adhere without the need for more than hand pressure; and require no activation by water, solvent, or heat. Some PSA materials are cured by hot air, electron beam, UV, or chemical (peroxide) means. They are available in a wide variety of chemical compositions and systems including acrylic and methacrylate adhesives, emulsion-based acrylic adhesive; rubber-based pressure sensitive adhesive, styrene copolymers (styrene/isoprene/styrene and styrene/butadiene/styrene block copolymers), and silicones. In some embodiments, hot melt adhesives may be useful as well, are included herein for those embodiments as "PSA"; a hot melt adhesive is a thermoplastic adhesive compound, usually solid at room temperature which becomes fluid on heating for use. Suitable commercial examples of PSA include PS-2000™ from Dow, and "acResin®", available from BASF, and comprising a UV-curable polyacrylate that can be applied by conventional hot-melt coaters at temperatures of about 120° C. Suitable tackifiers can be added to acResin® or like compositions to control the tackiness of the adhesive; examples are FORAL® 85 synthetic resin available from Pinova. Tackifiers can be added to the base adhesive composition in any suitable amount, e.g. from 15% to 25% by weight of the total composition of PSA and tackifier, or higher than 25% by weight of the total composition of the PSA and tackifier. In some embodiments, the PSA can be blended with an olefinic additive such as polyethylene, ethylene/methyl acrylate copolymer, or ethylene/vinyl acetate copolymer. These blends can be in any suitable proportions of the PSA and olefinic additive, as long as the easy-open and reclosable functionality of the package is substantially maintained. Extrudable pressure sensitive hot melt adhesive, having an appropriate melt index and melt strength, can be extruded as an intermediate layer within a multilayer structure made by a blown or cast film process. This layer would impart the reclosable characteristics to the structure. Examples of extrudable PSA materials include but not limited to the M-series materials such as M3156T™ and M551™ available from Bostik; HL2942M™ available from H B Fuller; and VECTOR™ 4114A and 4186A available from Dexco. Alternatively, blends of these materials can be made with compatible materials that may act as processing aids, without unduly compromising the reclose characteristics of the original PSA. Extrudable adhesive chemistries include styrene-Isoprene-styrene and styrene-butadiene-styrene copolymers, including both the linear blocks (e.g. the resins from Bostik) and radial blocks (the VECTOR resins); silicones; high comonomer content EVA, EMA, EBA etc. based formulations; and INFUSE™ olefinic block copolymer based materials. Those skilled in the art will appreciate, after a review of this disclosure, that a particular PSA can be selected based at least in part on the particular process used to produce the film from which the base strip is made, e.g. coextrusion, extrusion coating, etc., and the appropriate rheology and process characteristics of the PSA desired for that process, while ensuring that the easy-open and reclosable features of the package made in accordance with the invention are substantially maintained.

"Reclosable" herein refers to a feature or function of a package in accordance with the invention whereby a package can be reclosed by bringing a folded web, panel, or panel section, or portion of a folded web, panel, or panel section into contact with the PSA of the base strip.

"Registration device" herein refers to any mark, pattern, die cut or feature of a web or discrete laminate, that facilitates the advancement of the web or discrete laminate, or a component thereof, in a controlled manner, into a packaging machine, where the web and/or discrete laminate is used to make individual packages. The device can be e.g. printed or placed in uniformly spaced fashion along or near an edge of the web or discrete laminate, i.e. registration marks, or in an area near the middle of a web that does not interfere with decorative printed graphics. These marks are used in connection with appropriate sensors to controllably advance the web or discrete laminate. Where die cuts are used as a registration device, detected by sensors, it may not be necessary to print registration marks on the web or discrete laminate.

"Seal" herein means a bond between two thermoplastic surfaces, e.g. as produced by heat sealing, radio frequency (RF) sealing, ultrasonic sealing, or permanent adhesive, but excluding repositionable adhesive or PSA.

"Sealant" is a polymeric material or blend of materials, such as olefinic polymer or copolymer such as an ethylenic polymer or copolymer, that can form a surface of the base strip or panel section of the invention, or a web to which the base strip or panel section is sealed, and form a bond between two thermoplastic surfaces. A permanent adhesive can also be a sealant. "Sealant" herein, with respect to the base strip or panel section, or a web to which the base strip or panel section is adhered, excludes a repositionable adhesive or PSA.

"Sealing segment" refers to a monolayer or multilayer portion of a base strip that can be sealed to a web or first side panel by a sealant.

"Strip" and "panel section" herein refers to an elongate piece of thermoplastic material, typically longer in a first direction than in a direction perpendicular to the first direction, e.g. rectangular; but can also be square, round, oblong, elliptical, or any appropriate shape in plan view. The strip and panel section can be of any suitable thickness, e.g. between 0.1 and 30 mils.

"Tamper evidence", "tampering", and the like herein refers to visual evidence of a breach in a package; i.e. that someone has accidentally or intentionally opened or partially opened the package, or attempted to do so.

"Tape" herein refers to a strip with PSA adhered to at least a portion of a first surface of the strip.

"Thermoplastic" herein includes plastic materials that when heated to a softening or melting point may be reshaped without significant thermal degradation (burning). Thermoplastic includes both materials that are not crosslinked, or that are crosslinked by chemical or radiation means.

"Tray" herein refers to a formed member that has a tray bottom, tray sides, and a tray flange around the upper perimeter of the tray, where the tray bottom and tray sides form an internal cavity within which a product can be placed. The cavity can be enclosed by a lidstock sealed to the tray flange.

"Web" is used herein to mean a thermoplastic film, laminate, or web, either multilayer or monolayer, that may be used in connection with the present invention. The web can be of any suitable thickness, e.g. between 0.1 and 30 mils, and the web can be of any suitable length and width.

"Zipper" and the like herein refers to a plastic zipper closure; press-to-close or slide zipper; interlocking closure; reclosable fastener with interlockable fastener elements; interlocking rib and groove elements having male and female profiles; interlocking alternating hook-shaped closure, and the like.

All compositional percentages used herein are presented on a "by weight" basis, unless designated otherwise.

Drawings herein are not necessarily to scale, and certain features of the invention may be graphically exaggerated for clarity.

DETAILED DESCRIPTION OF THE INVENTION

1. Package

Referring to the drawings, a package 5 according to the invention is shown. Package 5 includes a pouch 7 that can be made from either a single web, or two webs, to form a first side panel 12, and a second side panel 14.

A. Web(s)

In either embodiment, the web or webs comprises a thermoplastic material of any suitable composition, including those having as at least one component olefinic materials such as ethylene or propylene polymers or copolymers, e.g. polyethylene or ethylene/alpha olefin copolymers; polyethylene terephthalate (PET); and including webs typically used in, or useful in, HFFS, VFFS, lidstock/tray, continuous horizontal packaging, and bag making apparatus and processes. The web or webs can be monolayer or multilayer in construction, can be coextruded, laminated, or made by any suitable film making process, and can have any suitable thickness.

Examples of web(s) that can be used with a discrete laminate of the invention include H7225B™, a barrier hybrid material used for products requiring a high oxygen barrier, such as shredded cheese; H7525B™, a barrier hybrid material used for products requiring a high oxygen barrier, such as bacon and smoked and processed meat; H7530B, like H7525B but having a thickness of about 3 mils; CP04140™, a low barrier (high OTR) material used in produce packaging, CPM4090, a microwaveable packaging film for fresh cut produce; and T7225B™, a barrier material used as lidstock (non-forming web) for products requiring a high oxygen barrier, such as luncheon meat. These are all commercial products produced by the Cryovac business unit of Sealed Air Corporation.

H7225B™ is a laminate having the construction PET//adhesive//coextruded barrier film, where the PET is a biaxially oriented polyester film, and the barrier film has the construction LDPE (low density polyethylene)/EVA tie/nylon/EVOH+nylon/nylon/EVA tie/EAO. The overall thickness of the laminate of this construction can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7225B™ can be used as a lidstock (non-forming) web.

H7525B™ is a laminate having the construction PET//adhesive//coextruded barrier film, where the PET is a biaxially oriented polyester film, and the barrier film has in one embodiment the construction LDPE (low density polyethylene)/EVA/LLDPE tie/EVOH/LLDPE tie/EVA/EAO. The overall thickness of the laminate of this construction can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7525B™ can be used as a lidstock (non-forming) web.

CP04140™ is a laminate having the construction BOPP//adhesive/monolayer LLDPE film. A typical gauge for the laminate is about 1.8 mils. The LLDPE typically acts as the heat sealant layer of the finished laminate, and in packaging made from the laminate, the LLDPE will form the inner or sealant surface of the package, facing the contained product, and the BOPP will form the outer or skin surface of the package.

CPM4090™ is a laminate having the construction BOPP//adhesive/monolayer LLDPE+LDPE film. A typical gauge for the laminate is about 2 mils. The LLDPE+LDPE layer typically acts as the heat sealant layer of the finished laminate, and in packaging made from the laminate, the LLDPE+LDPE will form the inner or sealant surface of the package, facing the contained product, and the BOPP will form the outer or skin surface of the package.

T7225B™ film has the construction EAO/EAO/LLDPE tie/nylon/EVOH/nylon/EVA tie/EVA tie/nylon. The first layer of EAO typically acts as the heat sealant layer of the film, and in packaging made from the laminate, the EAO will form the inner or sealant surface of the package, facing the contained product, and the nylon of the last layer will form the outer or skin surface of the package. T7225B™ is used as a lidstock (non-forming) web.

Referring to the drawings, the first side panel 12 has a top portion 9, a first side edge 31, a second side edge 33, and a lower portion 17. The second side panel 14 has a top portion 11, a first side edge 35, a second side edge 37, and a lower portion 18. The first and second side panels 12 and 14 are joined together along their respective first and second side edges by either a seal or a fold. As shown, first side edge 31 of first side panel 12 is joined to first side edge 35 of second side panel 14 by a seal 30. Second side edge 33 of first side panel 12 is joined to second side edge 37 of second side panel 14 by a heat seal 32. The second end 34 of the pouch 7 can be either a seal or a fold. Where a single web is used to make the pouch, second end 34 will typically be a fold, although even after the web is folded, a seal such as a heat seal can optionally be installed in the area of the fold. Where two webs of film are used to make panels 12 and 14, second end 34 will be a seal that joins panels 12 and 14 together along their respective lower portions 17 and 18. The two webs can be from the same material, or can be different in composition, structure, etc.

B. Discrete Laminate

1. Geometry and Placement in Package

Figure 4:
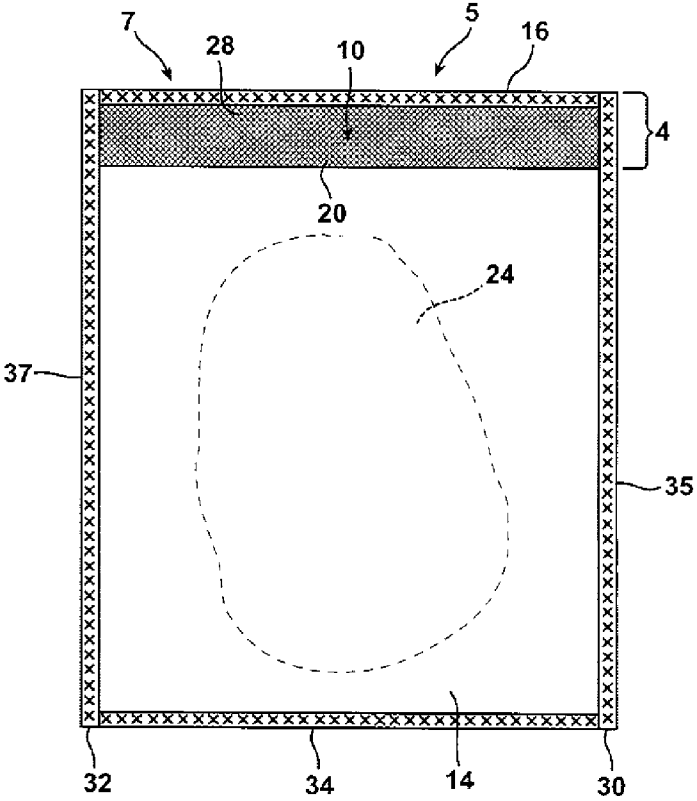
FIG. 4 is a back view of the package of FIG. 1, viewed along lines 4-4 of FIG. 1.
Figure 3:
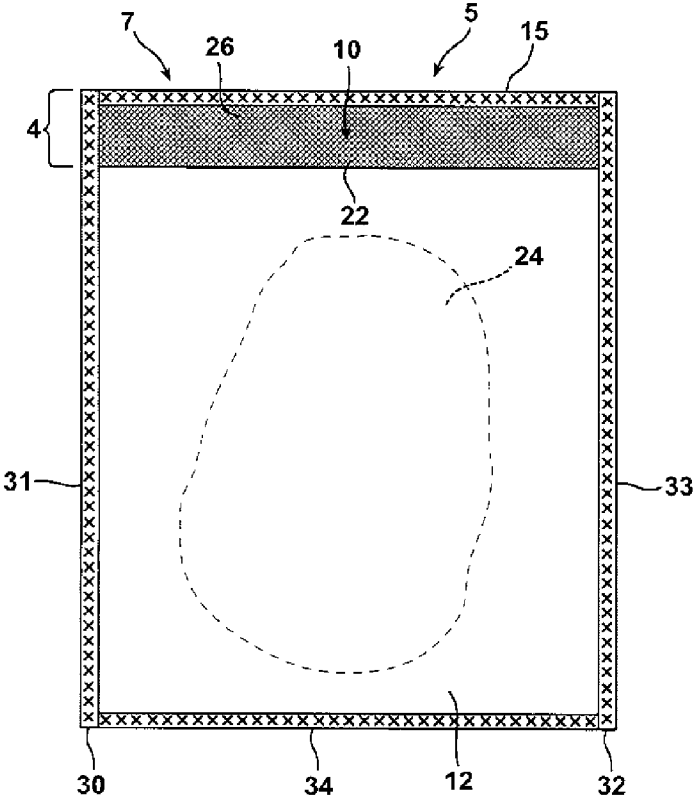
FIG. 3 is a front view of the package of FIG. 1, viewed along lines 3-3 of FIG. 1.

A discrete laminate 4 includes a panel section 6 having an outer surface 66 and inner surface 67, and a base strip 10. The second surface of the base strip 10 is anchored to the inner surface of second panel 14 at sealing zone "A", e.g. with a strong (regular) seal. The laminate, panel section, and base strip can each be of any suitable dimension and shape, and will typically be longer in length than in width, with the length being e.g. greater than two times the width, e.g. greater than 3, 4, or 5 times the width. A typical dimension for the discrete laminate is a width of from about 1 to 1.5 inches and a length of about 4 to 10 inches. The strip 10 will be shorter in one dimension than the pouch and package. For example, the strip can extend across the transverse width of a pouch made in e.g. a HFFS or VFFS process, but will be significantly narrower than the length of the package (see e.g. FIGS. 3 and 4). In one embodiment, the strip will occupy less than 50%, such as less than 40%, less than 30%, less than 20%, or less than 10% of the length of the package.

Base strip 10 comprises a first surface 23 and a second surface 25. In one embodiment, both of these first and second surfaces comprises a sealant. The second surface 25 is anchored to the inner surface 29 of the second side panel 14. The film strip can be of multilayer or monolayer construction.

When a product 24 is placed in the pouch 7, by any suitable process such as processes herein disclosed, and the pouch 7 is closed, the package 5 is made.

In some cases, the strip can be spaced apart from but near an end of the pouch or package. "Near" herein means that the first end 28 of the base strip closest to the first end of the pouch and package will be typically within about three inches of the first end of the pouch. The strip 10 can be closer than this, such as within about two inches, one and one quarter inches, one inch, 0.75 inches, 0.5, 0.4, 0.3, 0.2, or 0.1 inches of the first end of the pouch.

The base strip can each be of any suitable thickness. The base strip can for example have a thickness of between 2.0 and 5.0 mils, such as between 2.5 and 4.5 mils, between 3.0 and 4.0 mils, or any thicknesses therebetween. Factors such as the composition of the base strip, arrangement of layers within the base strip, and flexural modulus of the materials used may affect the choice of appropriate thickness of the base strip. The PSA can also have any suitable thickness, typically 0.5 mils, e.g. between 0.1 mil and 1 mil, or 0.2 mils and 0.8 mils, etc.

Any suitable web, including any of the hybrid materials of the type described herein for web materials can be used to make the panel section 6 and base strip 10.

The panel section 6 is anchored to the first side panel.

Panel section 6 is anchored to the first side panel by anchoring a second part of the inner surface 67 of panel section 6 to the outer surface 59 of first side panel 12 (see anchoring region "G" in FIGS. 2A through 2C), or by anchoring a second part of the outer surface 66 of panel section 6 to the inner surface 27 of first side panel 12.

Figure 2:
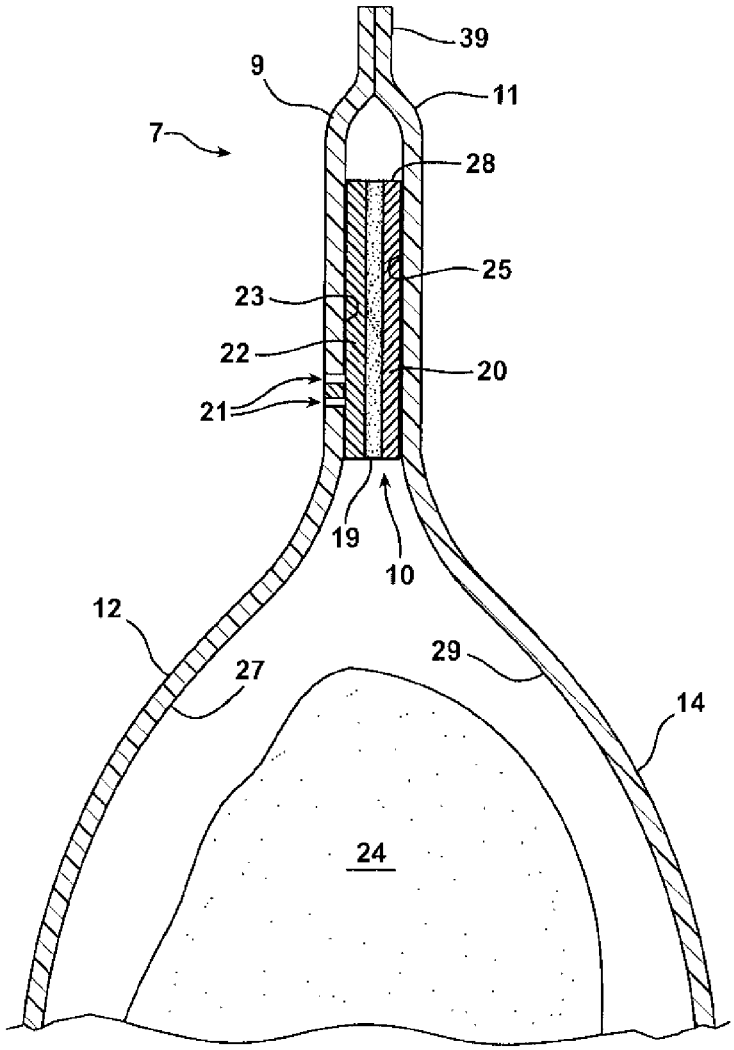
FIG. 2 is an enlarged view of the package of FIG. 1.
Figure 2A:
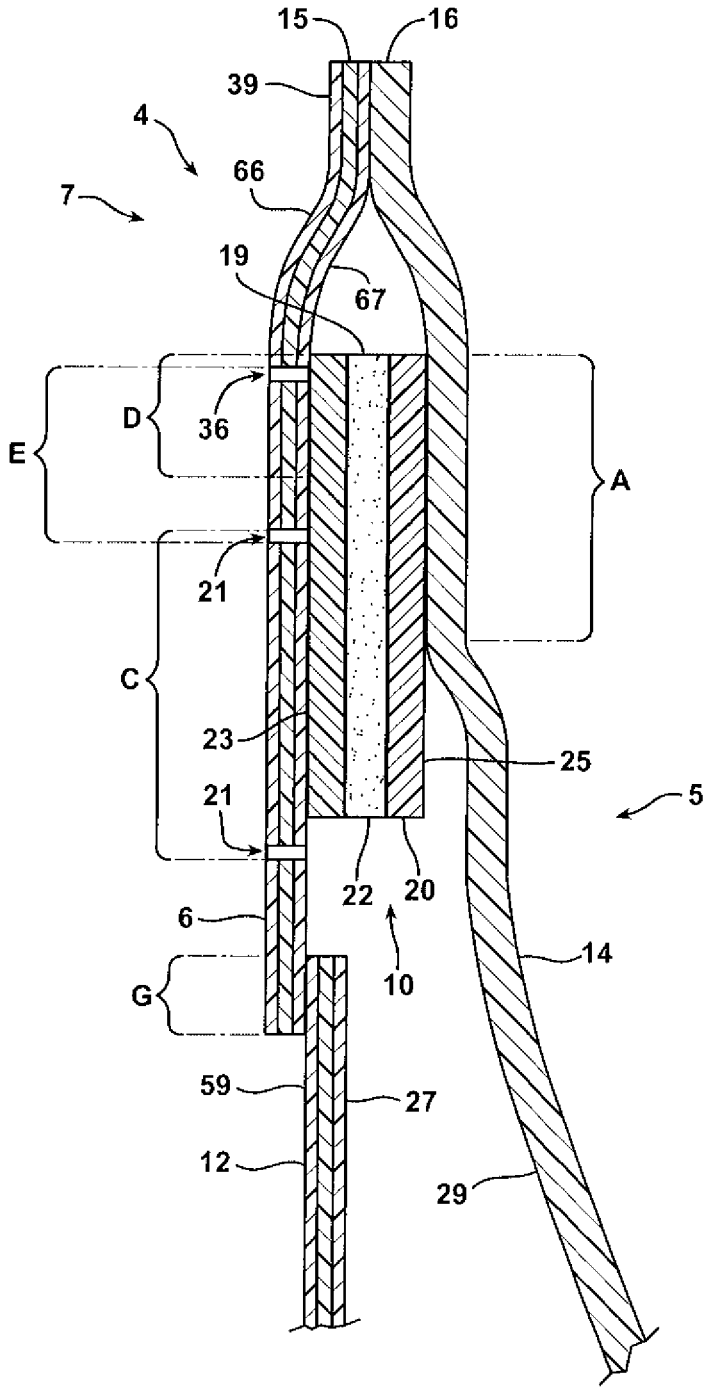
FIG. 2A is an enlarged cross-sectional view of a portion of FIG. 1.
Figure 5A:
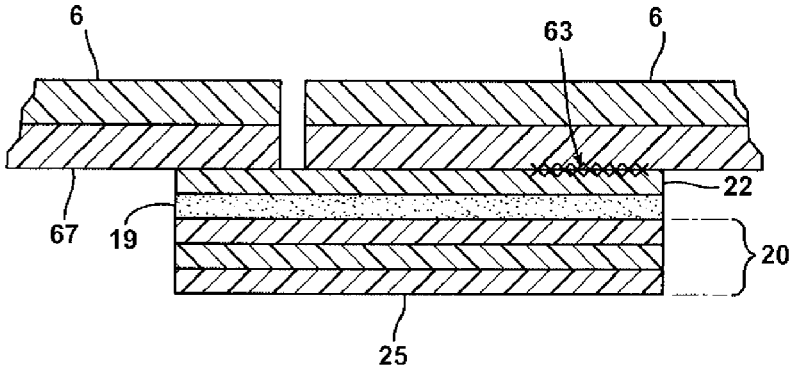
FIG. 5A is a schematic cross-sectional view of a portion of a package.
Figure 5B:
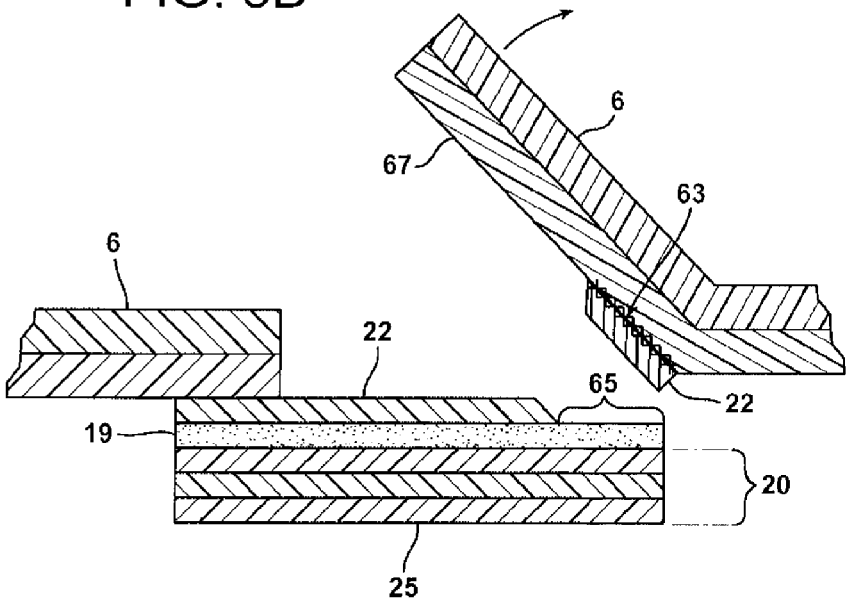
FIG. 5B is a schematic cross-sectional view of a portion of the package of FIG. 5A, shown with the package being opened.

As shown in the drawings, a first portion of the first surface 23 of the base strip is anchored to the inner surface 67 of panel section 6 at a first location (sealing zone "D") to form a first anchor seal 63 (see also FIGS. 5A and 5B), providing an easy-open mechanism as described herein. The second surface 25 of the base strip is sealed to the inner surface of the second side panel 14 with a strong (regular) seal to form a second anchor seal shown as sealing zone "A". A second portion of the first surface 23 of the base strip is anchored to the inner surface 27 of first side panel 12 at sealing zone "G" to form a third anchor seal. The functionality of this arrangement in providing an easy-open and reclosable package is disclosed in more detail herein When the appropriate die cut segment is removed or displaced from the package to open the package, the first end of the front of the package effectively becomes the first end of the portion of the panel section that remains after the die cut segment is removed or displaced. To illustrate, in a typical package orientation, shown in elevation view in FIG. 2A, the original first end of the package 5 is the top of the package, defined by top ends 9 and 11 (see FIG. 2) of the panel section and second side panel respectively. When the die cut segment defined by "C" is removed, the top or first end of the front of the package becomes the location of the panel section where the lowest die cut 21 was located (the lower end of "C" in the drawing.) It is a characteristic of the invention that the location of the first end of panel section 6 after opening, which in the embodiment of FIG. 2A is the top of that panel section after opening, is lower, i.e. further from the first end (top) of the package, than the pressure sensitive adhesive 19. Of course, more generally, the first end of the panel section will after opening be typically further from a given end of the package than the pressure sensitive adhesive.

2. Strip Construction

In general, strip 10 can have any total thickness desired, and each layer can have any thickness desired, so long as the strip and package provide the desired functionalities. Typical total film thicknesses are from 0.1 mils to 15 mils, such as 0.2 to 12 mils, such as 0.5 mils to 10 mils, 0.8 mils to 8 mils, and 1 mil to 4 mils. Suitable gauges include 1.5 mils, 2 mils (as in Example 1); and 3 mils.

The base strip of the invention is made from a multilayer film. A representative film structure suitable for use as the discrete strip 10 according to the invention is shown in FIGS. 2 through 2C. In one embodiment, this film is a three layer coextruded film and has the composition shown in Table 1.

TABLE 1

(Example 1)

| Layer | Composition | Gauge (thickness %) | Gauge (mils) | Gauge (microns) |
|---|---|---|---|---|
| 20 | Polyethylene | 33.3 | 0.50 | 12.7 |
| 19 | PSA | 33.4 | 0.50 | 12.7 |
| 22 | Polyethylene | 33.3 | 0.50 | 12.7 |

In the embodiment of example 1, layer 22 functions as a sealant layer for sealing to a first portion of an inner surface of a front or first side panel or surface of a web to be made into a package. Layer 22 also comprises a single layer, and comprises sealing segment 22. Layer 20 functions as a sealant layer for sealing to an inner surface of a back or second side panel or surface of a web to be made into a package. Layer 20 also comprises a single layer, and comprises backing segment 20. Thus, either or both of sealing segment 22 and backing segment 20 can comprise, and consist of, only one layer.

A film of the construction of the film of Example 1 is commercially available in Europe, and sold as T174RC2™ from B-Pack, used as a primary web for a package, not as a discrete strip to be used in a package as disclosed herein.

Alternative three layer coextruded film structures, suitable for use in the invention, that were made in-house on a flat cast line include the films shown below in Table 2:

TABLE 2

(Examples 2 to 9)

| Example | Sealant Layer 22 | Reclose Layer 19 | Skin Layer 20 |
|---|---|---|---|
| 2 | IO1 | PSA1 | AD3 |
| 3 | IO2 | PSA1 | AD3 |
| 4 | IO3 | PSA1 | AD3 |
| 5 | IO4 | PSA1 | AD3 |
| 6 | IO5 | PSA1 | AD3 |
| 7 | EA3 | PSA1 | AD3 |
| 8 | EA1 | PSA1 | AD3 |
| 9 | EA2 | PSA1 | AD3 |

In each of examples 2 through 9 of Table 2, sealant layer 22 was 0.4 mils thick; the reclose layer 19 was 0.6 mils thick; and skin layer 20 was 1 mil thick.

Figure 6:
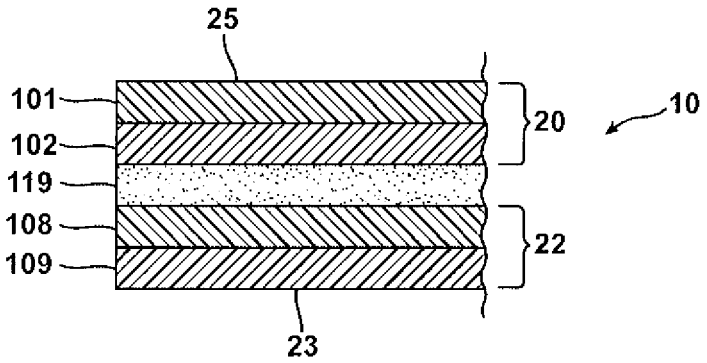
FIG. 6 is a cross-sectional view of a base strip.

Another representative film structure suitable for use as the film strip 10 according to the invention is shown in FIG. 6. In one embodiment, this coextruded five-layer film has the composition shown in Table 3.

TABLE 3

(Example 10)

| Segment | Layer | Composition | Gauge (thickness %) | Gauge (mils) | Gauge (microns) |
|---|---|---|---|---|---|
| backing segment 20 | 101 | 98% PE7 + 2% AB2 | 21.74 | 0.39 | 10.0 |
| | 102 | EV2 | 17.39 | 0.31 | 8.0 |
| | 119 | PSA1 | 32.61 | 0.59 | 15.0 |
| sealing segment 22 | 108 | EMAA1 | 7.61 | 0.14 | 3.5 |
| | 109 | 99% PE7 + 1% AB2 | 21.74 | 0.39 | 10.0 |

In the embodiment of example 10, layer 109 functions as a sealant layer for sealing to a first portion of an inner surface of a front or first side panel or surface of a web to be made into a package. Layer 108 functions as a sealant support layer, and also as a tie layer to bond the sealant layer 109 to the PSA layer 119. Thus, in this embodiment, sealing segment 22 comprises two layers, layers 109 and 108. In general, sealing segment 22 can comprise any suitable number of layers, such as one, two, or three or more layers, as long as the easy-open/reclose functionality of the package made from the web and base strip is maintained.

In the embodiment of example 10, layer 101 functions as a sealant layer for sealing to the inner surface of a back or second side panel or surface of a web to be made into a package. Layer 102 functions as a tie layer to bond the sealant layer 101 to the PSA layer 119. Thus, in this embodiment, backing segment 20 comprises two layers, layers 101 and 102. In general, backing segment 20 can comprise any suitable number of layers, such as one, two, or three or more layers, as long as the easy-open/reclose functionality of the package made from the web and base strip is maintained. In some embodiments, backing segment 20 can include one or more functional layers such as e.g. oxygen barrier layers.

A commercial example of a film of the construction of the film of Example 10 is available in Europe, used there as a primary web for a package.

Figure 7:
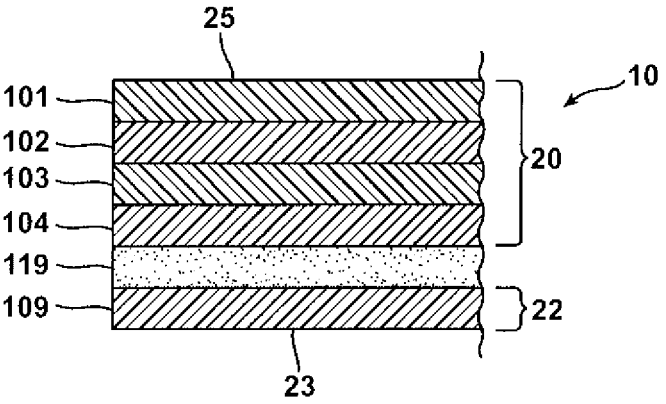
FIG. 7 is a cross-sectional view of a base strip according to another embodiment.

Another representative film structure suitable for use as the film strip 10 according to the invention is shown in FIG. 7. In one embodiment, this coextruded six-layer film has the composition shown in Table 4.

TABLE 4

(Example 11)

| Segment | Layer | Composition | Gauge (thickness %) | Gauge (mils) |
|---|---|---|---|---|
| backing segment 20 | 101 | PE7 | 20.00 | 0.4 |
| | 102 | AD3 | 10.00 | 0.2 |
| | 103 | OB1 | 10.00 | 0.2 |
| | 104 | AD3 | 10.00 | 0.2 |
| | 119 | PSA1 | 30.00 | 0.6 |
| sealing segment 22 | 109 | 99% PE7 + 1% AB3 | 20.00 | 0.4 |

In the embodiment of example 11, layer 109 functions as a sealant layer for sealing to a first portion of an inner surface of a front or first side panel or surface of a web to be made into a package. Thus, in this embodiment, sealing segment 22 comprises one layer, layer 109.

In the embodiment of example 11, layer 101 functions as a sealant layer that can be used for sealing to the inner surface of a back or second side panel or surface of a web to be made into a package. Layer 103 functions as an oxygen barrier layer, and tie layers 102 and 104 bond the oxygen barrier layer 103 to the sealant layer 101 and PSA layer 119 respectively. Thus, in this embodiment, backing segment 20 comprises four layers, layers 101, 102, 103 and 104.

EXAMPLE 12

A film is made like the film of Example 11, but in which PSA2 is used instead of PSA1.

EXAMPLE 13

A film is made like the film of Example 11, but in which layer 109 comprises 98% EA3+2% AB3.

EXAMPLE 14

A film is made like the film of Example 13, but in which PSA2 is used instead of PSA1.

The materials disclosed in Tables 1 to 4, and other materials referred to elsewhere in the present application, are identified in Table 5.

TABLE 5

| Material Code | Tradename Or Designation | Source(s) |
|---|---|---|
| AB1 | 10853 ™ | Ampacet |
| AB2 | aB60051LD ™ | IMCD Italia SPA |
| AB3 | FSU 255E ™ | Schulman |
| AD1 | BYNEL ™ 39E660 ™ | DuPont |
| AD2 | PLEXAR ™ PX3236 ™ | LyondellBasell |
| AD3 | PLEXAR ™ PX3227 | LyondellBasell |
| EA1 | PRIMACOR ™ 3330 | Dow |
| EA2 | PRIMACOR ™ 3150 | Dow |
| EA3 | PRIMACOR ™ 1430 | Dow |
| EMAA1 | NUCREL ™ 1202 | DuPont |
| EV1 | ESCORENE ™ LD318.92 ™ | ExxonMobil |
| EV2 | EVATANE ™ 28-03 | Arkema |
| IO1 | SURLYN 1650 ™ | DuPont |
| IO2 | SURLYN 1857 ™ | DuPont |
| IO3 | SURLYN 1652 ™ | DuPont |
| IO4 | SURLYN 1705 ™ | DuPont |
| IO5 | SURLYN 1706 ™ | DuPont |
| OB1 | SOARNOL ™ ET3803_ ™ | Nippon Gohsei |
| PE1 | PE ™ 1042cs15 ™ | Flint Hills |
| PE2 | AFFINITY ™ PL 1888G ™ | Dow |
| PE3 | PETROTHENE ™ NA 345-013 ™ | LyondellBasell |
| PE4 | — | — |
| PE5 | EXCEED ™ 3512CB ™ | ExxonMobil |
| PE6 | — | — |

TABLE 5-continued

| Material Code | Tradename Or Designation | Source(s) |
|---|---|---|
| PE7 | SURPASS ™ FPs317-A | Nova Chemical |
| PSA1 | M3156 ™ | Bostik |
| PSA2 | M550 ™ | Bostik |

AB1 is a masterbatch having about 81% linear low density polyethylene, and about 21% of an antiblocking agent (diatomaceous earth).
AB2 is a masterbatch having about 80% linear low density polyethylene, and about 20% of a silica antiblocking agent.
AB3 is a masterbatch having about 70% low density polyethylene with 25% silica and 5% erucamide, each component by weight of the masterbatch. A very small amount of stabilizer is present.
AD1 is a maleic anhydride modified EVA that acts as a polymeric adhesive (tie layer material).
AD2 is a maleic anhydride modified LLDPE that acts as a polymeric adhesive (tie layer material).
AD3 is a maleic anhydride modified LLDPE that acts as a polymeric adhesive (tie layer material).
EA1, EA2 and EA3 are each ethylene/acrylic acid copolymer with an acrylic acid content of less than 10% by weight of the copolymer. EA1 has an acrylic acid content of 6.5% by weight of the copolymer. EA2 has an acrylic acid content of 3% by weight of the copolymer.
EMAA1 is an ethylene/methacrylic acid copolymer with a methacrylic acid content of about 12% by weight of the copolymer.
EV1 is an ethylene/vinyl acetate copolymer with a vinyl acetate content of less than 10% by weight of the copolymer.
EV2 is an ethylene/vinyl acetate copolymer with a vinyl acetate content of about 27% by weight of the copolymer.
IO1, IO2, IO3, IO4 and IO5 are each an ionomeric resin, comprising a zinc neutralized ethylene/methacrylic acid copolymer.
OB1 is EVOH with about 38 mole % ethylene.
PE1 is LDPE.
PE2 is a branched, single-site catalyzed ethylene/octene copolymer with a density of about 0.9035 grams/cubic centimeter.
PE3 is LDPE.
PE4 is a dry/pellet blend of 65% AD1 and 35% PE1.
PE5 is a linear, single-site catalyzed ethylene/hexene copolymer with a density of about 0.9120 grams/cubic centimeter.
PE6 is a blend of between 0.01% and 100%, by weight of the total composition, PE5, and between 100% and 0.01%, by weight of the total composition, EV1.
PE7 is a single-site catalyzed ethylene/octene copolymer with a density of 0.916 grams/cc.
PSA1 and PSA2 are each a pressure sensitive adhesive, comprising styrene/isoprene block copolymer.
All percentages herein are by weight unless indicated otherwise.

The oxygen barrier layer 103 of Examples 11 to 14 of the above film structures can comprise any suitable oxygen barrier material, such as EVOH, and can be blended in any suitable proportion with other polymeric materials or organic or inorganic additives as desired. Optionally, intermediate layers can be included on each respective side of layer 103, each comprising a nylon, e.g. 100% semicrystalline polyamide such as nylon 6. An intermediate layer of nylon can, in one embodiment, be placed on either or both adjacent surfaces of an EVOH or other barrier layer 103.

Tie layers 102 and 104 can comprise any suitable polymeric adhesive that functions to bond two layers together, e.g. EVA, EAO, LDPE, EMA, and anhydride grafted derivatives of these polymers. Tie layers 102 and 104 can be the same, or can differ.

Layer 108 can comprise a suitable polyolefin, such as an EAO; and/or a polymeric adhesive such as those disclosed herein for tie layers 102 and 104.

Additional materials that can optionally be incorporated into one or more of the film layers of the discrete strip or the primary web, as appropriate, include antiblock agents, slip agents, antifog agents, fillers, pigments, dyestuffs, antioxidants, stabilizers, processing aids, plasticizers, fire retardants, UV absorbers, etc.

The first anchor seal 63 (sealing zone "D"), of any suitable geometry seals the panel section 6 to the first surface 23 of the discrete strip. This seal is an easy-open seal.

The sealant layers of the discrete strip, e.g. layer 22 and layer 20 as depicted in FIG. 2, or layer 109 and layer 101 as depicted in FIGS. 6 and 7, can comprise any suitable sealant material or blend of materials. Examples of such materials include the following polymers, their copolymers or blends: olefinic polymers such as ethylene polymer or copolymer, ethylene/alpha olefin copolymer, ethylene/vinyl acetate copolymer, ionomer resin, ethylene/acrylic or methacrylic acid copolymer, ethylene/acrylate or methacrylate copolymer, low density polyethylene, high density polyethylene, polypropylene, propylene/ethylene copolymer, propylene/ethylene/butene terpolymer; polystyrene, syndiotactic polystyrene, ethylene/styrene copolymer, and norbornene/ethylene copolymer. Ethylene/alpha olefin copolymers can include Ziegler/Natta or single-site catalyzed ethylene/alpha olefin copolymer such as ethylene/butene copolymer, ethylene/hexene copolymer, and ethylene/octene copolymer. Cycloolefin copolymers can be used. Non-olefinic copolymers can also be used, such as polyester and polyamide. Examples of polyester include homopolymers and copolymers of alkyl-aromatic esters, such as polyethylene terephthalate (PET), amorphous polyethylene terephthalate (APET), crystalline polyethylene terephthalate (CPET), glycol-modified polyethylene terephthalate (PETG), and polybutylene terephthalate; copolymers of terephthalate and isophthalate, such as polyethylene terephthalate/isophthalate copolymer; and homopolymers and copolymers of aliphatic esters such as polylactic acid (PLA) and polyhydroxyalkonates, such as polyhydroxypropionate, poly(3-hydroxybutyrate), poly(3-hydroxyvalerate), poly(4-hydroxybutyrate), poly(4-hydroxyvalerate), poly(5-hydroxyvalerate), poly(6-hydroxydodecanoate) and blends of any of these materials. An example of a polyamide is a commercially available resin, GRILAMID™XS1392 from EMS Grivory, comprising a blend of polyamide 6/12 and polyamide 12. For polyester and polyamide sealants on the discrete strip, the sealant layer of the first side panel, or web to made into the first side panel, that will be sealed to the discrete strip to make a package is selected to have the same or substantially the same chemical formulation. For example, if a polyester is used as the sealant for the discrete strip, a polyester is also used as the sealant for the inner surface of the first side panel. Thus, the sealant materials as disclosed herein for a sealant layer of the discrete strip can be selected for the sealant layer of the primary web to which the discrete strip will be sealed. This selection can be made based on cost of materials, the strength of the seals made in the production of the package, and the like, and takes into account that the seal of the discrete strip to the inner surface of the first side panel, or the portion of a web that becomes the inner surface of the first side panel, is such that upon opening the package as described herein, a rupture of the sealing segment of the discrete strip occurs, and upon continued opening part of the PSA layer is exposed by delamination of the sealing segment/PSA interface of the discrete strip in sealing zone "D", and access is gained to the interior of the package.

The web and base strip of the invention can be made by any suitable process, including coextrusion, extrusion coating, lamination, extrusion lamination, etc.

Opening Mechanisms

The package of the invention can be easily manually opened.

The first surface 23 of strip 10 is sealed with a first anchor seal to the inner surface 67 of the panel 6. Anchor seal 63 is an easy-open seal that will typically exhibit a combination of cohesive and delamination failure. Cohesive failure herein refers to the feature wherein the sealing segment 22 of the discrete strip fractures when the package is opened. Delamination failure herein refers to the feature wherein once the sealing segment fractures, the interlaminar bond between the sealing segment and the PSA layer is broken. Thus, the interlaminar bond provides the interface that will break apart upon manually opening the package. This delamination occurs substantially along the portion of the discrete strip that underlies the sealing zone "D".

In some embodiments, in particular those in which a hermetic package is desired, the portion of the die cut or die cuts that is cut all the way through the panel section is bracketed or surrounded collectively by the top seal of the package, the side seals of the package, and the first anchor seal.

In an alternate embodiment, two die cut segments may be present in the panel section. The primary die cut segment can be removed or displaced to open the package and access the contents of the package. The secondary die cut segment is in one embodiment at least partially underlain by the base strip, but the primary die cut segment is in one embodiment not underlain by the base strip, or is not anchored to the base strip by an anchor seal. Thus, in initially opening the package, the PSA is not exposed. In other embodiments, the primary die cut segment may be partially underlain by the base strip, and include an anchor seal so positioned that in initially opening the package, the PSA is exposed to a limited extent. In either embodiment, when it is desired to reclose the package, the secondary die cut segment is removed or displaced, the sealing segment is at least partially removed, the underlying PSA 19 is at least partially exposed, and the package is folded over to bring the PSA into contact with the outer surface of the first side panel 12 and close the package.

The secondary die cut segment is in one embodiment defined by a closed loop die cut, and the secondary die cut segment is removed so that the underlying PSA 19 is exposed, and the package is folded over to bring the PSA into contact with the outer surface of the first side panel 12 and close the package. It will be appreciated that thereafter, subsequent removal of package contents can potentially come in contact with and contaminate the now exposed PSA. Thus in an alternative embodiment, the secondary die cut segment is defined by an open loop die cut. This results in a flap that is displaced but not completely removed when exposing the PSA. The flap can be held back while reclosing the package. When it is desired to reaccess the contents of the package, the package can be reopened, and the flap can be placed over the PSA to recover the PSA before package contents are withdrawn from the package. Depending on the placement and configuration of the secondary die cut segment, nature of the materials, etc. the flap may exhibit a tendency to close over the PSA, aiding this step. This protects the PSA from contamination by the package contents.

The invention is characterized by the fact that:

- the package before initial opening does not have a PSA on the exterior surface of the package,
- before opening the package, the PSA is in contact with the inner surface of the panel section of the discrete laminate of the package,
- before opening the package, the PSA is not in direct contact with the outer surface of the first side panel, the outer surface of the panel section, or of the outer surface of the second side panel, In each of the embodiments of the package and process disclosed herein, a non-hermetic or hermetic package can be made in accordance with the invention.

FIG. 2A shows a primary die cut segment defined by die cuts 21, and identified as region "C". Also shown is a secondary die cut segment defined by upper die cut 21 and die cut 36, and identified as region "E". Region "C" is partially underlain by the base strip, and partially underlain by a clear area in which the base strip is not present; region "E" is entirely underlain by the base strip. See also the arrangements of die cuts and base strips in FIGS. 27A to 27D, 28A to 28C, 29, and 30A to 30D. In FIG. 2A, the first surface 23 of the base strip is anchored to the inner surface of panel section 6 in seal zone "D" to form first anchor seal 63 (see FIGS. 5A and 5B); the second surface 25 of the base strip is anchored to the inner surface of the second side panel 14 in seal zone "A" to form a second anchor seal 63; and the outer surface 59 of first side panel 12 is anchored to the inner surface of panel section 6 in seal zone "G" to form the third anchor seal.

Figure 2B:
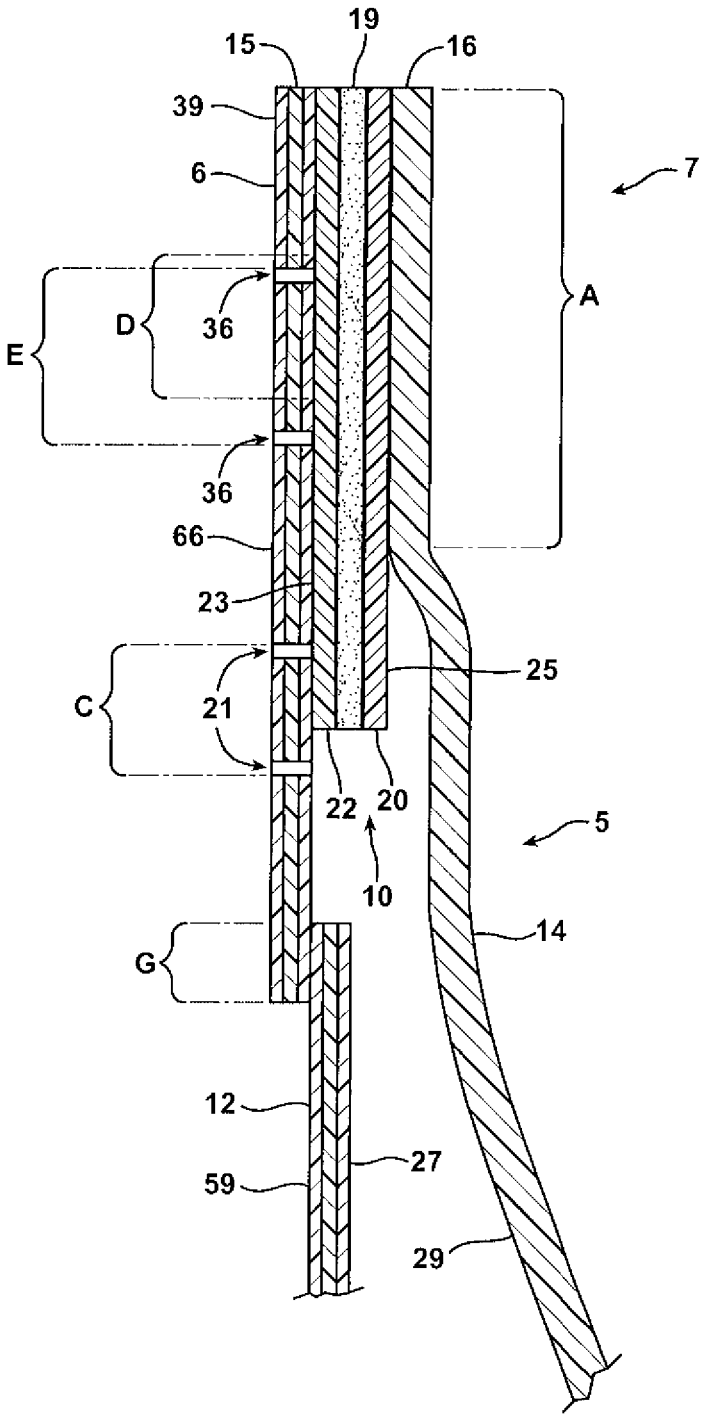
FIG. 2B is an enlarged cross-sectional view of another embodiment of a portion of a package.
Figure 2C:
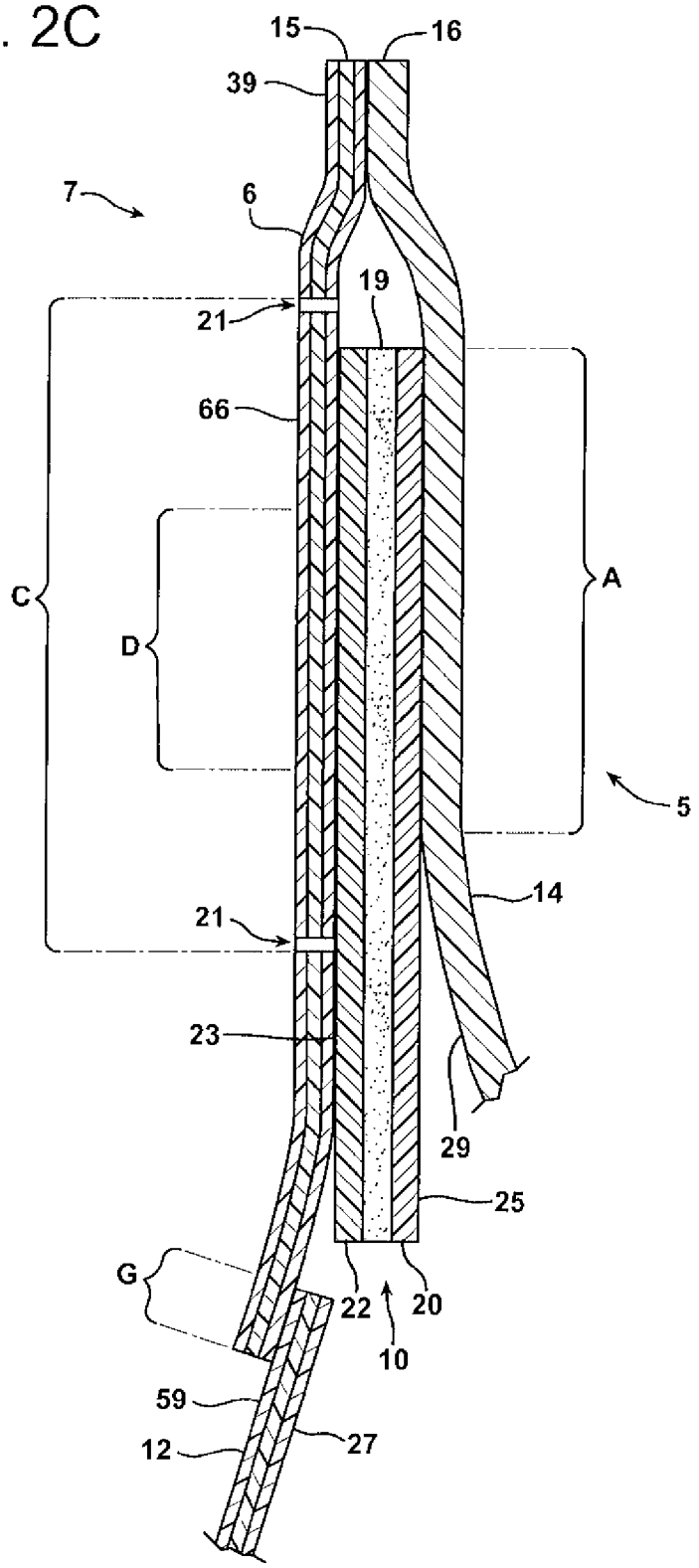
FIG. 2C is an enlarged cross-sectional view of another embodiment of a portion of a package.

In an alternative embodiment, FIG. 2B is similar to FIGS. 2A, but in which 1) strip 10 is sealed at its first end 28 to the inner surfaces of the first ends of the first and second side panels respectively; and 2) regions "C" and "E" are spaced from one another, and do not share a common die cut. The embodiments of both FIGS. 2A and 2B offer the feature of having the opening mechanism of the package (removing the primary die cut segment) different from the reclosing mechanism (removing the secondary die cut segment to expose the PSA, etc.). Thus, in these embodiments, the PSA need not be exposed to open the package.

In FIG. 2C, a single primary die cut segment defined by die cuts 21 can be removed, thereby opening the package and also at least partially removing the sealing segment from the discrete strip, and at least partially exposing the pressure sensitive adhesive.

In each of the embodiments of the package and process disclosed herein, a non-hermetic or hermetic package can be made in accordance with the invention.

2. Method of Making a Package

A. Horizontal Form/Fill/Seal (HFFS)

HFFS packaging systems are generally well known to those of skill in the packaging industry, and can be used to make packages of the present invention.

Referring to FIGS. 8, and 9A through 9C, lay-flat web 300 is unwound from roll 302, then advanced to forming plow 304 to convert lay-flat web 300 to folded web 305 (typically a centerfold film). The second end of each of the pouches to be made will comprise a second end fold 306. Second end fold 306 therefore is equivalent to second end 34 of FIG. 1. This second end fold can be optionally sealed, or left as a folded second end of the pouch. Side seals 308 are made to define a plurality of vertically arranged pouches 309. Each pouch 309 is cut off from the trailing edge of web 300 by an appropriate cutting mechanism (not shown) such as a knife, at position 311, a product (not shown in FIG. 8, but see product 24 in FIGS. 1 to 5B) is inserted or dropped into the open mouth 312 of each pouch, and the pouch mouth 312 is then closed by a suitable sealing mechanism such as a heat sealer (not shown) to create a seal 314.

Discrete laminate 310, equivalent to discrete laminate 4 of FIGS. 1 to 5B, can be introduced into the HFFS process in a number of ways. For example, discrete laminate 310 can be unwound from a roll 315 in the vicinity of roll 302, and disposed on lay-flat web 300 prior to, or as web 300 is being folded into folded web 305. The discrete laminate is disposed on the web such that the discrete laminate overlaps the lay-flat web sufficient to allow the discrete laminate to be anchored to the web.

Discrete laminate 310 includes a base strip, and a panel section. In one embodiment, the inner surface of the panel section can be anchored to the outer surface of the lay-flat web 300. In another embodiment, the second surface of the base strip can be anchored to the lay-flat web 300. Base section 10 and panel section 6 can in an alternative embodiment be anchored to the lay-flat web at different positions on the lay-flat web such that when the web is folded, and the package is made, the panel section and base strip come together, and the inner surface of the panel section is anchored to the first surface of the base strip.

The panel section includes die cuts made in a predetermined pattern (see FIGS. 28A to 30D) to produce packages according to the invention. The panel section is in one embodiment anchored to the folded web 305 on one side of the fold 306, and the second surface of the base strip is anchored to an inner surface of the folded web on the other side of fold 306, by a suitable means such as a sealing mechanism such as a heat sealer (not shown). The first surface of the base strip is sealed to an inner surface of the panel section 6 with an easy-open seal as disclosed herein. Discrete laminate 310 can thus be installed on the pouch, either as a single unit or as initially separate components (panel section and base strip) in the same overall HFFS process that achieves production of the pouch, loading of a product into the pouch, and completion of the final package. Discrete laminate 310 is incorporated onto the pouch material and after cutting and sealing as described hereinabove, the panel section 6 comprises an extension of the first side panel of each pouch as shown in FIG. 8, and FIGS. 2A to 2C.

Figure 9A:
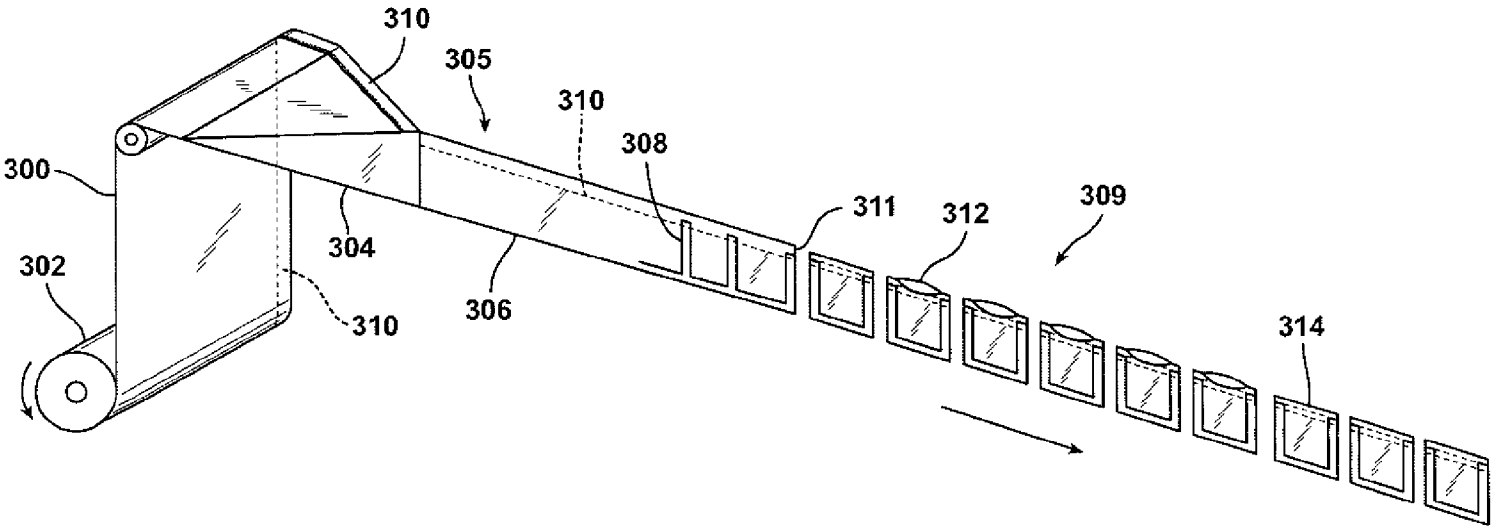
FIG. 9A is a perspective view of a HFFS process and apparatus for making a package according to another embodiment.
Figure 9B:
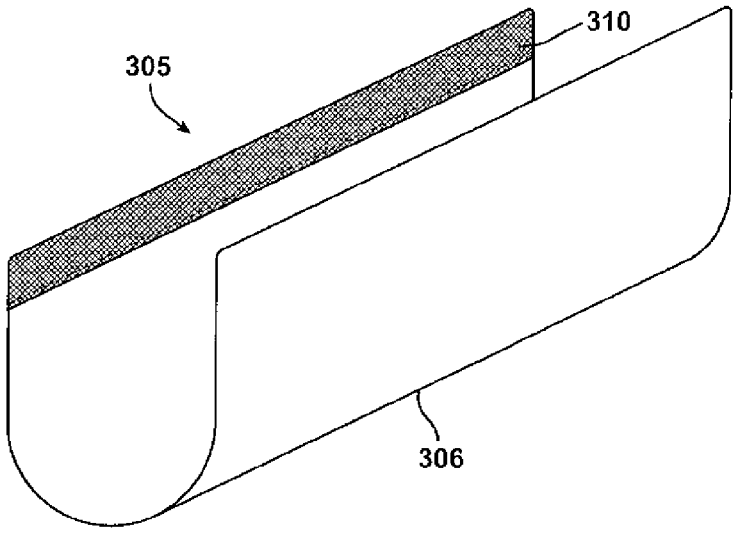
FIG. 9B is a perspective view of a section of folded web.

Alternatively, and referring to FIGS. 9A and 9B, discrete laminate 310 is shown as being installed on the lay-flat web prior to the start of the HFFS packaging process. This can be accomplished off-site from the processor, e.g. by the supplier of the web roll 302.

Figure 8:
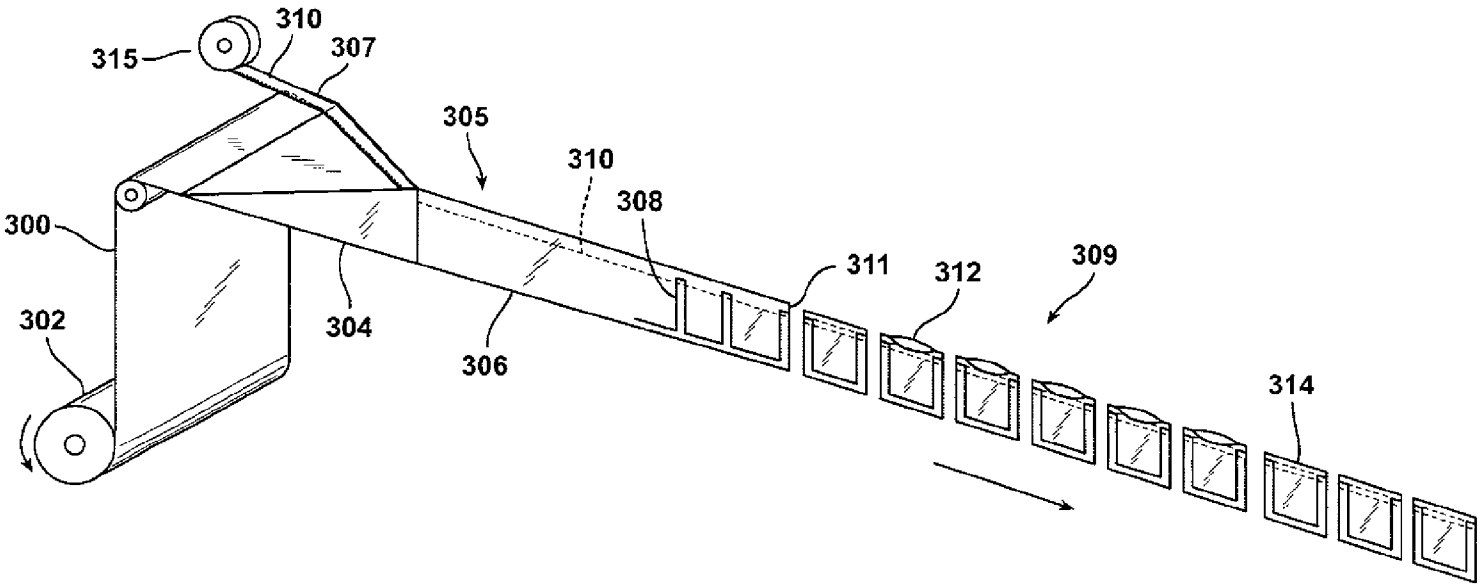
FIG. 8 is a perspective view of a HFFS process and apparatus for making a package.

FIG. 9B is a perspective view of a section of folded web as shown in the HFFS process and apparatus of FIGS. 8 and 9A, as the lay-flat web is folded to create folded web 305. The discrete laminate 310 is shown disposed, and optionally attached to, an inner surface of one panel of the folded web 305, such that upon sealing the web to create a pouch, the panel section of the discrete laminate functions as an extension of the first side panel.

Alternatively, one of the panel section 6 and base strip 10 can be installed on the lay-flat web prior to the start of the HFFS packaging process. This can be accomplished off-site from the processor, e.g. by the supplier of the web roll 302. The other of the components can then be anchored to the lay-flat web or folded web at any suitable time in the package process.

Figure 9C:
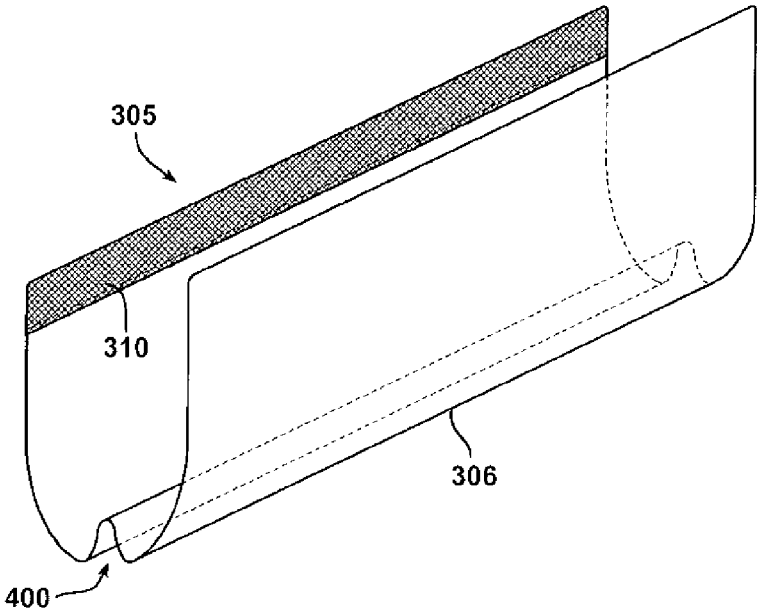
FIG. 9C is a perspective view of a section of a gusseted folded web.

The embodiment of FIG. 9C is similar to FIG. 9B, but additionally shows an optional gusset 400 that can be made in the second end fold 306 of the folded web. The gusset can be optionally thereafter heat sealed. A gusseted second end provides a stand-up pouch feature in the final package. Gusseting can be accomplished by any suitable means known to those of skill in the art, such as a second forming plow (not shown) placed in-line in the manufacturing line at a position downstream of the forming plow 304. The bottom area of the folded web takes on a generally "W" shape, i.e. a gusseted shape, in cross-section, with the outside legs of the "W" extending upwardly, and two parallel reverse folds to create the gusseted bottom. Seal opening or holes are previously punched in the inner legs of the "W" shape and aligned with one another so that the two outside plies can be sealed together through these holes. When the seals are made the panels are sealed to one another through the holes. One or more static plows may be mounted above the seal zone to form the gussets. Gusset holes can be die punched by a die at a hole-punch station which punches clearance holes at an appropriate position designed to be in general alignment with the side seal, adding rigidity to the gusset portion of the final package. This added rigidity enables the final package to stand up by itself when placed on a flat surface.

At any suitable time before or during the method of making the package in an HFFS process, the first surface of the base strip is anchored to the panel section 6 to provide the discrete laminate and a first anchor seal, the second surface of the base strip is anchored to the lay-flat web, the folded web, or the inner surface of the second side panel to provide a second anchor seal, and the panel section 6, or the portion of the discrete laminate that comprises panel section 6, is anchored to the lay-flat web, folded web, or first side panel to provide a third anchor seal. Any of these steps can be done e.g. on the lay-flat web prior to supplying the web to the processor, or prior to or as the lay-flat web is advanced to a forming device, or before or after a product is put in the open pouch, as long as the base strip is not anchored to the panel section before product is put in the pouch.

B. Vertical Form/Fill/Seal (VFFS)

Figure 10:
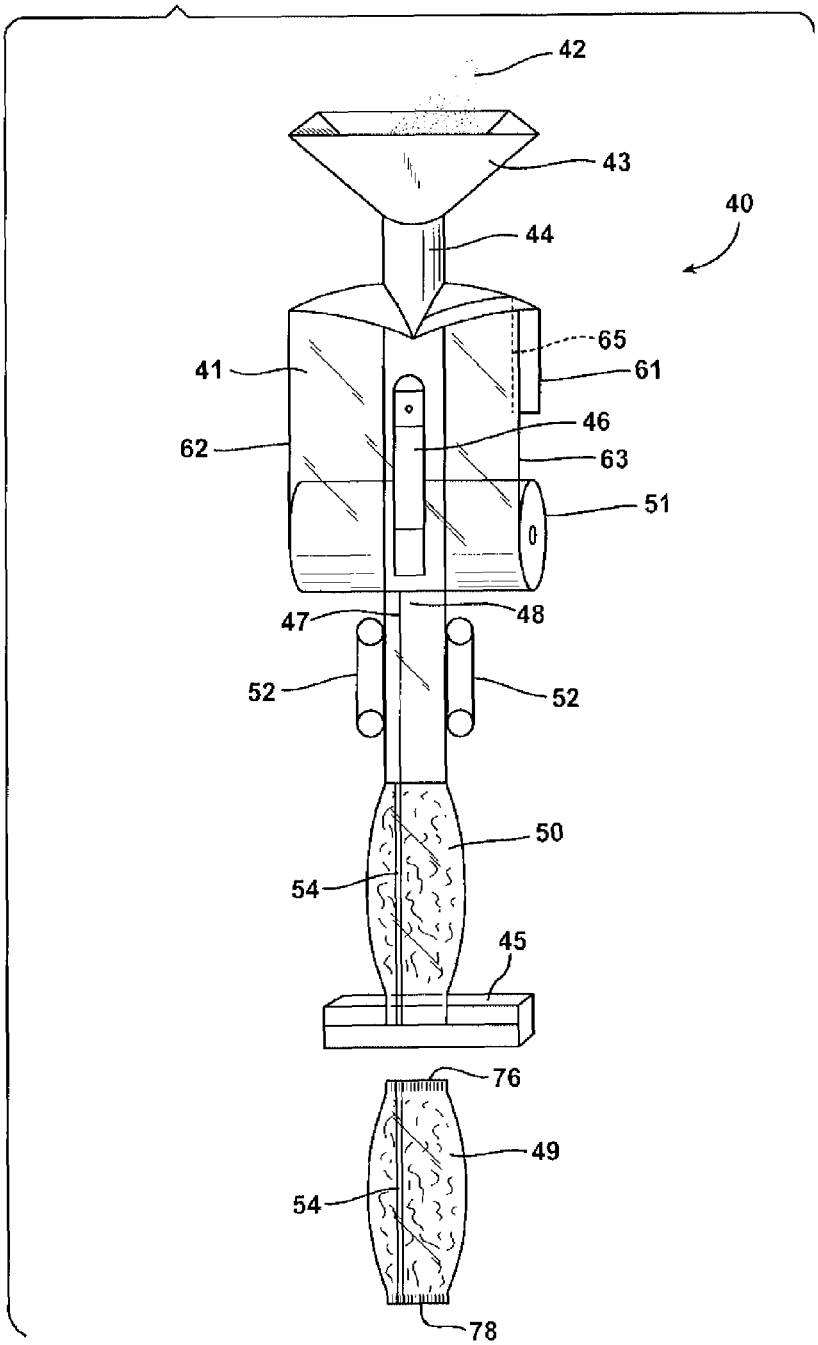
FIG. 10 is an elevational view of a VFFS process and apparatus for making a package.

FIG. 10 schematically illustrates a VFFS apparatus that can be used in conjunction with the apparatus and process according to some embodiments of the present invention. VFFS packaging systems are generally well known to those of skill in the art, and described for example in U.S. Pat. Nos. 4,589,247 (Tsuruta et al), 4,656,818 (Shimoyama et al.), 4,768,411 (Su), and 4,808,010 (Vogan), all incorporated herein by reference in their entirety.

Apparatus 40 utilizes a lay-flat web 41 as a rollstock. Product 42 is manually or mechanically supplied to apparatus 40 from a source (not illustrated), from which a predetermined quantity of product 42 reaches the upper end portion of forming tube 44 via funnel 43, or other conventional means. The packages are formed in a lower portion of apparatus 40, and web 41 from which the packages are formed is fed from feed roll 51 over certain forming bars (not illustrated), is wrapped about forming tube 44 (sometimes known as a "sailor's collar" or "forming collar") and is provided with a longitudinal fin seal or lap seal 47 by longitudinal heat sealing device 46, resulting in the formation of a vertically-oriented folded web in the form of a tube 48. Transverse heat seal bars 45 operate to close and seal horizontally across the lower end of vertically-sealed tube 48, to form a pouch 49 which is thereafter packed with product 42. Film drive belts 52, powered and directed by rollers, as illustrated, or by suitable alternative motive means, advance tube 48 and pouch 49 a predetermined distance, after which seal bars 45 close and simultaneously seal horizontally across the lower end of vertically-sealed tube 48 as well as simultaneously sealing horizontally across upper end of sealed pouch 49, to form a product packaged in sealed pouch 49. The next pouch 50, thereabove, is then filled with a metered quantity of product 42, forwarded, and the packaging cycle is repeated. It is conventional to incorporate with the seal bars 45 a cut-off knife (not shown) which operates to sever a lower sealed pouch 49 from the bottom of upstream pouch 50.

Figure 11:
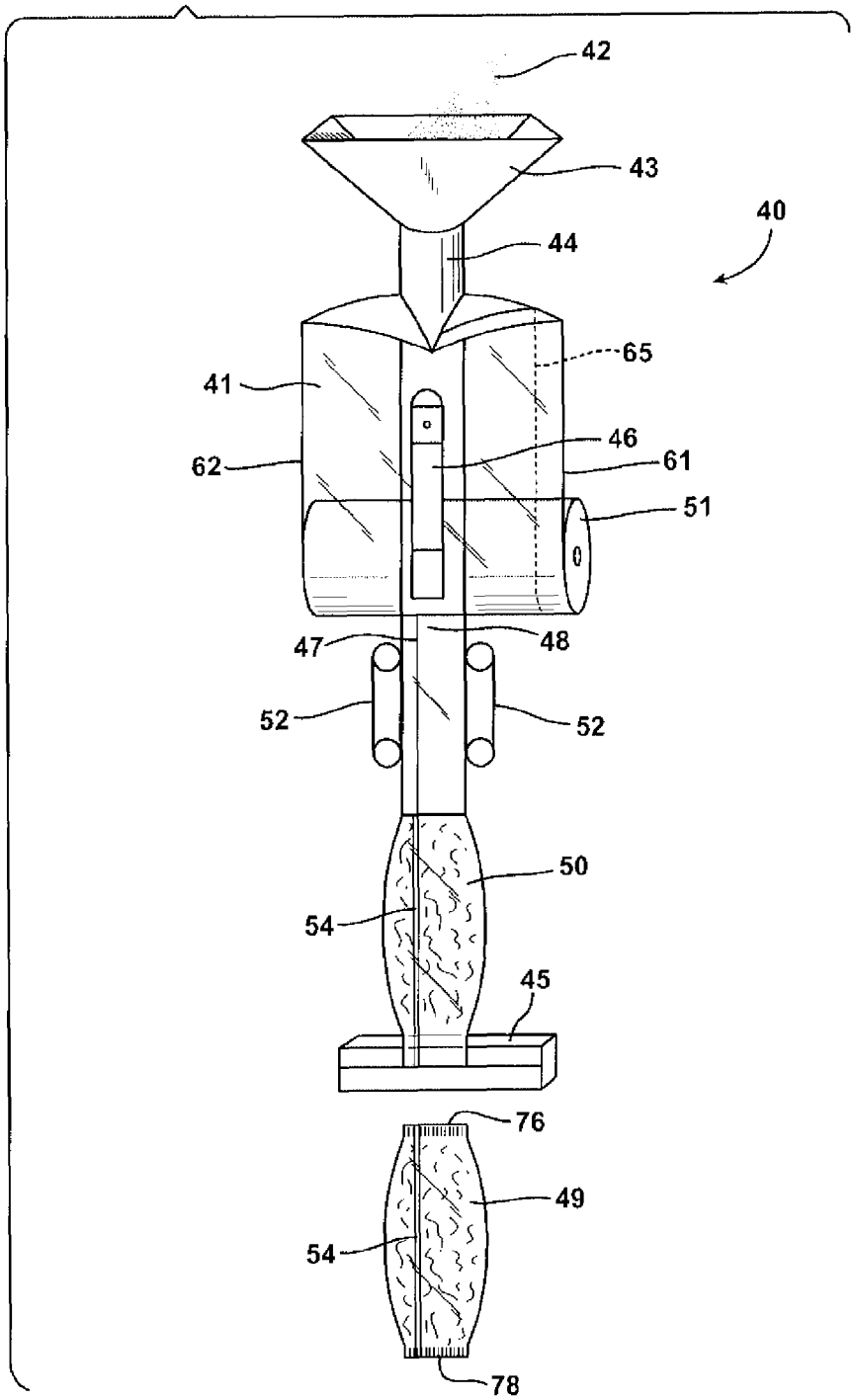
FIG. 11 an elevational view of a VFFS process and apparatus for making a package according to another embodiment.

Lay-flat web 41 of FIGS. 10 and 11 will in operation travel upward, e.g. vertically upward from roll 51 to the forming tube 44, and then downward, e.g. vertically downward for the remaining process steps. Discrete laminate 54 is unwound from roll 51 to dispose discrete laminate 54 in overlapping relationship onto web 41 before, or as, web 41 is wrapped about forming tube 44. When longitudinal seal 47 is made, discrete laminate 54 becomes part of the folded web.

Figure 12:
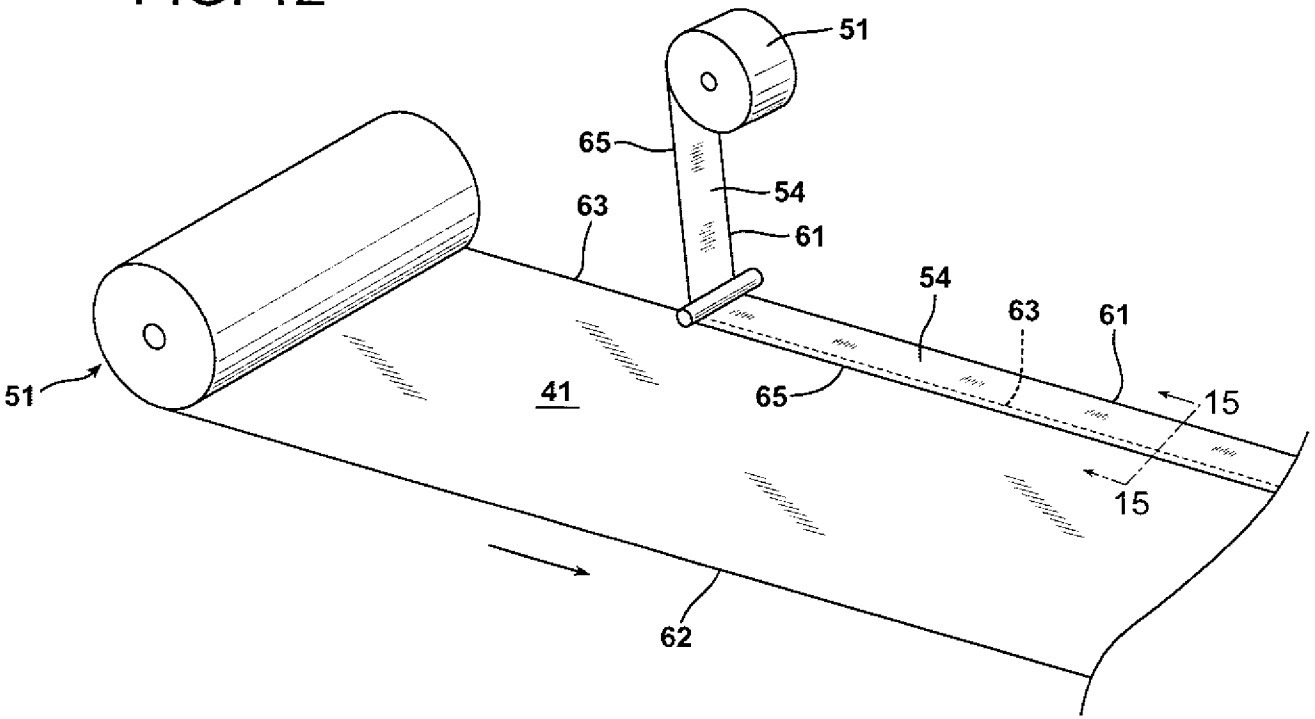
FIG. 12 is a perspective view of a roll of lay-flat web and a roll of a discrete laminate.

FIG. 12 discloses the roll 51 of lay-flat web 41 according to one embodiment of the invention. Discrete laminate 54 is fed from roll 51 onto a portion of lay-flat web 41.

Figure 13:
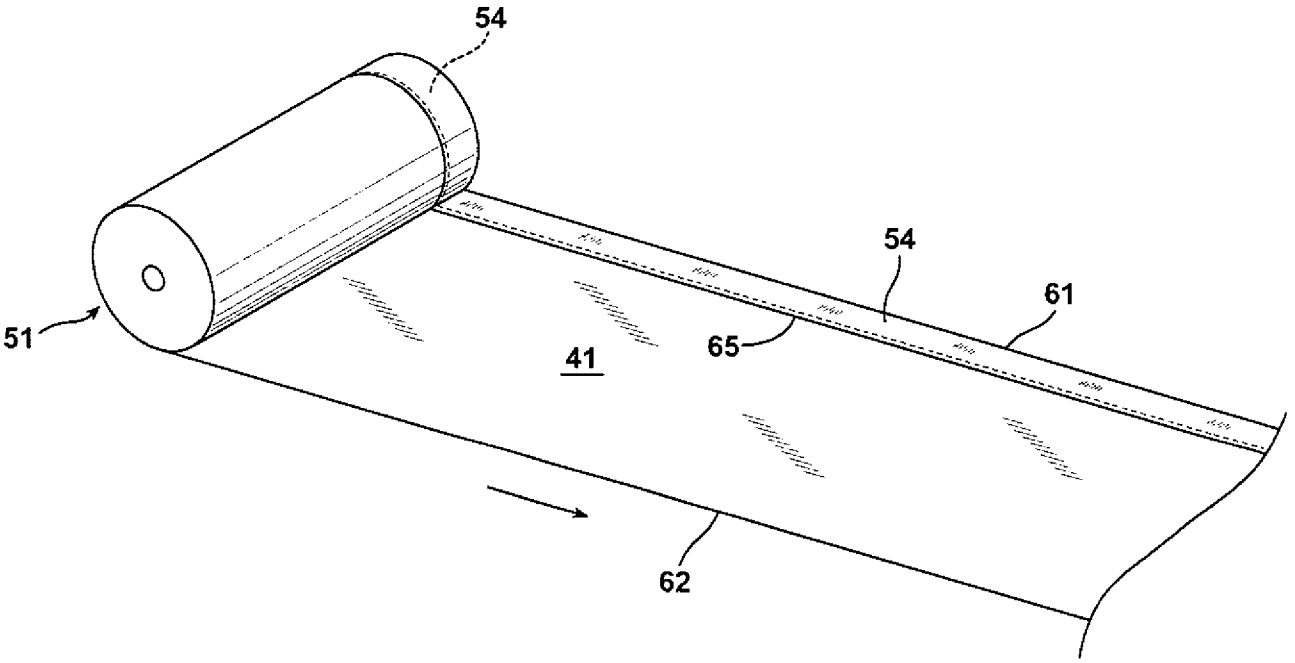
FIG. 13 is a perspective view of a roll of lay-flat web and a discrete laminate according to another embodiment.

Alternatively, and referring to FIGS. 11 and 13, discrete laminate 54, or one of the components thereof, i.e. panel section 6 or base strip 10, is already installed on the lay-flat web prior to the start of the VFFS packaging process. This can be accomplished off-site from the processor, e.g. by the supplier of the feed roll 51.

The discrete laminate includes die cuts on the panel section of the discrete laminate, the die cuts made in a predetermined pattern to produce packages according to the invention.

In some embodiments, at least one of the web and the discrete laminate carries a registration device. Printed indicia can be in the form of registration marks, such as eye-spots. Those skilled in the art will be familiar with the use of eye-spots and registration marks in processing web material in packaging operations. Registration marks are printed in uniformly spaced fashion along or near an edge of the web or tape, and facilitate the controlled production of packages of the invention, and can be printed in conjunction with other decorative printing.

Figure 14:
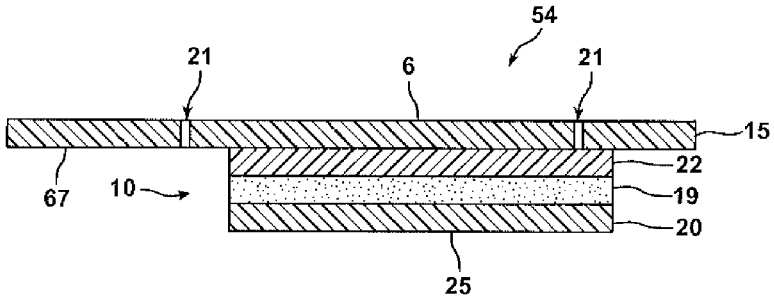
FIG. 14 is a side view of a discrete laminate.

FIG. 14 shows a discrete laminate 54 of the invention, which can be used in the various processes and packages disclosed herein, e.g. as a discrete laminate 54 of FIGS. 12 and 13. Discrete laminate 54 includes base strip 10 and panel section 6 including die cut(s) 21.

Figure 15:
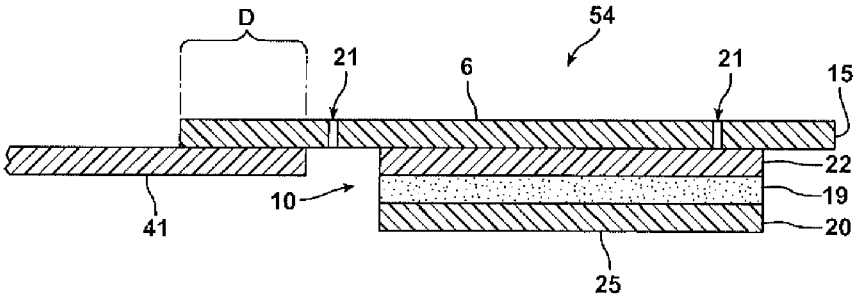
FIG. 15 is a view of a discrete laminate and a portion of a lay-flat web taken along lines 15-15 of FIG. 12.

FIG. 15 shows a discrete laminate 54 of the invention (see also FIG. 12) that has been anchored to lay-flat web 41. In the embodiment shown in FIG. 15, a seal (sealing zone "D") is used to anchor the panel section 6 of the discrete laminate to the lay-flat web 41. Alternatively, the discrete laminate can be anchored at a second surface of base strip 10 to lay-flat web 41.

Figure 31:
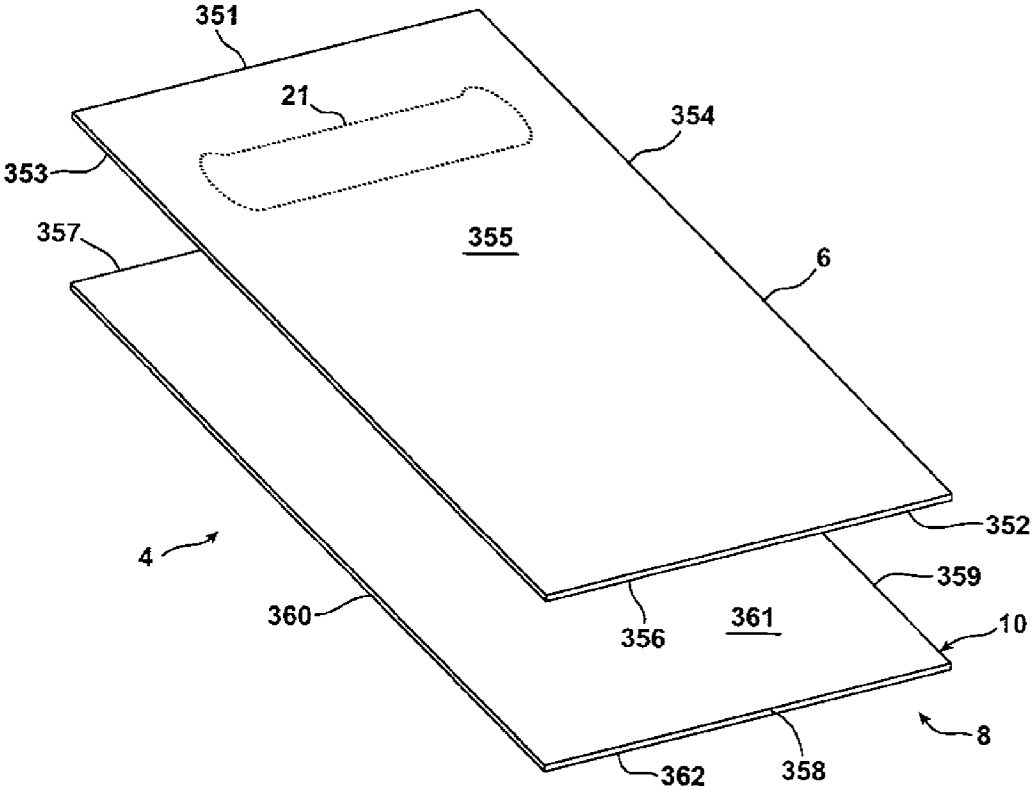
FIG. 31 is a perspective, blown-up view of the discrete laminate.
Figure 32:
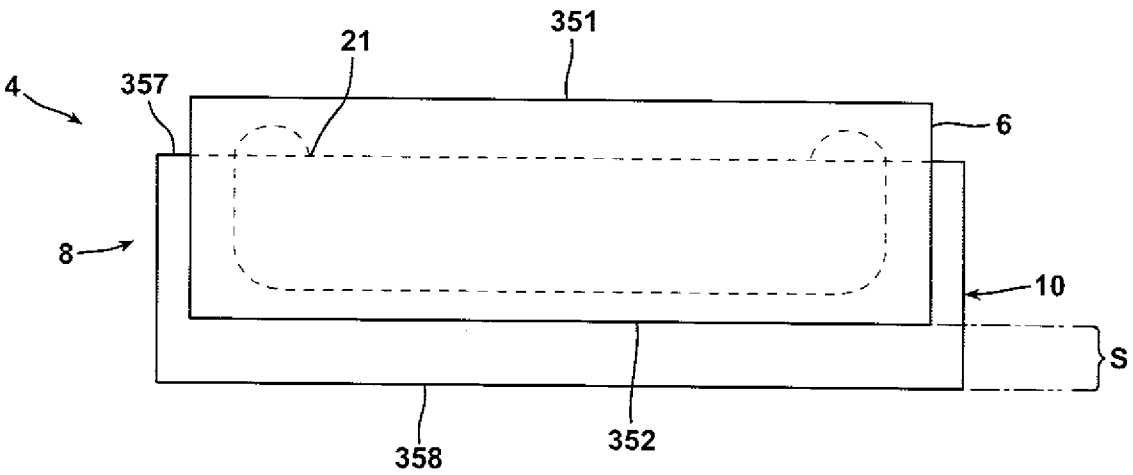
FIG. 32 is a plan view of the discrete laminate.

FIGS. 31 and 32 show a discrete laminate 4 in accordance with the invention. The discrete laminate includes a panel section 6 including an outer surface 355, an inner surface 356, a first side edge 353, a second side edge 354, a first end 351, a second end 352, and a die cut 21; and a base strip 10 including a first surface 361, a second surface 362, a first side edge 360, a second side edge 359, a first end 357, and a second end 358. Each of the components of discrete laminate 4 can have any suitable dimensions, and in some embodiments base strip 10 and panel section 6 can be congruent.

Although for purposes of illustration FIG. 32 shows the first and side edges of the base strip as extending beyond the first and side edges of the panel section, typically in packages of the invention the first and second side edges of the panel section will be congruent with the first and second edges respectively of the base strip.

Figure 16:
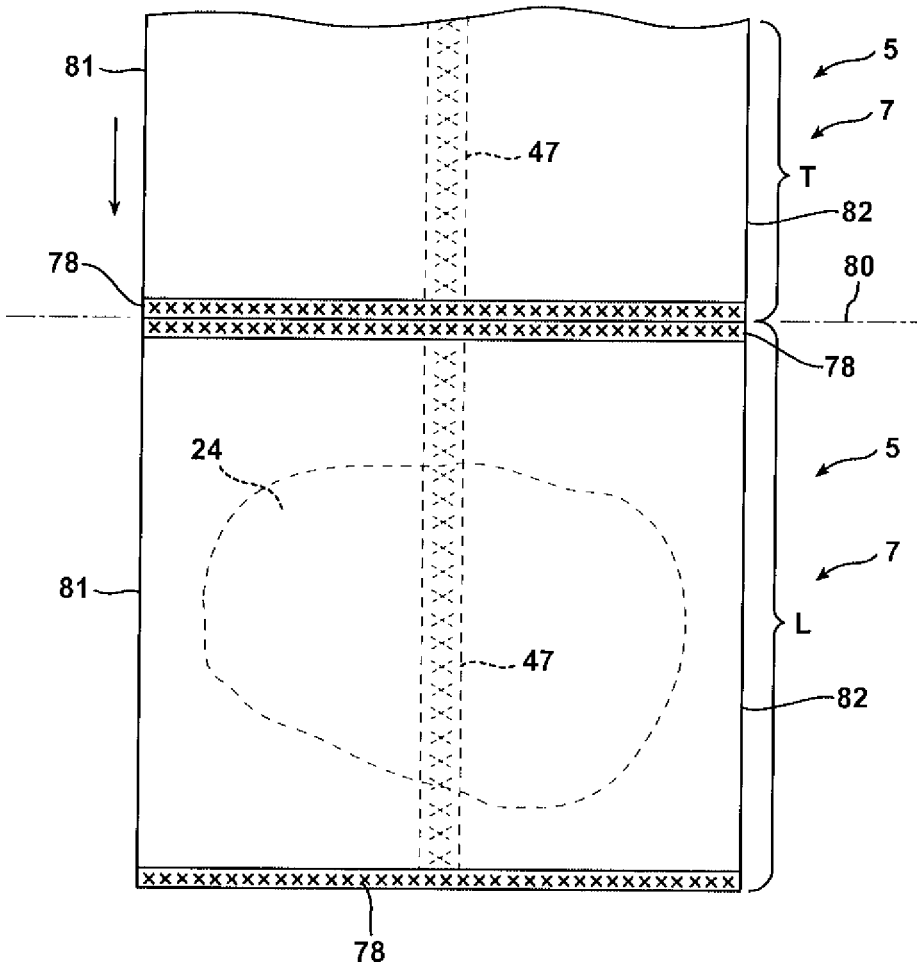
FIG. 16 is an elevational view of two consecutive pouches in a VFFS embodiment.

In FIG. 16, a leading or downstream pouch "L" includes a transverse bottom and top seals 78, folded side edges 81 and 82, and longitudinal seal 47. Trailing or upstream pouch "T" has features similar to leading pouch "L". Leading pouch "L" is severed from upstream pouch "T" at cut line 80, and the seals 78 are made by suitable sealing equipment commonly used in VFFS packaging processes, such as heat sealing equipment, not shown. Die cuts 21 and optionally 36, present in the first side panel of the package, are not shown in all of the drawings. The discrete laminate is not shown in FIG. 16.

Figure 17:
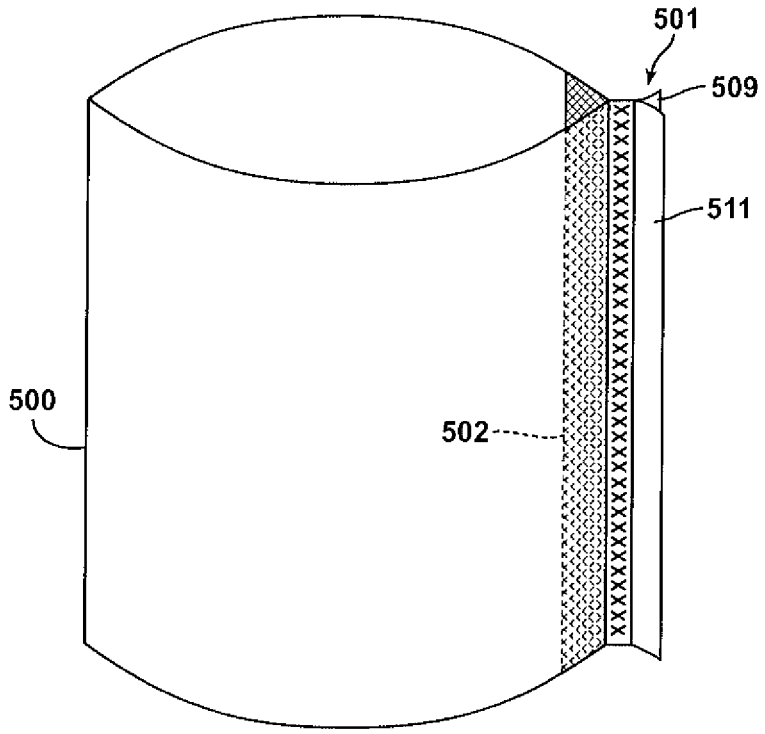
FIG. 17 is a perspective view of a folded web for use in the invention.

FIG. 17 shows folded web 500 with a discrete laminate 502 anchored to the folded web, and fin seal 501, formed as disclosed hereinabove, and prior to a step of making transverse seals in the folded web. A finished package made according to FIG. 17 will thus look like the packages of FIGS. 3 and 4, when these are viewed at right angles to their position in FIGS. 3 and 4, i.e. with the discrete laminate 4 to the right side of each package, and the second end 34 representing a fold. The embodiment of FIG. 17 thus provides a method of producing packages on a VFFS apparatus where the longitudinal seal of the package effectively becomes the first end of the finished package (discounting any unsealed material between the longitudinal seal and the top edge of the package). The apparatus and methodology of U.S. Pat. No. 6,293,073 (Caudle) this patent incorporated herein by reference in its entirety, can be utilized in combination with the teachings herein, to produce packages according to this embodiment. A point of distinction is that in the present invention, the transverse seals will typically (although not necessarily) be rectilinear, whereas the trans-verse seals disclosed in Caudle '073 are wavy or sinusoidal.

Figure 18:
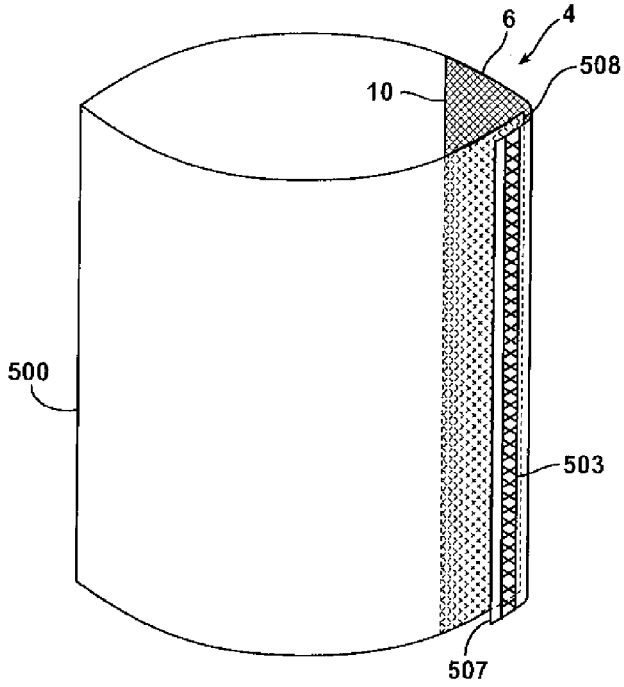
FIG. 18 is a perspective view of a folded web for use in the invention.
Figure 19:
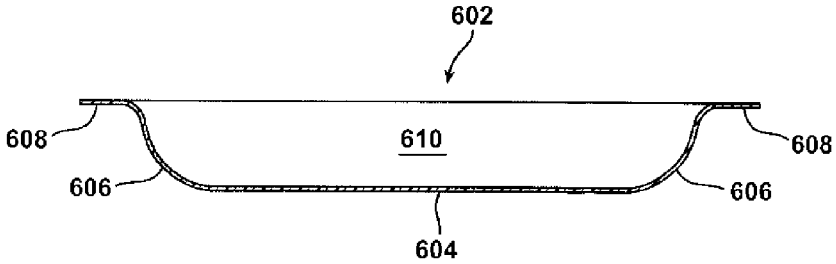
FIG. 19 is a side view of a tray for use in connection with the invention.

Alternatively (FIG. 18), a package like the embodiment of FIG. 17 is shown, but where a lap seal 503 is shown. In this as well as the other processes disclosed herein, a lap seal can be used in lieu of a fin seal when making a longitudinal seal according to the invention. A finished package 5 according to FIG. 18 has a product therein; the two longitudinal ends of the package are closed by a transverse seal; the lap seal runs down the middle or spine of the package, bounded on both ends by the transverse seals; and the discrete laminate is anchored to an interior surface of the folded web.

At any suitable time before or during the method of making the package in a VFFS process, the first surface of the base strip is anchored to the panel section 6 to provide the discrete laminate and a first anchor, the second surface of the base strip is anchored to the lay-flat web, the folded web, or the inner surface of the second side panel to provide a second anchor, and the panel section 6, or the portion of the discrete laminate that comprises panel section 6, is anchored to the lay-flat web, folded web, or first side panel to provide a third anchor. Any of these steps can be done e.g. on the lay-flat web prior to supplying the web to the processor, or prior to or as the lay-flat web is advanced to a forming device, or before or after a product is put in the open pouch, as long as the base strip is not anchored to the panel section before product is put in the pouch.

C. Lidstock/Formed Web

FIGS. 19, 20A, 20B and 21 illustrate in another embodiment the use of a formed web, e.g. a tray, and a non-formed web, e.g. a lidstock, used in connection with the invention. Tray 602 will typically be made during the packaging process. Thermoforming equipment, available from e.g. Multivac, Tiromat, Ulma or Rapid Pak, is used to convert flat thermoplastic forming web into formed pockets to create trays for containing product such as food, various industrial and consumer items and sterile medical products. Trays are formed from a lower web by heat and pressure, and can be loaded with product manually or automatically on the machine. After that, the packages are vacuumized or backflushed with modified atmosphere (if required), hermetically sealed to an upper web, separated, and removed for distribution or storage. Alternatively, pre-formed trays can be used.

Each tray 602 has a tray bottom 604, tray sides 606, and a tray flange 608 along its perimeter to which the lidstock 612 can be sealed by heat or other means. Tray bottom 604 and tray sides 606 define tray cavity 610. Prior to any thermoforming step, tray 602 can be of any suitable thickness, e.g. from 2 to 30 mils thick, and any suitable construction.

Figure 20A:
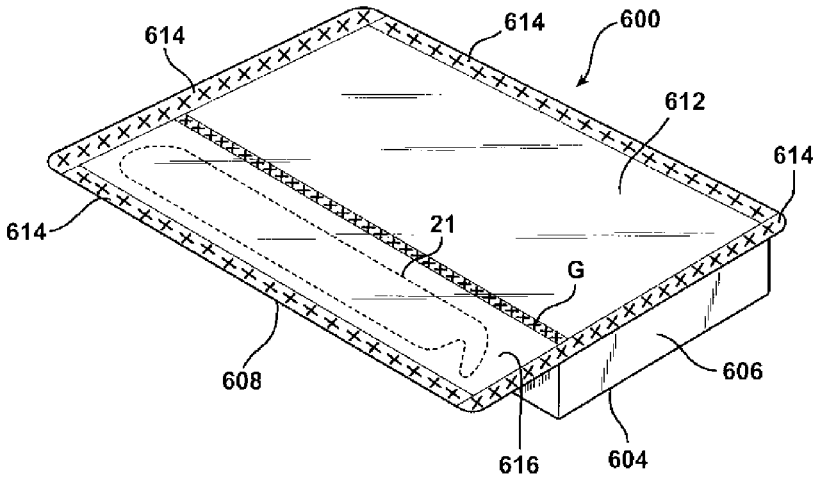
FIG. 20A is a perspective view of a package.
Figure 20B:
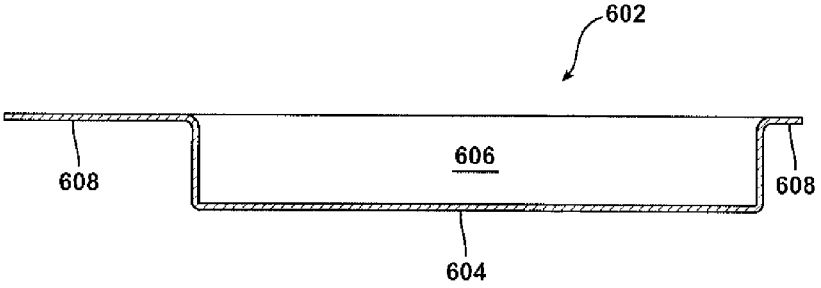
FIG. 20 B is an elevational view of a tray with an extended flange for use in connection with the invention.
Figure 21:
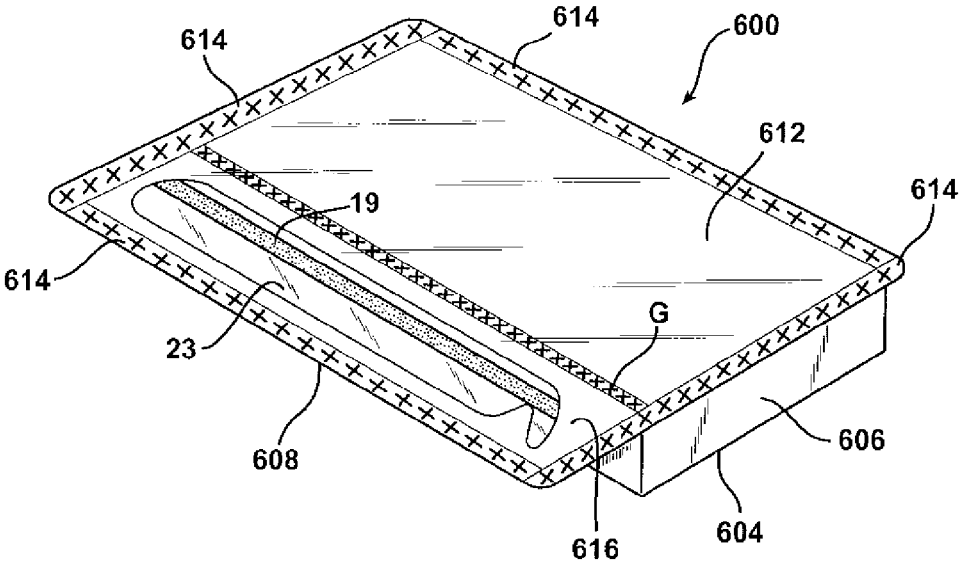
FIG. 21 is a perspective view of the package of FIG. 20A in an opened condition, with the die cut segment removed to expose a pressure sensitive adhesive.

If a pre-made tray is used according to the invention, it can be rigid or semi-rigid, can be in the form of a flat or shaped tray, and can be made from any suitable material, including solid or expanded embodiments, such as PP, polystyrene, polyamide, 1,4-polymethylpentene (e.g. TPX™ available from Mitsui), or crystallized polyethylene terephthalate (CPET). A tray liner can optionally be used that adheres to the surface of the pre-made tray on which the product is to be placed. This liner can be of any suitable design, and can be a multi-layer structure with at least one layer with gas-barrier properties. Such a liner can be adhered to the tray by heat lamination, extrusion lamination, extrusion coating, adhesives, corona treatment, etc. Tray 602 can be a flexible or semi-rigid, or rigid formed web. Referring to FIGS. 20A and 21, a package includes tray 602 to which lidstock 612 has been sealed with perimeter seal 614. Lidstock 612 includes a lay-flat web 611 (see FIGS. 22 and 23) formulated to function as a lid on a formed web, and can be any suitable monolayer or multilayer thermoplastic film as described herein with respect to webs useful in connection with the present invention. Lidstock 612 also includes discrete laminate 616. The base strip of the discrete laminate is anchored to the tray flange, i.e. to the inner surface of the folded web. Discrete laminate 616 has the easy-open characteristics and composition discussed herein with respect to the discrete laminate of HFFS or VFFS packages. The first side panel at closed loop die cut 21 can be removed so that the package is easily opened and product can be removed as desired. Removal or displacement of the die cut segment defined by die cut 21 also exposes the PSA layer 19. After removing the product, the package can be reclosed by folding over the first end of the package (where the extended tray flange is located) such that the PSA contacts the outer surface of lidstock 612.

Figure 22:
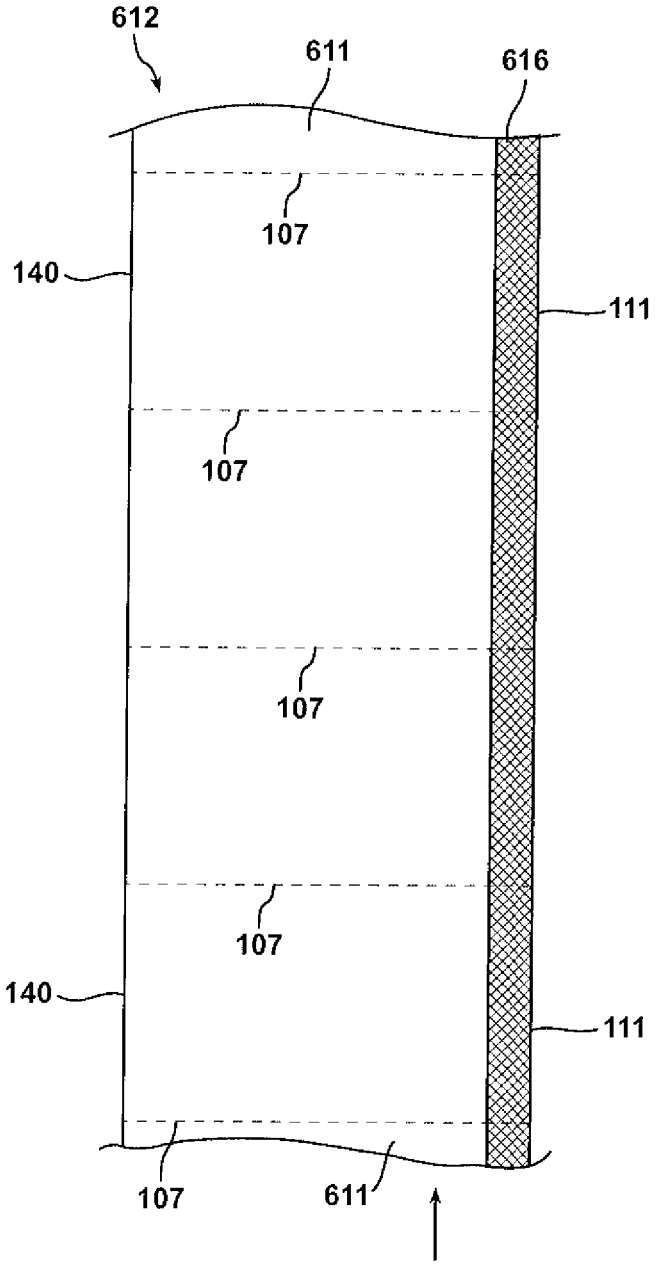
FIG. 22 is a plan view of a lidstock.

Referring to FIG. 22, discrete laminate 616 has a first lateral edge 111. As shown, discrete laminate 616 has been anchored to the lay-flat web 611 to produce lidstock 612. Dotted lines 107 indicate the location at which lidstock 612 is sealed and cut, e.g. perimeter heat sealed and cut, in registered fashion by otherwise conventional means as discussed herein, e.g. in thermoforming equipment, to create individual packages. Lines 107 represent what will become the side edges and seals of individual packages when lidstock 612 is advanced into a packaging system where it is progressively fed over filled trays, sealed to the trays, and cut to create finished packages. Lines 111 and 140 also represent what will become the first and second end respectively of individual packages. Lay-flat web 611, as rolled up, and as it feeds into thermoforming equipment, has a first lateral edge 140. Discrete laminate 616 can be preanchored on lay-flat web 611 by the supplier of the lidstock, as in the embodiments of FIGS. 9A, 11 and 13. Alternatively, discrete laminate 616 can be anchored to the lay-flat web 611 during the packaging process, as in the embodiments of FIGS. 8A, 10, and 12.

Figure 23:
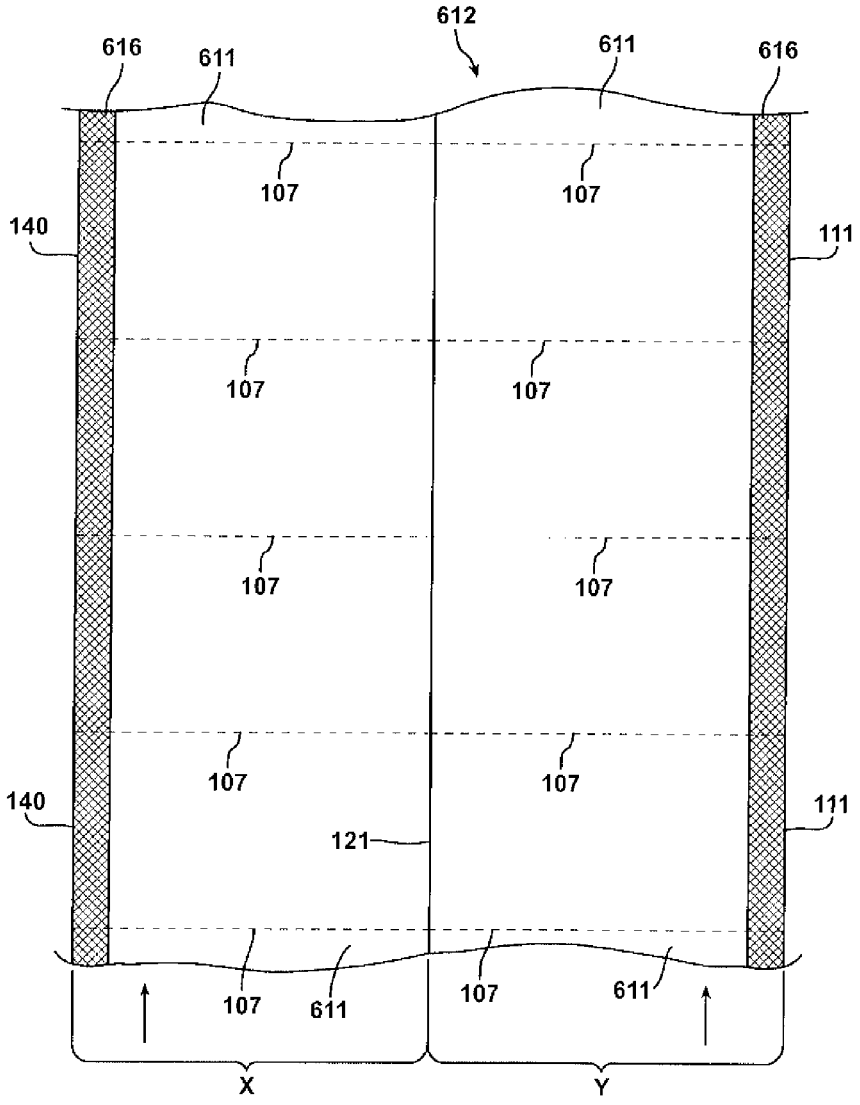
FIG. 23 is a plan view of a lidstock according to another embodiment.

FIG. 23 shows an alternative embodiment of FIG. 22, in which the lidstock is produced as described above, but "two across", so that when run in a packaging machine, with suitable machine die set-ups, two, four, etc. packages can be made simultaneously. In addition to the seal and cut steps at locations 107, the web is cut longitudinally along line 121, so that individual packages made from the longitudinal portion "X" of FIG. 23 will have a second end 121; and individual packages made from the longitudinal portion "Y" of FIG. 23 will have a second end 121.

At any time before or during the method of making the package having a formed web, the first surface of the base strip is anchored to the panel section 6 to provide the discrete laminate and a first anchor seal, the second surface of the base strip is anchored to the inner surface of the formed web, e.g. at an extended tray flange as shown in FIGS. 23A and 23C to provide a second anchor seal; and the panel section of the discrete laminate is anchored to the inner or outer surface of the lay-flat web to provide a third anchor seal. This can be done on the lay-flat web prior to supplying the web to the processor, or before or after sealing the lidstock to the formed web.

D. Continuous Horizontal Packaging

Figure 25:
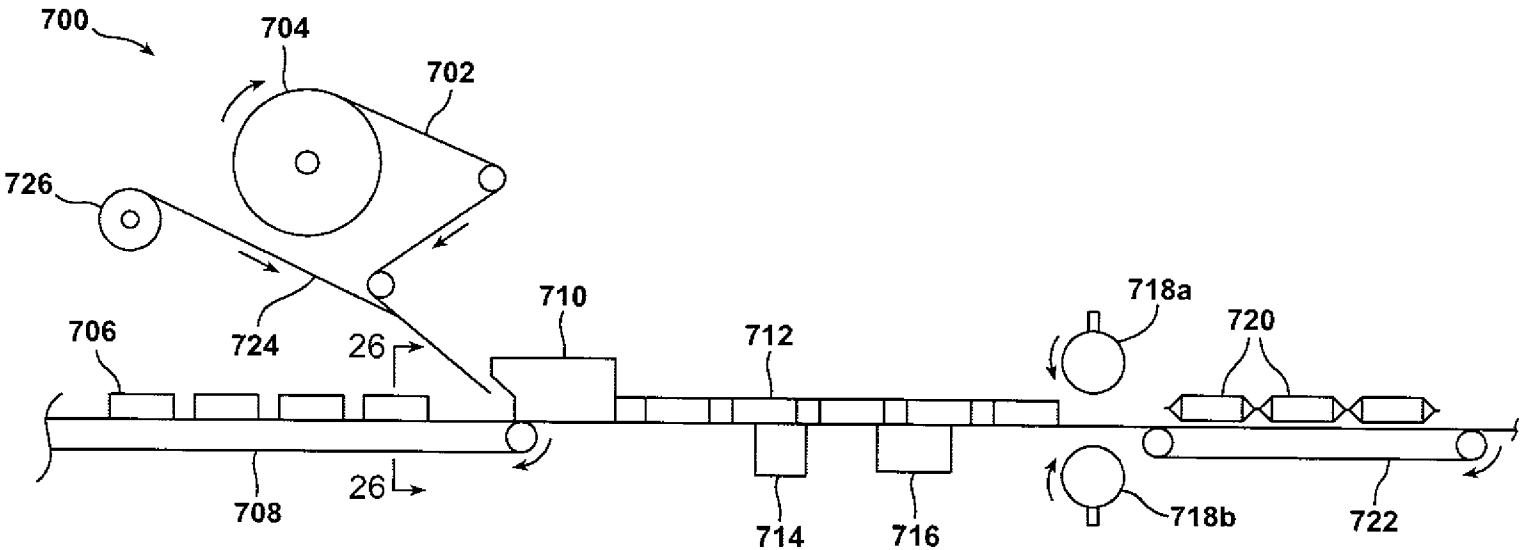
FIG. 25 is an elevational view of a continuous horizontal packaging process and apparatus for making a package.
Figure 26:
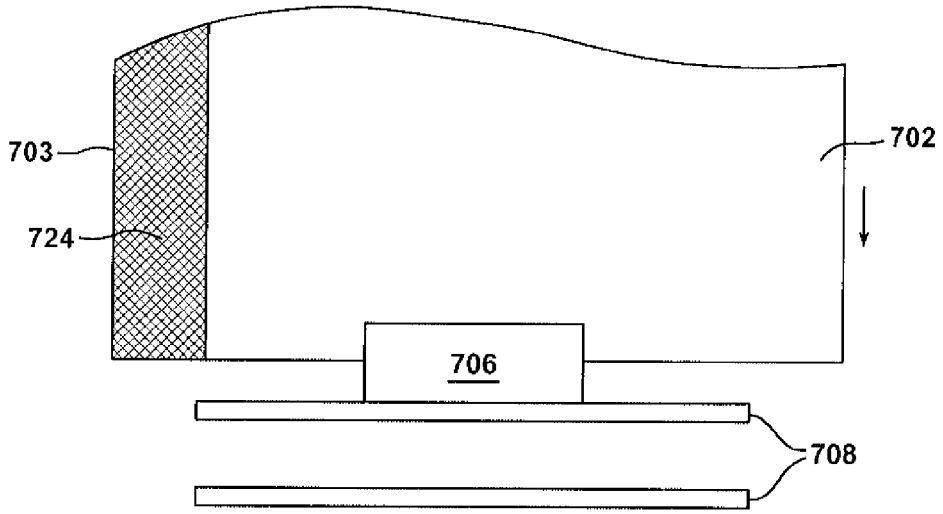
FIG. 26 a front end view of the apparatus of FIG. 25, viewed along lines 26-26 of FIG. 25.

In another embodiment, and referring to FIGS. 25 and 26, the package of the invention can be made using a continuous HFFS process and apparatus such as those used for packaging bakery and other goods, sometimes known as Flow Wrap, Flow-Wrap or Flow wrapping machines or systems, and available from manufacturers/suppliers such as Ilapak, ULMA, and Bosch.

FIG. 25 shows such a process and apparatus 700, but one in which a discrete laminate 724 is installed into a package. Lay-flat web 702 is drawn from roll 704 and advanced to forming device 710. As this occurs, a series of products 706 is advanced along conveyor 708 to forming device 710, and discrete laminate 724 is drawn from roll 726 and advanced to forming device 710. Web 702, with the discrete laminate (or a component thereof, i.e. a panel section 6 or base strip 10) in some embodiments anchored thereto either before or during forming of the web in the forming device, is formed by forming device 710 into folded web 712. This folded web will be like the folded web described above with respect to VFFS embodiments, but in a substantially horizontal orientation. Folded web 712 wraps around products 706. A longitudinal sealing device that can be part of forming device 710 forms a lap or fin seal (of the type disclosed above with respect to VFFS embodiments) on the folded web, typically at the bottom of the folded web, but can also be embodied as a fin seal along a longitudinal edge of the finished package. The lap or fin seal is typically a heat seal. An alternative is to have a separate sealing device 714 to produce the lap or fin seal. The products travel downstream from forming device 710 or sealing device 714 to transverse sealing device 716 where the folded web is transversely sealed in areas of the folded web between adjacent products. Such seals are typically heat seals. The products are advanced from transverse sealing device 716 to cutting device 718*a* and 718*b*, where the formed and longitudinally and transversely sealed folded web is severed in areas of the folded web between adjacent products, in or near the transverse seals, such that individual packages 720 are produced.

Alternatively, the sealing function of transverse sealing device 716 and the cutting function of cutting device 718*a* and 718*b* can be combined at a single station, rather than being performed at separate locations on the production path.

Web 702 and discrete laminate 724 can be of any suitable dimension and composition, such as those disclosed herein. As discrete laminate 724 or a component thereof is fed to forming device 710, it can be brought into contact with, and optionally anchored to a surface of web 702. This embodiment is shown in FIGS. 25 and 26, where discrete laminate 724 is shown as anchored to web 702 as it progresses toward forming device 710. The panel section, or the second surface of the base strip, can be anchored to web 720. First longitudinal edge 703 of discrete laminate 724 can be seen in FIG. 26. Alternatively, discrete laminate 724 can be fed into forming device 710, and then incorporated into folded web 712 by anchoring the discrete laminate (panel section, second surface of the base strip, or both) to the formed web adjacent to or in the area of the formed web in which the lap or fin seal is made, and in a manner and format analogous to the embodiment of the VFFS pouch and package of FIGS. 10, 17 and 18, but in a horizontal rather than vertical position. In another embodiment, discrete laminate 724 can be pre-applied to web 702 by the supplier of the web, analogous to the embodiment of the VFFS pouch and package of FIG. 13, and the HFFS pouch and process of FIGS. 9A and 9B.

At any suitable time before or during the method of making the package in a continuous horizontal packaging process, the first surface of the base strip is anchored to the panel section 6 to provide the discrete laminate and a first anchor, the second surface of the base strip is anchored to the lay-flat web, the folded web, or the inner surface of the second side panel to provide a second anchor, and the panel section 6, or the portion of the discrete laminate that comprises panel section 6, is anchored to the lay-flat web, folded web, or first side panel to provide a third anchor. Any of these steps can be done e.g. on the lay-flat web prior to supplying the web to the processor, or prior to or as the lay-flat web is advanced to a forming device, or before or after a product is put in the open pouch, as long as the base strip is not anchored to the panel section before product is put in the pouch.

E. Side Seal Bags

Figure 33:
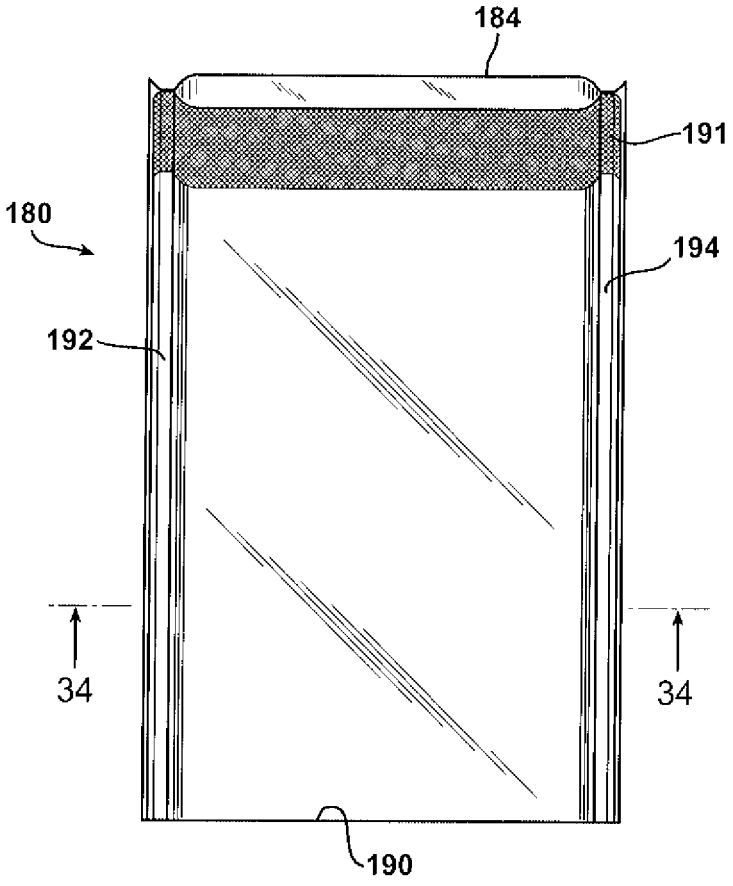
FIG. 33 is a plan view of another embodiment of the invention.
Figure 34:
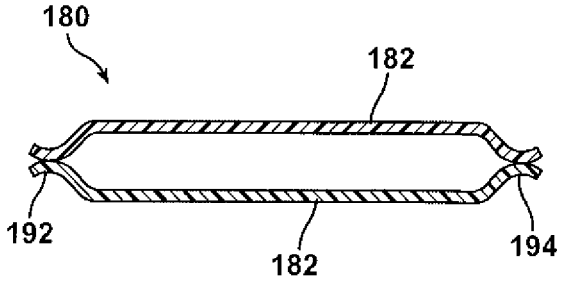
FIG. 34 is a cross sectional view of FIG. 34, viewed along lines 34-34 of FIG. 33.

In one embodiment, and referring to FIGS. 33 and 34, the package of the invention can be made using otherwise conventional bag making equipment and processes. Bags are often made as side seal bags. The side seal bag has a factory-made heat seal at opposite bag edges. The bag bottom is formed by one of two folds of film created during the extrusion of bag tubing during manufacture. The opposite fold of film is slit to form a bag mouth. The bag is typically made from a long length of bag tubing. A method of making side seal bags is disclosed in US 2008/0138478 A1 (Ebner et al.), this patent incorporated herein by reference in its entirety.

FIGS. 33 and 34 illustrate bag 180. FIG. 33 illustrates a side seal bag 180, in a lay-flat view; FIG. 34 illustrates a cross-sectional view taken through section 34-34 of FIG. 33. With reference to FIGS. 33 and 34 together, side seal bag 180 comprises a web 182, first edge 184 defining an open mouth, edge fold 190, first side seal 192, and second side seal 194. Discrete laminate 191 is installed on the individual bag, or on a slit bag tube that is then cut and sealed at predetermined intervals to make a series of side seal bags 180, by any suitable process such as any of those disclosed herein.

A bag can be made by extruding a thermoplastic tube to make a bag tubing; slitting the tubing at one longitudinal edge thereof to make a slit bag tubing; anchoring the discrete laminate as described herein to the slit bag tubing; and transversely cutting and sealing the bag tubing at predetermined intervals to make a plurality of individual bags each with the discrete laminate disposed thereon. The discrete laminate can function as described herein for other embodiments and processes, in providing an easy-open and reclosable package. Some of the steps set out in US 2008/0138478 A1, for making a bag, are optional with respect to the present invention; such steps including irradiation and orientation of the tubing.

At any suitable time before or during the method of making the bag, the first surface of the base strip is anchored to the panel section 6 to provide the discrete laminate and a first anchor seal, the second surface of the base strip is anchored to the bag tubing or slit bag tubing to create a second anchor seal, and the panel section 6, or the portion of the discrete laminate that comprises panel section 6, is anchored to the bag tubing or slit bag tubing to provide a third anchor seal.

The discrete laminate can be anchored to the first side panel of a web, pouch, or package in a number of different configurations. An example is that shown in FIGS. 2A and 2B. Alternatives are shown in FIGS. 35 to 37.

Figure 35:
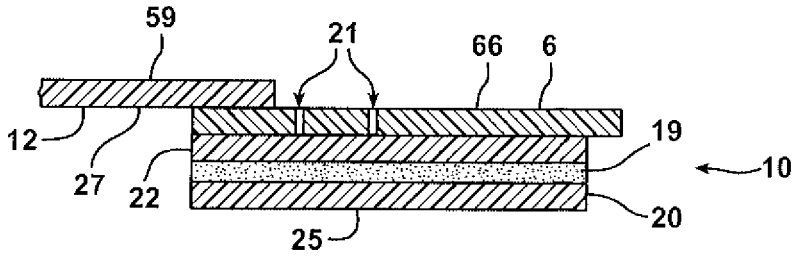
FIG. 35 is a cross sectional view of an alternative embodiment.

FIG. 35 shows the discrete laminate anchored to the first side panel 12 by anchoring a second part of the outer surface 66 of panel section 6 to the inner surface 27 of first side panel 12.

Figure 36:
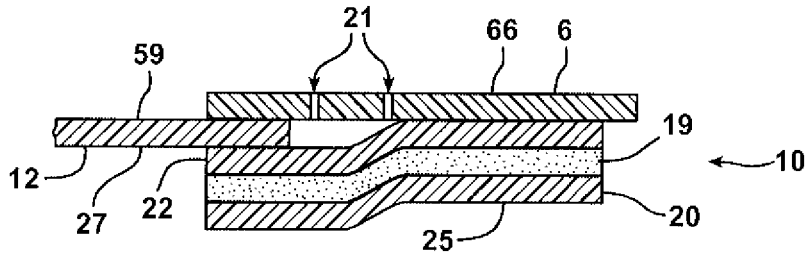
FIG. 36 is a cross sectional view of an alternative embodiment.

FIG. 36 shows the discrete laminate anchored to the first side panel 12 by anchoring a second part of the inner surface 67 of panel section 6 to the outer surface 59 of first side panel 12.

Figure 37:
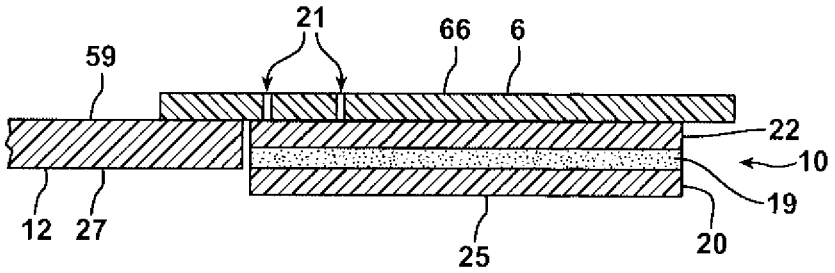
FIG. 37 is a cross sectional view of an alternative embodiment.

FIG. 37 shows the discrete laminate anchored to the first side panel 12 by anchoring a second part of the inner surface 67 of panel section 6 to the outer surface 59 of first side panel 12.

For each of these alternatives, In the event that the anchor is in the form of a seal, appropriate sealants should be present at surfaces to be anchored by sealing.

Method of Operation

Figure 27A:
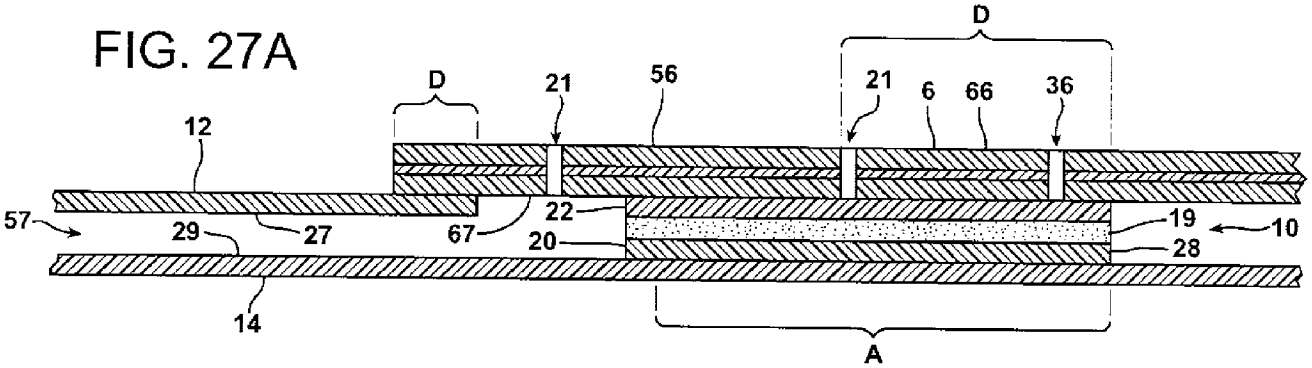
FIGS. 27A, 27B, 27C, 27D, and 27E are each cross-sectional views of a portion of the package, showing a sequence for opening and reclosing the package.
Figure 27B:
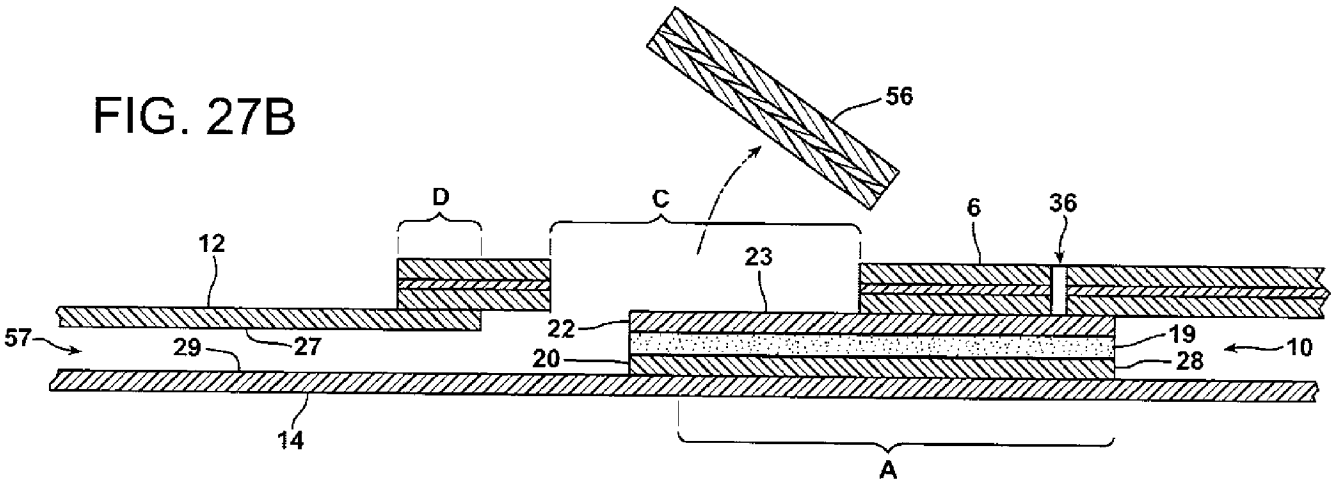
Figure 27C:
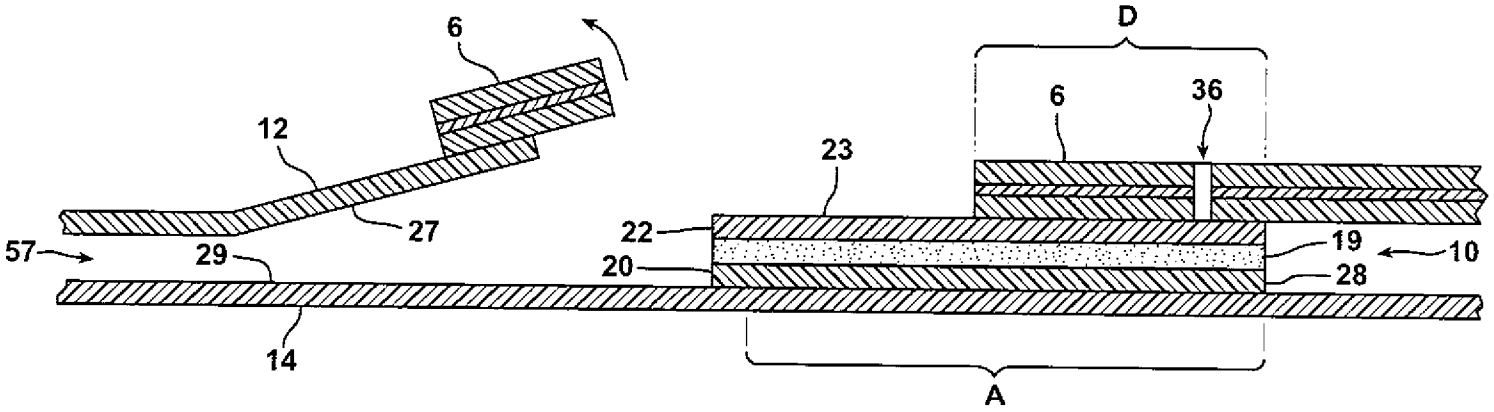
Figure 27D:
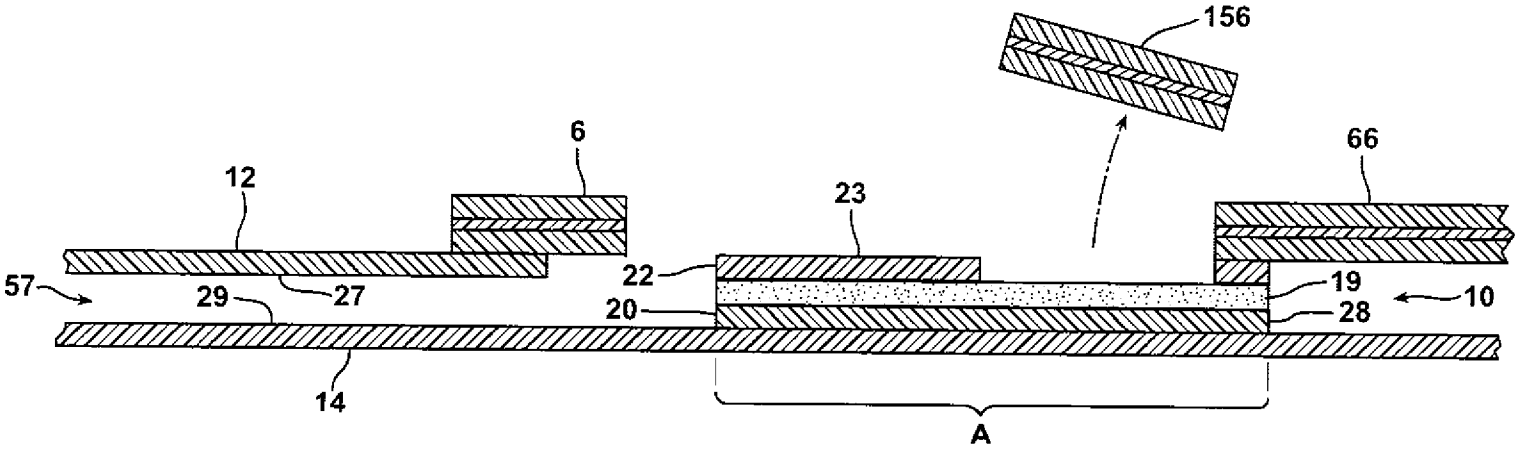
Figure 27E:
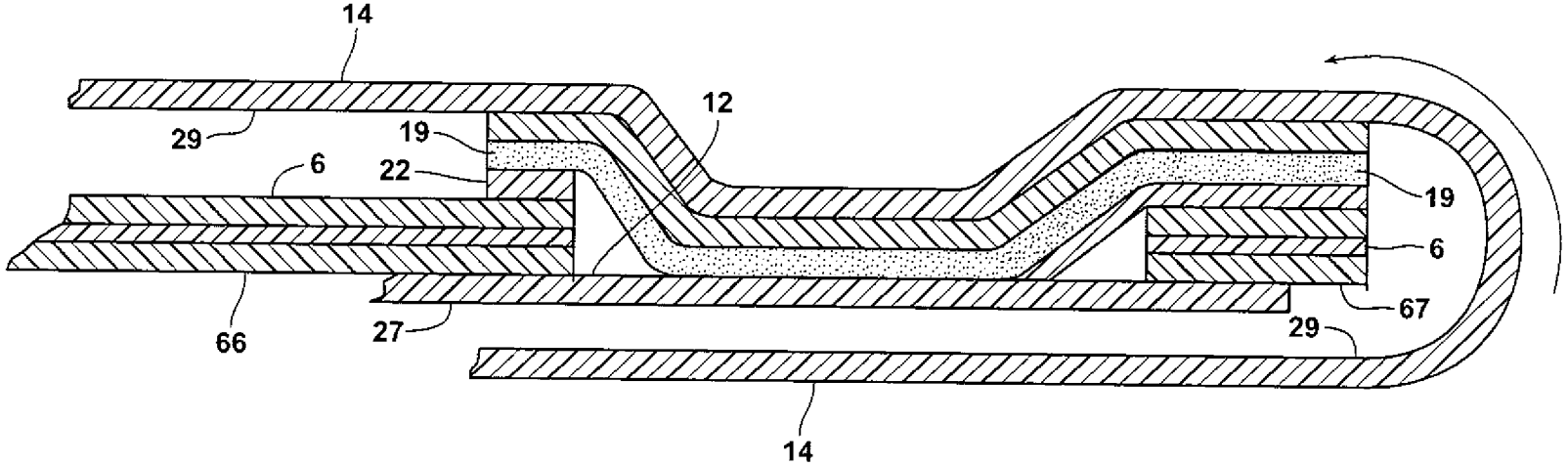
Figure 28B:
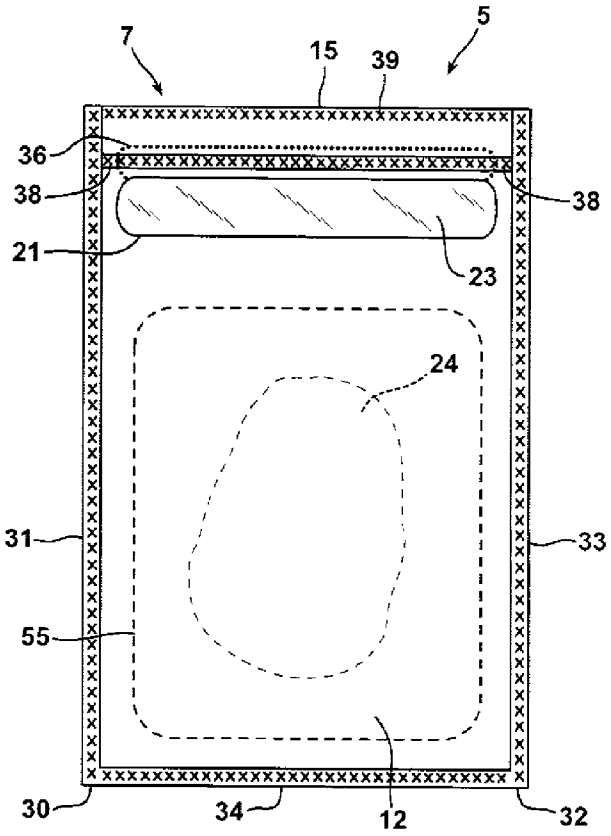
FIGS. 28A, 28B, and 28C are each plan views of an alternative embodiment of the package, showing a sequence for opening the package.
Figure 28A:
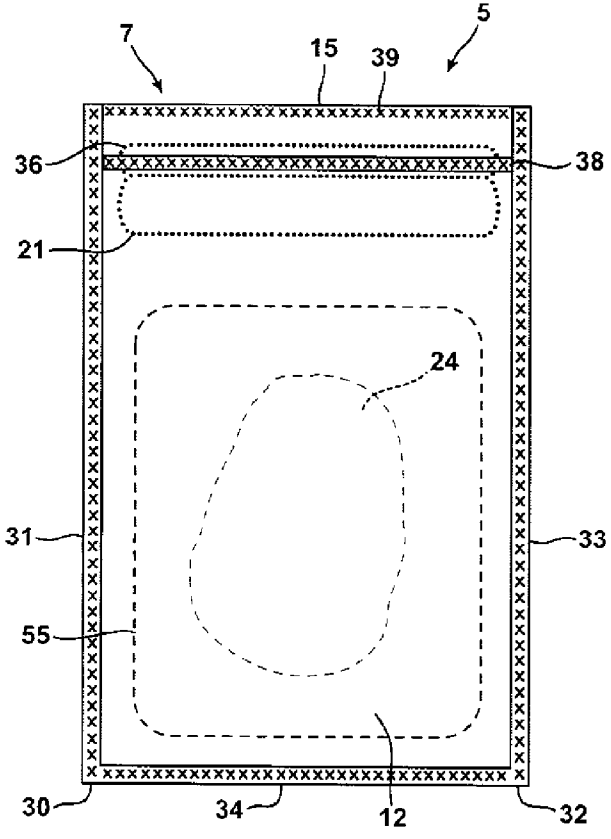
Figure 29:
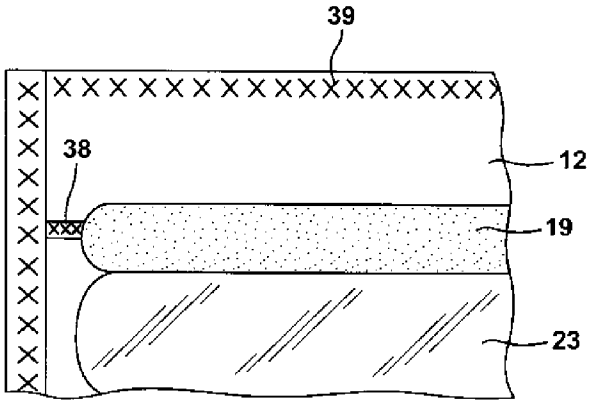
FIG. 29 is an enlarged view of a portion of the package of FIG. 28C.
Figure 28C:
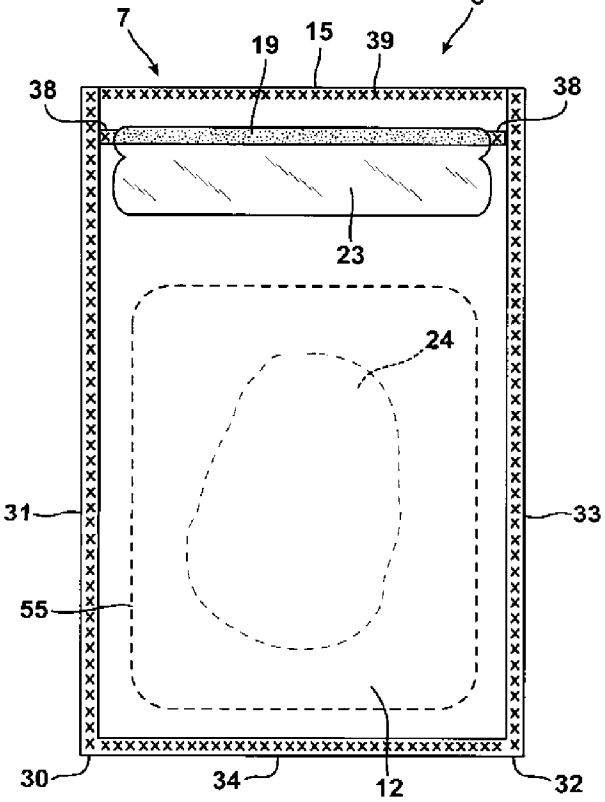

In opening the package of FIGS. 27A to 27E, primary die-cut segment 56 defined by a first closed-loop die cut 21 (see also FIGS. 28A to 28C) is removed (FIG. 27B), and the first end of the remaining portion of panel section 6 is manually grasped and pulled away to open the package and access product in the interior 57 of the package (FIG. 27C). A secondary die cut segment 156 (see FIG. 27D) defined by secondary die cut 36 is then removed. As this action progresses, stress is put on the first anchor seal 63 that bonds a portion of the inner surface of the panel section 12 to sealing segment 22 of base strip 10 in region "D". As force continues to be exerted, sealing segment 22 ruptures down to the PSA layer 19, as a cohesive failure mechanism, and continued pulling partially removes the sealing segment from the discrete strip, by delamination of the strip at the sealing segment/PSA interface, thereby partially exposing the intermediate layer 19 comprising PSA. The package can then be reclosed by folding the first end or top of the package over to bring the PSA into contact with the outside surface of the first side panel 12 (see FIG. 27E). During this opening/reclosing sequence, the anchor in region "A" between second surface 25 of the strip and inner surface 29 of second side panel 14 will typically remain intact, such that a portion of the strip 10 stays on and in contact with surface 29. Here, and in FIGS. 28A through 29, and FIGS. 30B and 30C, more than one die cut is present. The first die cut in some embodiments is close-looped, i.e. the die cut defines a primary die-cut segment that can be displaced or completely removed from the first side panel of the package. The secondary die cut can also be closed-loop (see e.g. FIG. 30C), or can be open-loop and hinged such that the flap formed by a second die cut and a hinge line can be opened without removing the flap from the first side panel of the package (see FIG. 30B).

Figure 30A:
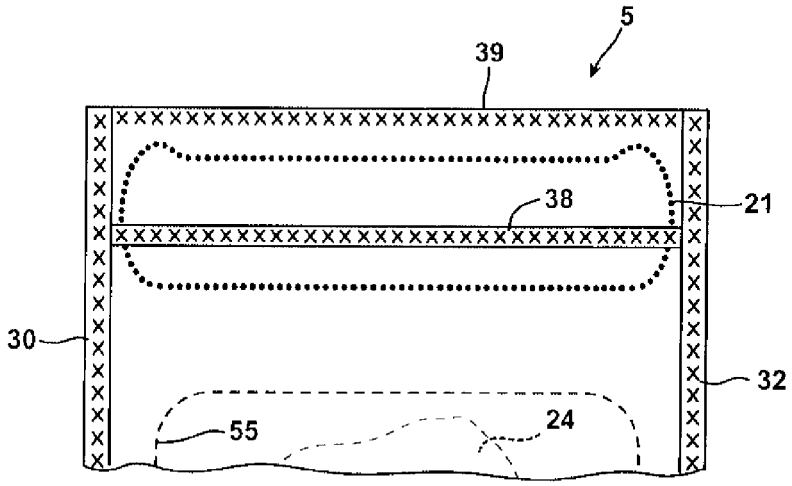
FIGS. 30A, 30B, 30C, and 30D are each a plan view of alternative embodiments.
Figure 30B:
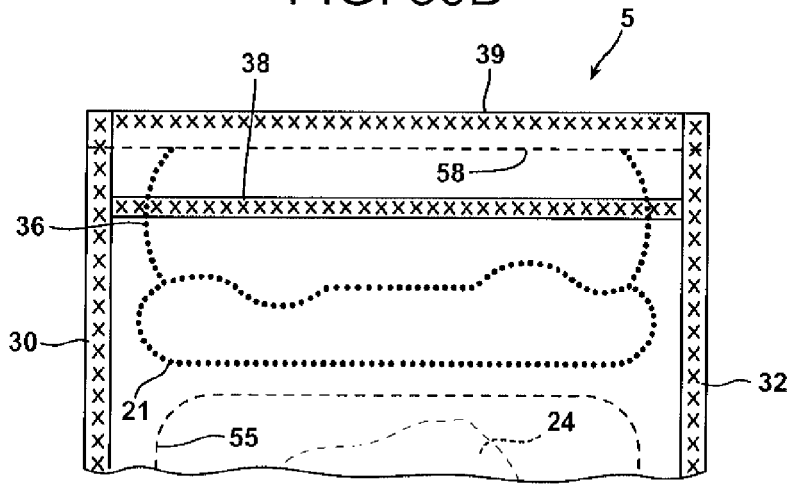
Figure 30C:
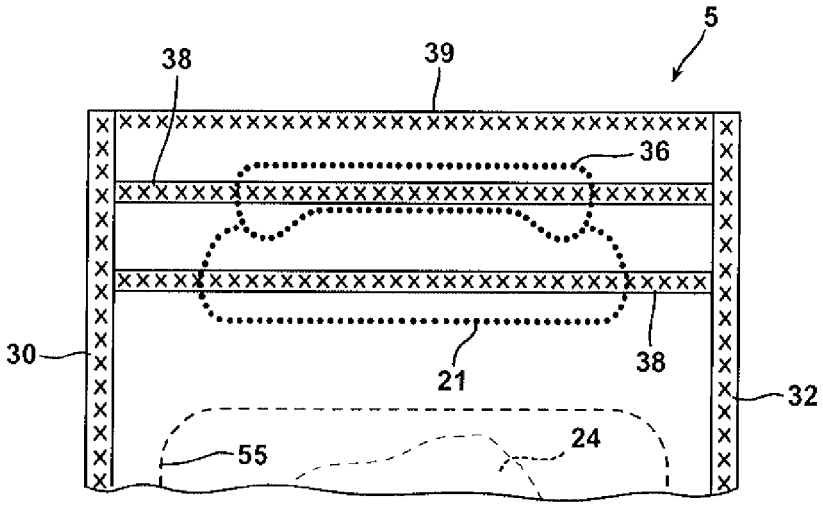
Figure 30D:
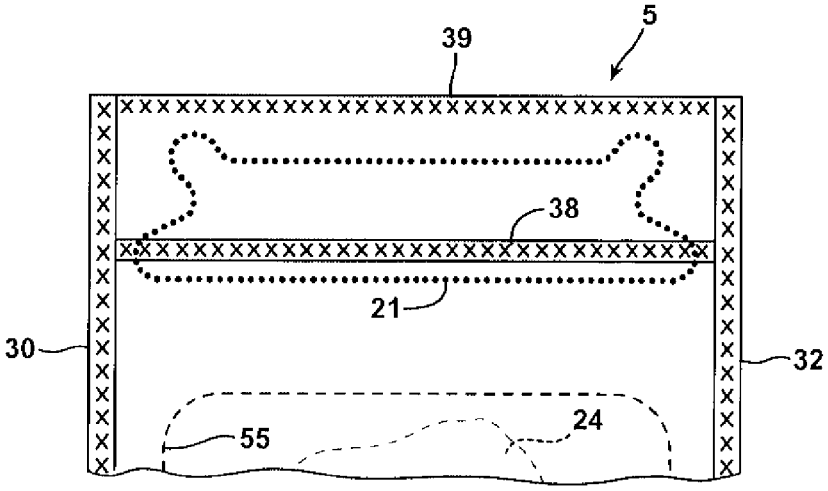

It will be noted in the embodiment of FIG. 30C that the seal 38 furthest from the first (top) end 39 of the package can act as a hermetic seal, allowing the die cut 21 defining the die cut segment to be partially a through-cut to enable the die cut segment to be easily removed, without compromising the hermeticity of the package before opening. The seal 38 closest to the first end of the package acts as an anchor seal that can be used to access the PSA as taught herein, when it is desired to reclose the package. Although the removal of the die cut segment defined by die cut 21 will result in exposure of some of the adhesive of layer 19, the main purpose of the die cut 21 in this embodiment is to provide an easy-open mechanism to open the package and allow access to the package contents.

Alternatively, a single die cut can be used, that is either close-looped (FIGS. 30A and 30D) or includes a hinge line. Each die cut can be of any suitable geometry and depth. In the area of first die cut region "C" on the first side panel of FIGS. 2A and 27A, there is no seal holding the strip to the inner surface 67. This leaves an area of the package where a portion of the panel section can be relatively easily removed. PSA layer 19 is not initially exposed when the package is opened in each of these embodiments. To reclose the package, a secondary die cut segment is removed to expose the PSA. A portion of the second side panel can be folded over to allow the PSA to contact the first side panel. Alternatively, removal of a single or primary die cut segment can expose the PSA as well as provide an opening for accessing product in the package. The package can be opened and reclosed several times.

Method of Making a Die Cut in a Web

A conventional die cutter can be used to create a first die cut 21, and optionally one or more additional die cuts 36 in a web that is used to make panel section 6. Die cuts can be made by any suitable conventional process and equipment. Any suitable pattern of die cut can be used, open or closed-looped, as long as it serves the function of providing an easy open package in which the packaged product can be accessed by means of a die cut segment created at least in part by the die cut. Alternative patterns include elliptical, oval, triangular, three side rectangle, hour glass, "dog bone", and other regular and irregular shapes.

The die cut extends completely through the panel section, or may extend through most of, but not entirely through, the thickness of the panel section. The die cut may extend through e.g. at least 50% of the thickness of panel section 6, e.g. at least 60%, at least 70%, at least 80%, at least 90%, at least 95%, or 100% of the thickness of the panel section.

A laser system can be configured to produce a laser cut that cuts partly or completely through the panel section, or alternatively, a die cut can be made using a mechanical cutting system using rotary engraved dies, or steel rule dies supported in platens as used in reciprocating presses. The choice of die cutting technique depends on several factors, including the thickness and physical nature of the film or web to be cut.

The die cut may sometimes act as a tamper evident feature.

The die cutting of a web used to produce a panel section, the assembling of the discrete laminate from the strip and panel section, and the assembling of a package incorporated a die cut panel section and a base strip, can be done at a single location, but more practically will typically be done at one or more separate locations, with the assembling of the package by a packager using pre-provided discrete laminate prepared elsewhere and provided in advance of the packaging process.

Method of Applying a Panel Section to a Base Strip to Make a Discrete Laminate

Figure 24:
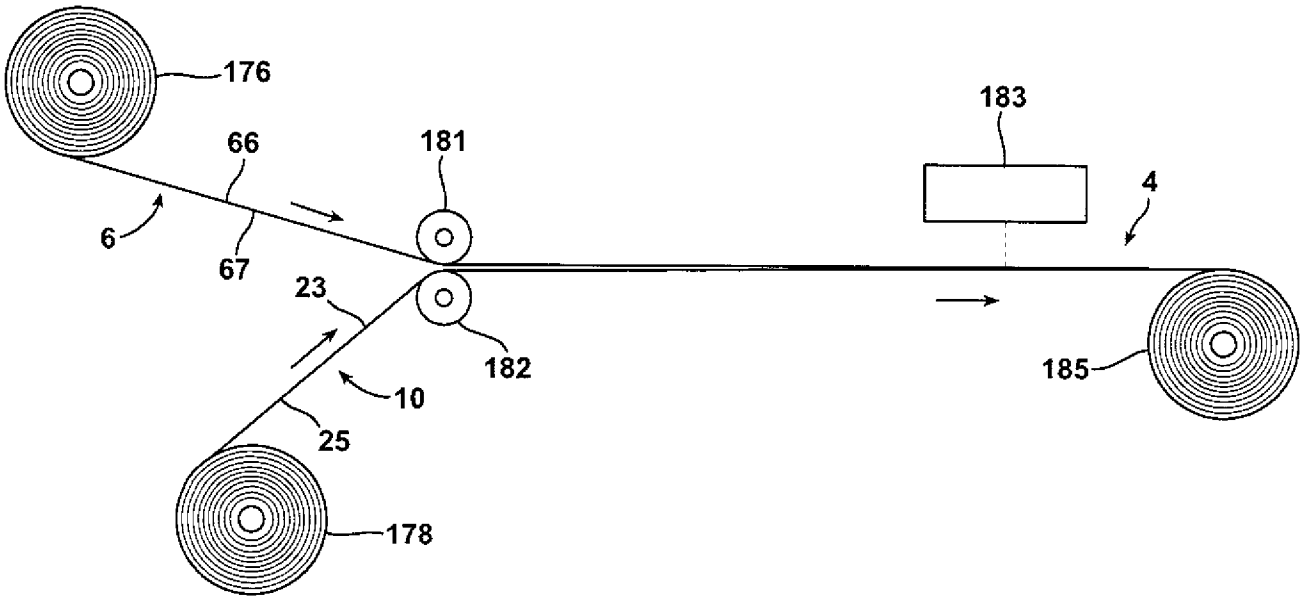
FIG. 24 is a schematic view of an apparatus and process for making a discrete laminate.

FIG. 24 shows a method of applying a panel section to a base strip to make a discrete laminate, comprising the following steps:

1) advancing base strip 10 by suitable motive means (not shown, and well known in the art, such as a motor) from roll 178.

2) advancing panel section 6 from roll 176.

3) bringing strip 10 and panel section 6 together at nip rolls 181,182, and anchoring the strip to the panel section, by suitable means such as a heat sealer (not shown).

4) installing a series of die cuts in panel section at die cutter 183.

5) advancing resulting discrete laminate 4 to take-up roll 185.

The panel section could be die-cut in advance of this process.

Method of Application of the Discrete Laminate to a Web

The discrete laminate can be applied to a web such as a lay-flat web in a number of ways.

In one embodiment, the discrete laminate can be completely assembled, either at the package facility where it will be used to make packages, or at a supplier or converter location. The discrete laminate can then be adhered or anchored to a web as disclosed herein. Anchoring in this embodiment is accomplished by anchoring the panel section of the discrete laminate to a surface of the web, or by anchoring the second surface of the base strip of the discrete laminate to a surface of the web.

In another embodiment, the panel section and base strip are not brought together initially, and the panel section is anchored to one surface of a web, and the strip is separately anchored to an opposite surface of the web, and the base strip is anchored to the inner surface of the panel section at any suitable point in the packaging process. Attachment of the panel section and strip to the web can be done simultaneously, or sequentially with attachment of the panel section either before or after attachment of the strip. In this embodiment, the panel section and tape can be congruent, although they do not have to be. As an example, with reference to FIG. 12, in an alternative embodiment, 54 can refer to the panel section 6 only, and a separate roll can feed a strip 10 onto the opposite longitudinal edge 62 of the web, and anchored thereto, such that when or after the web is folded as described herein, the strip is anchored to panel section 6. Anchoring of panel section 6 and strip 10 to web 41 can be done at any suitable time in the manufacturing sequence.

In yet another alternative, one of the panel section 6 and strip 10 can be anchored to web 41 as shown in FIG. 12, and the other of the panel section 6 and strip 10 can be pre-anchored to web 41 at the same or a different location on the web by the supplier of the web prior to the packaging method disclosed herein.

These same alternatives can be applied mutatis mutandis to the alternative processes (VFFS, lidstock/formed web, continuous horizontal packaging/side seal bag making) disclosed herein.

PACKAGE EXAMPLES

Example 1

A package is made in accordance with the embodiment illustrated in FIG. 2B and described herein, in a horizontal form/fill/seal system. First and second side panels 12 and 14 respectively each comprise H7530B, a laminate having the construction:

| chemically treated PET | polyurethane adhesive | coextruded barrier film |
|---|---|---|

where the PET is a biaxially oriented polyester film, and the coextruded barrier film has the construction:

| Layer 1 PE2 | Layer 2 EV1 | Layer 3 AD2 | Layer 4 OB1 | Layer 5 AD2 | Layer 6 EV1 | Layer 7 76% PE3 + 20% PE4 + 4% AB1 |
|---|---|---|---|---|---|---|
| 0.63 | 0.33 | 0.19 | 0.23 | 0.19 | 0.33 | 0.63 |

The overall thickness of the coextruded barrier film is about 2.50 mils. Layer gauges in mils for each layer are indicated below each layer. Layer 7 is the layer of the barrier film adhered, by the adhesive, to the PET film. Layer 1 is the heat sealant layer of the film, and the EAO (PE2) of layer 1 forms the inner or sealant surface of the package, facing the contained product, and the PET forms the outer or skin surface of the package. The thickness of the PET film is about 0.48 mils. The overall thickness of the laminate is about 3.0 mils.

Alternatives to the composition of layer 7 include various combinations of materials, including:

96% PE3+4% AB1.

100% PE3.

76% PE3+20% PE6+4% AB1.

The discrete strip of the package is a film as described herein for Example 11.

Before the package is made, the discrete strip is anchored to the H7530B web (specifically, to layer 1 of the coextruded barrier film of the H7530B laminate) to form first and second anchor seals while the latter is in a lay-flat condition. A closed loop die cut is made in the web by a $CO_2$ laser prior to applying the strip to the web; the die cut defining a die cut segment that is positioned so as to result in the package as shown in FIG. 2D.

Example 2

A package like that of Example 1 is made, but in which the coextruded barrier film of the first and second side panel is a nine-layer film with a composition very similar to the seven layer film construction of Example 1, but having an additional intermediate layer of EV1, and an additional intermediate layer of a LDPE or a blend including LLDPE.

The above descriptions are those of embodiments of the invention. All parts and percentages are by weight, unless otherwise indicated or well understood in the art. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. All references to ASTM tests are to the most recent, currently approved, and published version of the ASTM test identified, as of the priority filing date of this application. Each such published ASTM test method is incorporated herein in its entirety by reference.

Terms referring to polymers, such as polyester, polyamide, and polyolefin, refer herein to both homopolymers and copolymers thereof, unless otherwise specified.

With reference to the drawings, the flow of materials is in the direction of the arrows.

Those of skill in the art will recognize that the drawings herein are not necessarily to scale, and certain features of the invention may be graphically exaggerated for clarity.

Both the web or webs used in the manufacture of the package according to the invention, and the strip and tape of the discrete laminate of the invention, can be made by any suitable process, including coextrusion, extrusion coating, extrusion lamination, and conventional lamination using polyurethane or other adhesives. These manufacturing processes are well known in the art. Extrusion can be done in annular or flat dies. The extrudate can be hot blown or cast, and optionally solid-state oriented as desired. Chemical or electronic crosslinking of one or more layers of the webs or the strip can be done. Both web and discrete laminate can be advanced by suitable motive means (not shown, and well known in the art, such as a motor) from their respective rolls.

A package according to the invention can optionally carry printed indicia, which can be decorative or informational in nature. Decorative printed indicia can include a logo, a trademark, product information, etc. with text and/or graphics.

Printed indicia can be in the form of a message e.g. "easy open" or "open here". This can be printed in scattered process (i.e. registration is not required) on or near the first end of the package. The message is surface printed or reverse printed.

In the embodiments disclosed herein, the first end of the package can be sealed, typically where two webs are used to make the package. Alternatively, the first end of the package can be a fold, e.g. where a single web of material is used to make the package.

The present invention, including the package and methods as disclosed herein, is provided in several embodiments in the absence of: plastic zipper closures; press-to-close or slide zippers; interlocking closures; reclosable fasteners with interlockable fastener elements; interlocking rib and groove elements having male and female profiles; interlocking alternating hook-shaped closure members, and the like. The package of the invention is provided herein in several embodiments in the absence of a discrete release liner for a PSA layer or coating. None of these aforementioned closures, zippers, elements, etc. is present in the package of the invention.

Although the invention is described in some embodiments herein as a package comprising a pouch comprising a first and second side panel each having a top edge, a first side edge, and a second side edge, those skilled in the art will understand, after a review of this disclosure, that in some embodiments, wherein a single web is used, the terms "side panel", "top edge", "first side edge", "second side edge", and the like are used for convenience to describe the relative locations or regions on a single web made into a pouch, so that the overall geometry of the package, and relative positions of the various features of the invention can be described. Thus, for instance, the first and second panels in a single web embodiment of the invention can be simply defined regions of the pouch, and the package made therefrom, and side edges are simply the side end lines of those regions. In such embodiments, the line of joinder of the side edges are the two side folds in the web that define the sides of the package. In contrast, in embodiments with two webs, each web when produced will have an identifiable first and second side edge, that will each be joined to a respective side edge of a second web.

Although the first and second side panels are shown in various embodiments as having the same length, the second side panel can be longer than the first side panel, i.e. extend beyond the first end of the first side panel. The extended portion can accommodate a hang tab with a hole therein.

In some embodiments, a die cut can be installed on the second side panel near its first end, or the region of a lay-flat web or folded web that will form the second side panel, that can act as a fold line for facilitating reclosure of the package. This die cut, which can be a score, can be of any suitable geometry, e.g. a straight line, positioned to ease or direct the folding of the second side panel to reclose the package after opening.

Those skilled in the art will appreciate that in describing a panel, strip or the like being "sealed" to another panel, strip, or the like, sealing is done by conventional means as described, and typically occurs in seal widths consistent with industry practice for packaging.

Packages of the various embodiments of the invention disclosed herein can optionally be vacuumized or gas flushed by otherwise conventional means. A package in accordance with the invention can contain a modified atmosphere.

What is claimed is:

1. An easy-open and reclosable package comprising:

a) a pouch comprising i) a first and second side panel each comprising an outer and inner surface, a first and second side edge, and a first and second end, the first and second side panels joined together along their respective first and second side edges with a seal;

ii) a first end;

iii) a second end defined by the second ends of the first and second side panels respectively;

iv) a discrete laminate comprising (a) a base strip comprising a first and second surface, a first and second side edge, a first and second end, a sealing segment, a backing segment, and an intermediate layer disposed between the sealing and backing segments and comprising a pressure sensitive adhesive, and (b) a panel section comprising an outer and inner surface, a first and second side edge, a first and second end, and a first and second die cut, wherein the panel section and the second side panel are joined together along their respective first and second side edges with a seal;

v) a first anchor seal whereby the first surface of the base strip is anchored to the inner surface of the panel section;

vi) a second anchor seal whereby the second surface of the base strip is anchored to the inner surface of the second side panel;

vii) a third anchor seal whereby the panel section is anchored to the first side panel;

viii) the first die cut defining a closed loop primary die cut segment, comprising a first portion where the first die cut extends partially through the panel section, and a second portion where the first die cut extends entirely through the panel section, the closed loop primary die cut segment being spaced from the first and second ends of the package, and so arranged with respect to the base strip that the package is adapted to be opened by removing the closed loop primary die cut segment;

ix) the second die cut defining a closed loop secondary die cut segment, comprising a first portion where the second die cut extends partially through the panel section, and a second portion where the second die cut extends entirely through the panel section, the closed loop secondary die cut segment being spaced from the first and second ends of the package and disposed between the closed loop primary die cut segment and an end of the package, the closed loop secondary die cut segment so arranged with respect to the base strip that when the second secondary die cut segment is removed, the sealing segment is at least partially removed from the base strip, and the intermediate layer comprising the pressure sensitive adhesive is at least partially exposed, such that the package can thereafter be reclosed by adhering the pressure sensitive adhesive to the first side panel; and ix) the first end of the panel section joined to the second side panel; and b) a product disposed in the pouch.

2. The easy-open and reclosable package of claim 1 wherein the closed loop primary die cut segment is spaced apart from a first and second side seal respectively.

3. The easy-open and reclosable package of claim 1 wherein the closed loop secondary die cut segment is spaced apart from a first and second side seal respectively.

4. The easy-open and reclosable package of claim 1 wherein a second part of the outer surface of the panel section is anchored to the inner surface of the first side panel.

5. The easy-open and reclosable package of claim 1 wherein a second part of the inner surface of the panel section is anchored to the outer surface of the first side panel.

* * * * *